US012247390B2

(12) United States Patent
Wilson et al.

(10) Patent No.: US 12,247,390 B2
(45) Date of Patent: Mar. 11, 2025

(54) STRUCTURAL PLATES AND METHODS OF CONSTRUCTING ARCH-SHAPED STRUCTURES USING STRUCTURAL PLATES

(71) Applicant: AIL INTERNATIONAL INC., Sackville (CA)

(72) Inventors: Michael W. Wilson, Sackville (CA); Wayne Ford, Moncton (CA)

(73) Assignee: AIL International Inc., Sackville (CA)

( * ) Notice: Subject to any disclaimer, the term of this patent is extended or adjusted under 35 U.S.C. 154(b) by 179 days.

(21) Appl. No.: 17/769,946

(22) PCT Filed: Oct. 19, 2020

(86) PCT No.: PCT/CA2020/051404

§ 371 (c)(1),
(2) Date: Apr. 18, 2022

(87) PCT Pub. No.: WO2021/072560

PCT Pub. Date: Apr. 22, 2021

(65) Prior Publication Data

US 2022/0381023 A1 Dec. 1, 2022

Related U.S. Application Data

(60) Provisional application No. 62/923,236, filed on Oct. 18, 2019.

(51) Int. Cl.
*E04B 1/32* (2006.01)
*E04B 1/38* (2006.01)
(Continued)

(52) U.S. Cl.
CPC ..... *E04B 1/3205* (2013.01); *E04B 1/388* (2023.08); *E04C 2/322* (2013.01); *E04C 2/50* (2013.01);
(Continued)

(58) Field of Classification Search
CPC ..... E04B 1/3205; E04B 1/388; E04B 2001/3276; E04B 2103/06; E04C 2/322; E04C 2/50; E04C 2/08
(Continued)

(56) References Cited

U.S. PATENT DOCUMENTS 2,073,185 A * 3/1937 Shafer ..... E01F 5/005 138/160
2,536,759 A * 1/1951 Martin ..... E21D 11/14 405/153
(Continued)

FOREIGN PATENT DOCUMENTS

CA 3049104 A1 8/2018
CL 49971 4/2011
(Continued)

OTHER PUBLICATIONS

European Patent Office, Extended European Search Report dated Oct. 27, 2023 for European Patent Application No. 20876169.2.
(Continued)

*Primary Examiner* — James J Buckle, Jr.
(74) *Attorney, Agent, or Firm* — Mintz, Levin, Cohn, Ferris, Glovsky and Popeo, P.C.

(57) ABSTRACT

Structural plates and methods of constructing arch-shaped structures using structural plates. Structural plates may include a combination of features including: an outer structural plate having adjacent circumferential apertures respectively spaced nominally greater than adjacent circumferential apertures of an inner structural plate; and the outer structural plate having nominally 5 enlarged or differently shaped circumferential apertures (as compared to circumferential apertures of the inner structural plate) such that the embodiment structural plates may be radiused to a variety of different radii while achieving desirable overlapping alignment of apertures along overlapping circumferential edges
(Continued)

for receiving fasteners therein. Joiner plates may be provided for interconnecting structural plates along transverse edges in a non-overlapping arrangement, 10 thereby reducing the quantity of structural plate material that otherwise would be needed for a given circumferential length of the arch-shaped structure.

24 Claims, 41 Drawing Sheets

(51) Int. Cl.
*E04B 5/02* (2006.01)
*E04C 2/32* (2006.01)
*E04C 2/08* (2006.01)

(52) U.S. Cl.
CPC ... *E04B 2001/3276* (2013.01); *E04B 2103/06* (2013.01); *E04C 2/08* (2013.01)

(58) Field of Classification Search
USPC ..... 52/86
See application file for complete search history.

(56) References Cited

U.S. PATENT DOCUMENTS 3,097,494 A * 7/1963 Chapron ..... E21D 11/20 405/153
3,300,923 A * 1/1967 Behlen ..... E04B 1/3205 D25/19
3,638,434 A 2/1972 Delaere
4,099,359 A * 7/1978 Sivachenko ..... E04C 2/32 52/630
5,233,799 A 8/1993 Abukawa
5,326,191 A * 7/1994 Wilson ..... E01F 5/005 285/903
5,385,423 A * 1/1995 Abukawa ..... B21D 5/08 403/186
5,611,178 A * 3/1997 Aubert ..... E04H 9/12 135/901
D566,852 S * 4/2008 Gaster ..... D25/1
8,157,475 B2 * 4/2012 Kim ..... E02D 29/045 52/783.11
8,418,424 B2 * 4/2013 Davis ..... E04C 2/32 52/630
9,085,977 B2 7/2015 Bonomi et al.
9,163,392 B2 * 10/2015 Wilson ..... E01F 5/005
9,869,090 B2 * 1/2018 Wilson ..... E04C 2/322
9,938,710 B2 * 4/2018 Guo ..... E04B 1/3205
2003/0143028 A1 7/2003 Wilson

FOREIGN PATENT DOCUMENTS

CL 53603 7/2012
CN 205676788 U 11/2016
CN 210031561 U 2/2020
GB 278246 A 10/1927
JP H0544227 A 2/1993
KR 19990027293 U 7/1999
KR 20-0166984 Y1 1/2000
KR 100704395 B1 4/2007
KR 20130090982 A 8/2013
WO 2018143567 A1 8/2018

OTHER PUBLICATIONS

Chilean Patent Office, Search Report dated Jan. 16, 2024 for Chilean Patent Application No. 202200957.
Chilean Patent Office, Expert Report dated Jan. 16, 2024 for Chilean Patent Application No. 202200957.
Canadian Intellectual Property Office, Office Action dated Jan. 30, 2024 for Canadian Patent Application No. 3,157,809.
Chilean Patent Office, Search Report dated Sep. 13, 2023 for Chilean Patent Application No. 202200957.
Chilean Patent Office, Expert Report dated Sep. 13, 2023 for Chilean Patent Application No. 202200957.
World Intellectual Property Organization, International Search Report and Written Opinion dated Jan. 18, 2021 for PCT Application No. PCT/CA2020/051404.

* cited by examiner

STRUCTURAL PLATES AND METHODS OF CONSTRUCTING ARCH-SHAPED STRUCTURES USING STRUCTURAL PLATES

CROSS REFERENCE TO RELATED APPLICATIONS

This application claims priority from U.S. provisional patent application No. 62/923,236, entitled "STRUCTURAL PLATES AND METHODS OF CONSTRUCTING ARCH-SHAPED STRUCTURES USING STRUCTURAL PLATES", filed on Oct. 18, 2019, the entire contents of which are hereby incorporated by reference herein.

FIELD

The present disclosure generally relates to structural plates, and in particular to interconnecting devices and methods for constructing arch-shaped structures from structural plates.

BACKGROUND

Structural plates may be constructed from a variety of materials, such as steel, aluminum, polycarbonate, or the like, and may be configured as flat plates, corrugated plates, or any other geometric configuration for providing structural support or transferring load forces.

Structural plates may be used to construct or support underpass systems, such as culverts, buried thoroughfares, tunnels, bridges, portals, or the like. As structural plate applications evolve to support longer or wider tunnels, heavier loads, higher stockpiles, or deeper portals, structural plate thickness may incrementally be increased.

SUMMARY

The present disclosure describes structural plates and methods of constructing arch-shaped structures using structural plates. Arch-shaped structures may also be known as box-shaped structures. Arch-shaped structures may be constructed from a plurality of structural plates. Respective structural plates may be interconnected with adjacent structural plates along transverse plate edges or circumferential plate edges. Respective structural plates may be radiused or otherwise curved, thereby contributing to the form of the arch-shaped or box-shaped structure.

Embodiments described herein may include joiner plates for interconnecting structural plates along transverse edges. Interconnecting structural plates along transverse edges via embodiments of joiner plates may reduce the quantity of required overlapping interconnections for constructing a given arch-shaped structure, thereby reducing the quantity of structural plate material that otherwise would be needed for a given circumferential length of the arch-shaped structure.

Embodiments described herein may provide structural plates having a generic circumferential length, which may be sectioned or cut to desirable circumferential length as required for particular box-shaped or arch-shaped structure infrastructure projects. Embodiments of joiner plates described herein may be configured to interconnect custom-length structural plates, thereby reducing requirements to pre-manufacture numerous stock-keeping units (SKUs) or structural plate versions having pre-positioned transverse edge apertures or pre-defined structural plate dimensions.

In some scenarios, structural plates may have a defined thickness. As structural plates may be radiused, when circumferential apertures proximal to a circumferential edge of a structural plate are positioned to overlap circumferential apertures of an adjacent structural plate, at least a subset of the overlapping apertures may not substantially align. Misaligned overlapping apertures may make it challenging to insert fasteners within the respective overlapping apertures for securing adjacent structural plates along respective circumferential edges.

Embodiments described herein may include structural plates with circumferential aperture features that may provide desirable overlapping alignment of circumferential apertures for a range of structural plate radii, thereby reducing the number of structural plate versions or SKUs for supporting infrastructure projects. In some embodiments, structural plates including the circumferential aperture features disclosed herein may be radiused with a radius value that may be within a large range of radius values (e.g., range may include values spanning 30 or more meters) and may provide the desirable overlapping alignment of circumferential apertures disclosed herein.

In some embodiments, structural plates may include circumferential aperture-to-aperture spacing features contributing to desirable overlapping alignment of circumferential apertures. In some embodiments, the circumferential aperture-to-aperture spacing of a first structural plate may be greater than the circumferential aperture-to-aperture spacing of a second structural plate by a margin value, such that, when the first structural plate may be interconnected with the second structural plate along an overlapping arrangement at adjacent circumferential edges, circumferential apertures of the first structural plate may be in a desirable overlapping alignment with circumferential apertures of the second structural plate for receiving fasteners within the respective overlapping apertures.

In some embodiments of structural plates described herein, the plurality of circumferential apertures of the first structural plate may be slotted apertures and the plurality of circumferential apertures of the second structural plate may be substantially round apertures. The round apertures may have a diameter sized to be substantially equal to a slot width dimension of the slotted apertures of the first structural plate. Embodiments of structural plates disclosed herein may include features to address scenarios where centroids of circumferential apertures of pairs of structural plates may be misaligned, while maximizing structural integrity of respective circumferential edges.

Embodiments of the present disclosure may contribute to providing fewer number of structural plate versions for supporting a wide range of structural plate requirements (e.g., range of structural plate radii, structural plate circumferential length, among other examples), while achieving desirable overlapping alignment of circumferential apertures along overlapping circumferential edges. For example, various embodiments of structural plates may include a combination of: (i) an outer structural plate having adjacent circumferential apertures respectively spaced nominally greater than adjacent circumferential apertures of an inner structural plate; and (ii) the outer structural plate having nominally enlarged circumferential apertures (as compared to circumferential apertures of the inner structural plate) such that the embodiment structural plates may be radiused to a variety of different radii while achieving desirable overlapping alignment of apertures along overlapping circumferential edges for receiving fasteners therein.

In an aspect, the present disclosure describes an arch-shaped structure. The arch-shaped structure may include: a pair of structural plates respectively having plate corrugations extending transversely of a longitudinal length of the arch-shaped structure, the respective structural plates including a transverse end having at least one plate aperture adjacent a transverse edge; and a joiner plate securing the pair of structural plates in non-overlapping arrangement at the respective transverse edges of the pair of structural plates, wherein the joiner plate includes joiner corrugations nested with the plate corrugations, and wherein the joiner plate includes at least one joiner aperture aligning with the at least one plate aperture of the respective structural plates to receive fastening bolts.

In some embodiments, the joiner plate may secure the pair of structural plates in non-overlapping abutment at the respective transverse edges.

In some embodiments, at least one of the pair of structural plates may be joined to a third structural plate by overlapping abutment along a circumferential plate edge.

In some embodiments, the respective structural plates may include a first circumferential plate edge having a first series of spaced apertures adjacent to the first circumferential plate edge, the respective spaced apertures being successively spaced from the transverse edge. The respective structural plates may include a second circumferential plate edge having a second series of spaced apertures adjacent to the second circumferential plate edge, the respective spaced apertures of the second series of spaced apertures being offset from the first series of spaced apertures relative to the transverse edge.

In some embodiments, the offset of the respective spaced apertures of the second series of spaced apertures from the first series of spaced apertures relative to the transverse edge may be a function of the structural plate thickness.

In some embodiments, at least one of a pitch, depth, or radius of the joiner corrugations differs from a pitch, depth, or radius of the plate corrugations to allow nesting of the joiner corrugations with the plate corrugations.

In some embodiments, the joiner plate may include a lateral member affixed within at least one trough of the joiner corrugations.

In some embodiments, the respective structural plates may include a pair of circumferential plate edges. The joiner plate may include a first circumferential joiner edge and a second circumferential joiner edge. The first circumferential joiner edge may overlap a first circumferential plate edge and the second circumferential joiner edge is positioned within a trough of the respective structural plates.

In some embodiments, the pair of structural plates may include a first structural plate having a first series of spaced apertures proximal to at least one circumferential plate edge of the first structural plate. The arch-shaped structure may include: an adjacent structural plate having a second series of spaced apertures proximal to at least one circumferential plate edge of the adjacent structural plate in overlapping arrangement with the first series of spaced apertures for receiving at least one fastener within overlapping apertures of the first series and the second series. A first aperture-to-aperture spacing distance between adjacent aperture pairs of the first series of spaced apertures may be greater than a second aperture-to-aperture spacing distance between adjacent aperture pairs of the second series of spaced apertures.

In some embodiments, the first series of spaced apertures may include slotted apertures in overlapping arrangement with the second series of spaced apertures.

In some embodiments, the second series of spaced apertures may include circular apertures having a diameter substantially equal to a width of the slotted apertures.

In some embodiments, the respective structural plates may include a pair of circumferential plate edges. The joiner plate may include a pair of circumferential joiner edges. The respective circumferential joiner edges may overlap a corresponding respective circumferential plate edge.

In some embodiments, a sealing compound may be received within at least one non-overlapping abutment of the respective transverse edges of the pair of structural plates.

In some embodiments, the joiner plate may include a brake between transverse ends of the joiner plate.

In some embodiments, the joiner plate may secure the pair of structural plates in non-overlapping abutment at the respective transverse edges of the pair of structural plates on an inner surface of the pair of structural plates.

In another aspect, the present disclosure may provide an arch-shaped structure. The arch-shaped structure may include: a pair of structural plates including a transverse end having at least one plate aperture adjacent a transverse edge and a joiner plate securing the pair of structural plates in non-overlapping abutment at the respective transverse edges of the pair of structural plates, wherein the joiner plate includes at least one joiner aperture aligning with the at least one plate aperture to receive fastening bolts.

In some embodiments, the respective structural plates may have plate corrugations extending transversely of a longitudinal length of the arch-shaped structure. The joiner plate may include joiner corrugations nested with the plate corrugations.

In some embodiments, at least one of a pitch, depth, or radius of the joiner corrugations may differ from a pitch, depth, or radius of the plate corrugations to allow nesting of the joiner corrugations with the plate corrugations.

In some embodiments, at least one of the pair of structural plates may be joined to a third structural plate by overlapping abutment along a circumferential plate edge.

In another aspect, the present disclosure may provide a method of assembling an arch-shaped structure. The method may include: positioning a pair of structural plates in non-overlapping arrangement at respective transverse edges of the pair of structural plates; placing a joiner plate adjacent a portion of the non-overlapping arrangement such that at least one joiner plate aperture aligns with at least one structural plate aperture of the respective structural plates; and fastening at least one fastening bolt in the at least one joiner plate aperture that is aligned with the at least one plate aperture of the respective structural plates.

In some embodiments, the respective structural plates may include plate corrugations extending transversely of a longitudinal length of the arch-shaped structure. The joiner plate may include joiner corrugations nested with the plate corrugations. The method may include: aligning the plate corrugations with the joiner corrugations to nest the joiner corrugations with the plate corrugations.

In some embodiments, the method may include: positioning a third structural plate along a circumferential plate edge of at least one of the pair of structural plates in overlapping abutment; and fastening a fastening bolt in aligned plate apertures proximal the respective circumferential plate edges of the third structural plate and at least one of the pair of structural plates.

In some embodiments, fastening the at least one fastening bolt may join the pair of structural plates to form a structural ring. The method may include: assembling a first set of structural rings; positioning, on a foundation, the first set of structural rings successively and respectively placed apart from an adjacent structural ring in a longitudinal direction of the arch-shaped structure; positioning additional structural rings between respective spaced-apart structural rings of the first set of structural rings, thereby lapping circumferential edges of the additional structural rings atop the respective spaced-apart structural rings of the first set of structural rings; and fastening the additional structural rings to the respective structural rings of the first set along the circumferential edges.

In another aspect, a method of assembling an arch-shaped structure may include: sectioning a first structural plate to provide a custom length plate, the first structural plate including a circumferential end having a first plurality of circumferential apertures proximal to a circumferential edge, the first plurality of circumferential apertures having a first recurring aperture-to-aperture spacing between respective pairs of adjacent apertures, wherein sectioning the structural plate provides a custom transverse edge; positioning an adjacent transverse edge of an adjacent structural plate in non-overlapping arrangement with the custom transverse edge to maintain the first recurring aperture-to-aperture spacing between a circumferential aperture proximal the custom transverse edge and a circumferential aperture proximal the adjacent transverse edge of the adjacent structural plate; and securing a joiner plate at the non-overlapping arrangement to secure the first structural plate to the adjacent structural plate.

In some embodiments, the non-overlapping arrangement is a non-overlapping abutment.

In some embodiments, the first recurring aperture-to-aperture spacing between respective pairs of adjacent apertures is a circumferential distance along the circumferential edge.

In some embodiments, the method may include: obtaining an under structural plate for interconnecting with the first structural plate along the first circumferential edge, the under structural plate having a second plurality of circumferential apertures proximal to a second circumferential edge; and positioning the first circumferential edge in overlapping arrangement with the second circumferential edge such that respective apertures of the first plurality of circumferential apertures are substantially aligned with corresponding apertures of the second plurality of circumferential apertures for receiving fasteners therein.

In some embodiments, the first plurality of circumferential apertures may be slotted apertures. The second plurality of circumferential apertures may be round apertures having a diameter substantially equal to a width of the slotted apertures.

In some embodiments, when a centroid of a first circumferential aperture is misaligned with a centroid of a second circumferential aperture, an area circumscribed by second circumferential aperture may substantially overlap a portion of an area circumscribed by the first circumferential aperture.

In some embodiments, the method may include: radiusing the first structural plate and an under structural plate based on a common radius, the under structural plate for interconnecting with the first structural plate along the first circumferential edge, the under structural plate having a second plurality of circumferential apertures proximal to a second circumferential edge, the second plurality of circumferential apertures having a reduced aperture-to-aperture spacing relative to the first recurring aperture-to-aperture spacing; and positioning the first plurality of circumferential apertures in overlapping arrangement with the second plurality of circumferential apertures such that respective apertures of the first plurality are substantially aligned with corresponding apertures of the second plurality of circumferential apertures for receiving fasteners therein.

In some embodiments, when a centroid of a first circumferential aperture is misaligned with a centroid of a second circumferential aperture, an area circumscribed by second circumferential aperture may substantially overlap a portion of an area circumscribed by the first circumferential aperture.

In some embodiments, the first plurality of circumferential apertures may be slotted apertures. The second plurality of circumferential apertures may be round apertures having a diameter substantially equal to a width of the slotted apertures.

In another aspect, the present disclosure describes an arch-shaped structure. The arch-shaped structure may include: a first structural plate having a plate radius, the first structural plate including a first circumferential end having a first plurality of circumferential apertures proximal to a first circumferential edge, the first plurality of circumferential apertures having a first recurring aperture-to-aperture spacing between respective pairs of adjacent apertures; and a second structural plate having the plate radius, the second structural plate including a second plurality of circumferential apertures proximal to a second circumferential edge, the second plurality of circumferential apertures having a second recurring aperture-to-aperture spacing less than the first recurring aperture-to-aperture spacing by a margin value. The first plurality of circumferential apertures may overlap the second plurality of circumferential apertures such that the respective apertures of the first plurality are substantially aligned with corresponding apertures of the second plurality of circumferential apertures for receiving fasteners therein.

In some embodiments, the first plurality of circumferential apertures may be slotted apertures. The second plurality of circumferential apertures may be round apertures having a diameter substantially equal to a width of the slotted apertures.

In some embodiments, when a centroid of a first circumferential aperture is misaligned with a centroid of a second circumferential aperture, an area circumscribed by the second circumferential aperture may substantially overlap a portion of an area circumscribed by the first circumferential aperture.

In some embodiments, wherein the margin value is a fraction of the first recurring aperture-to-aperture spacing or the second recurring aperture-to-aperture spacing.

In some embodiments, wherein the margin value is on the order of less than 1 percent of the first recurring aperture-to-aperture spacing or the second recurring aperture-to-aperture spacing.

In some embodiments, wherein the margin value is on the order of less than 0.5 percent of the first recurring aperture-to-aperture spacing or the second recurring aperture-to-aperture spacing.

In some embodiments, wherein the margin value is approximately 0.2 percent of the first recurring aperture-to-aperture spacing or the second recurring aperture-to-aperture spacing.

In another aspect, the present disclosure describes a kit for constructing an arch-shaped structure. The kit may include: a pair of structural plates respectively having plate corrugations extending transversely of a longitudinal length of the arch-shaped structure, the respective structural plates including a transverse end having at least one plate aperture adjacent a transverse edge; and a joiner plate configured to secure the pair of structural plates in non-overlapping arrangement at the respective transverse edges of the pair of structural plates, wherein the joiner plate includes joiner corrugations configured to nest with the plate corrugations, and wherein the joiner plate includes at least one joiner aperture aligning with the at least one plate aperture of the respective structural plates to receive fastening bolts.

In some embodiments, the joiner plate is configured to secure the pair of structural plates in non-overlapping abutment at the respective transverse edges.

In some embodiments, at least one of the pair of structural plates is configured to be joined to a third structural plate by overlapping abutment along a circumferential plate edge.

In some embodiments, the respective structural plates include a first circumferential plate edge having a first series of spaced apertures adjacent to the first circumferential plate edge, the respective spaced apertures being successively spaced from the transverse edge. The respective structural plates include a second circumferential plate edge having a second series of spaced apertures adjacent to the second circumferential plate edge, the respective spaced apertures of the second series of spaced apertures configured to be offset from the first series of spaced apertures relative to the transverse edge.

In some embodiments, the offset of the respective spaced apertures of the second series of spaced apertures from the first series of spaced apertures relative to the transverse edge is a function of the structural plate thickness.

In some embodiments, at least one of a pitch, depth, or radius of the joiner corrugations is configured to be different from a pitch, depth, or radius of the plate corrugations to allow nesting of the joiner corrugations with the plate corrugations.

In some embodiments, the joiner plate includes a lateral member configured to be affixed within at least one trough of the joiner corrugations.

In another aspect, the present disclosure provides a kit for constructing an arch-shaped structure. The kit may include: a pair of structural plates including a transverse end having at least one plate aperture adjacent a transverse edge; and a joiner plate configured to secure the pair of structural plates in non-overlapping abutment at the respective transverse edges of the pair of structural plates, wherein the joiner plate includes at least one joiner aperture configured to align with the at least one plate aperture to receive fastening bolts.

In some embodiments, the respective structural plates have plate corrugations extending transversely of a longitudinal length of the arch-shaped structure, and wherein the joiner plate includes joiner corrugations configured to be nested with the plate corrugations.

In some embodiments, at least one of a pitch, depth, or radius of the joiner corrugations is configured to be different from a pitch, depth, or radius of the plate corrugations to allow nesting of the joiner corrugations with the plate corrugations.

In some embodiments, at least one of the pair of structural plates is joined to a third structural plate by overlapping abutment along a circumferential plate edge.

In another aspect, the present disclosure provides a kit for constructing an arch-shaped structure. The kit may include: a first structural plate having a plate radius, the first structural plate including a first circumferential end having a first plurality of circumferential apertures proximal to a first circumferential edge, the first plurality of circumferential apertures having a first recurring aperture-to-aperture spacing between respective pairs of adjacent apertures; and a second structural plate having the plate radius, the second structural plate including a second plurality of circumferential apertures proximal to a second circumferential edge, the second plurality of circumferential apertures having a second recurring aperture-to-aperture spacing configured to be less than the first recurring aperture-to-aperture spacing by a margin value, wherein the first plurality of circumferential apertures is configured to overlap the second plurality of circumferential apertures such that the respective apertures of the first plurality are configured to substantially aligned with corresponding apertures of the second plurality of circumferential apertures for receiving fasteners therein.

In some embodiments, the first plurality of circumferential apertures are slotted apertures, and wherein the second plurality of circumferential apertures are round apertures having a diameter configured to be substantially equal to a width of the slotted apertures.

In some embodiments, when a centroid of a first circumferential aperture is misaligned with a centroid of a second circumferential aperture, an area circumscribed by the second circumferential aperture is configured to substantially overlap a portion of an area circumscribed by the first circumferential aperture.

In some embodiments, the margin value is a fraction of the first recurring aperture-to-aperture spacing or the second recurring aperture-to-aperture spacing.

In some embodiments, the margin value is on the order of less than 1 percent of the first recurring aperture-to-aperture spacing or the second recurring aperture-to-aperture spacing.

In some embodiments, the margin value is on the order of less than 0.5 percent of the first recurring aperture-to-aperture spacing or the second recurring aperture-to-aperture spacing.

In some embodiments, the margin value is approximately 0.2 percent of the first recurring aperture-to-aperture spacing or the second recurring aperture-to-aperture spacing.

In this respect, before explaining at least one embodiment in detail, it is to be understood that the embodiments are not limited in application to the details of construction and to the arrangements of the components set forth in the following description or illustrated in the drawings. Also, it is to be understood that the phraseology and terminology employed herein are for the purpose of description and should not be regarded as limiting.

Many further features and combinations thereof concerning embodiments described herein will appear to those skilled in the art following a reading of the present disclosure.

DESCRIPTION OF THE FIGURES

In the figures, embodiments are illustrated by way of example. It is to be expressly understood that the description and figures are only for the purpose of illustration and as an aid to understanding.

Embodiments will now be described, by way of example only, with reference to the attached figures, wherein in the figures.

DETAILED DESCRIPTION

Figure 1:
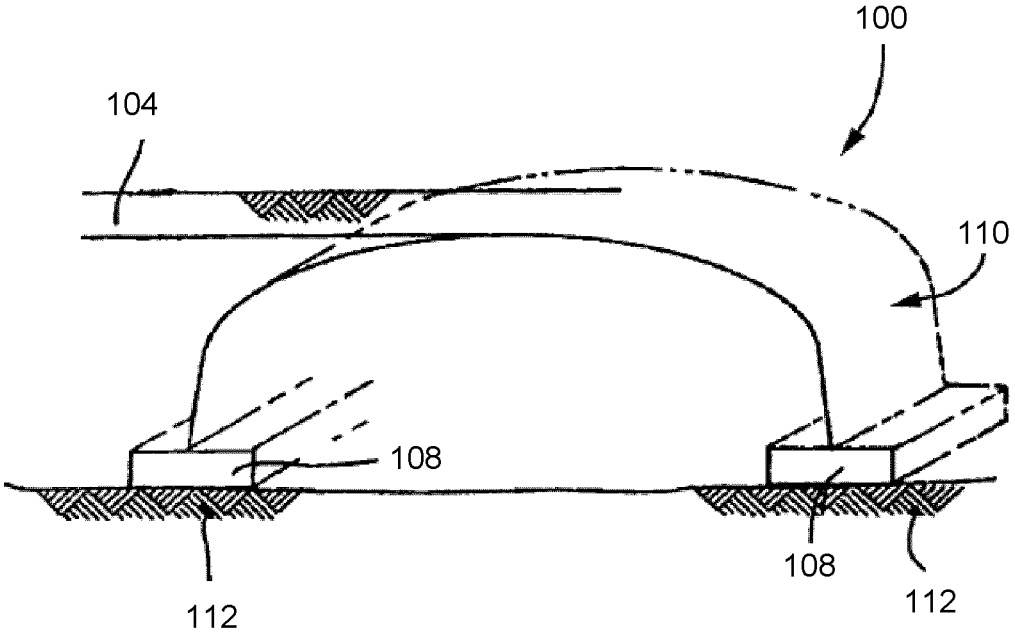
FIG. 1 illustrates an underpass system, in accordance with an embodiment of the present disclosure.

Arch-shaped structures may be constructed from a combination of interconnected structural plates. In some examples, arch-shaped structures may include culverts, buried thoroughfares, tunnels, bridges, or portals. In some examples, structural plates may be flat, may have a radius, or may have other structural shape for forming a portion of said arch-shaped structure.

Respective structural plates may be interconnected with adjacent structural plates along transverse edges or circumferential edges. In some examples, adjacent plates may be joined by lapping adjacent transverse edges or adjacent circumferential edges and inserting fastening bolts into plate apertures positioned proximal to the plate edges. As applications of structural plates evolve for constructing wider bridge underpasses, for withstanding heavier loads, for supporting higher stockpiles, or for constructing deeper portals, it may be beneficial to strengthen such structural plates. In some embodiments, increasing structural plate thickness may increase the strength of a structural plate.

As the requirement for structural plate thickness increases, the likelihood that plate apertures along overlapping (also known as "lapped") edges of respective structural plates not aligning may also increase, thereby making it challenging to insert fasteners within the plate apertures for securing adjacent structural plates. When plate apertures along respective structural plate edges do not align, installation technicians may attempt to ream or widen apertures using drilling tools. Reaming or widening apertures at a project site may result in alteration of structural integrity of the respective structural plates. Further, where plate apertures of lapping plate edges do not align, installation technicians may utilize pry bars and temporarily insert drift pins within overlapping plate apertures for securing positions of the adjacent structural plates. Such operations for constructing arch-shaped structures may be labor-intensive, at least, because additional trial-and-error operations may be necessary for aligning plate apertures. Devices and methods of joining structural plates while minimizing misaligned apertures may be beneficial.

In some scenarios, a greater number of overlapping edges of adjacent structural plates may lead to needing an overall greater quantity of structural plates for assembling a given length of arch-shaped structure, as compared to when the number of overlapping portions of structural plates is decreased. Embodiments of joiner plates described herein for interconnecting structural plates thereby reducing the number of plate-to-plate lapping interfaces may be beneficial.

In some scenarios, infrastructure requirements may vary from site-to-site. The target structure assembly (such as box-shaped structures, arch-shaped structures, among other examples) may vary in size requirements, load requirements, among other requirements. As target structure requirements may vary, in some scenarios, a large quantity of pre-sized structural plates may be required for a given project. Further, where pre-sized structural plates may not precisely match project requirements, such pre-sized structural plates may be cut or otherwise shaped, thereby wasting structural plate material.

It may be beneficial to provide configurable structural plates and methods of preparing structural plates for assembling structures (e.g., arch-shaped structures, etc.) for reducing the number of pre-sized structural plates for varying infrastructure requirements. For example, it may be beneficial to provide configurable structural plates that may be sized (e.g., cut, formed for a desired radius, etc.) and adaptably interconnected with other structural plates at a project stage nearer to the target construction site. Configurable structural plates embodiments described in the present disclosure may reduce the need for manufacturing numerous pre-set structural plate sizes/configurations.

In some embodiments, to construct arch-shaped structures by lapping at least circumferential edges of respective structural plates, structural plates maybe interconnected in multiple stages. For ease of exposition, the following example method may be referred to in the present disclosure generally as the "over-under" structural plate configuration.

In a first stage, structural rings may be constructed by interconnecting a plurality of structural plates along transverse edges. In a second stage, the structural rings may be interconnected along circumferential edges in a longitudinal direction of the arch-shaped structure. A set of structural rings labelled as "inner rings" may first be erected on a foundation in a staggered pattern (e.g., installing inner ring at $1^{st}$ position, $3^{rd}$ position, $5^{th}$ position, etc. on the foundation) along the longitudinal length of the arch-shaped structure. The staggered structural rings may be temporarily joined by flat plate spacers.

Subsequently, the flat plate spacers may be removed as respective structural rings labelled as "outer rings" are installed between the inner structural rings. Circumferential edges of the outer structural rings may overlap circumferential edges of the inner structural rings, and fasteners may be inserted into apertures for securing the successive structural rings.

In some embodiments, arch-shaped structures may be constructed by successively positioning structural plates and successively overlapping circumferential edges whilst moving successively across a series of structural plates.

In some embodiments, in a first stage, structural rings may be constructed based on a plurality of structural plates interconnected along transverse edges. In a second stage, the structural rings may be interconnected along circumferential edges in a longitudinal direction of the arch-shaped structure. For example, a first structural ring may be erected on a foundation. A second structural ring may be positioned adjacent the first structural ring such that abutting circumferential edges may overlap, and fasteners may be received within apertures adjacent the respective circumferential edges. Successively, additional structural rings may be positioned such that circumferential edges may successively abut and overlap a prior erected structural ring. Overlapping circumferential edges may successively advance in a longitudinal direction of the structure, thereby resembling configuring asphalt shingles on a roof (as an example).

In some scenarios, it may be beneficial to provide structural plates and methods of constructing arch-shaped structural plates for reducing aperture misalignment among overlapping circumferential edges for interconnecting structural plates. In some scenarios, it may be beneficial to reduce the quantity of overlapping edges for reducing the quantity of structural plate material required for constructing a given length of arch-shaped structure.

In some embodiments, substituting overlapping structural plate edges joined via fasteners with abutting structural plate edges may lead to increased ability to transfer thrust loads along interconnected structural plates.

Some embodiments described herein relate to corrugated structural plates; however, other types of structural plates may be contemplated, such as non-corrugated structural plates or structural plates having other shapes or configurations. Some embodiments described herein relate to metal plates; however, plates may be constructed of non-metal plates and may be referred to generally as structural plates.

Reference is made to FIG. 1, which illustrates an underpass system 100, in accordance with an embodiment of the present disclosure. The underpass system 100 may be a buried bridge system, a thoroughfare infrastructure system, or the like. The underpass system 100 may include an arch-shaped structure 110 constructed of interconnected structural plates or sheets. In some embodiments, the interconnected plates may be corrugated structural plates. In some embodiments, the structural plates may be constructed of metal. Other types of material or configurations of plates or sheets may be contemplated.

In the example illustrated in FIG. 1, the box-shaped structure or arch-shaped structure 110 has an "open-bottom". Other types of arch-shaped structures may be contemplated, such as closed-bottom structures, where the arch-shaped structures form a culvert or similar structure. Closed-bottom structures may have cross-sectional profiles that may be circular, elliptical, or other shapes.

The arch-shaped structure 100 may include a prescribed depth of overburden 104, on top of which is a roadway or other physical structure. In some examples, the arch-shaped structure 100 includes a pair of footings 108 and a metal archway 110 supported by the pair of footings 108. The pair of footings 108 may be placed atop compacted fill 112.

Figure 2:
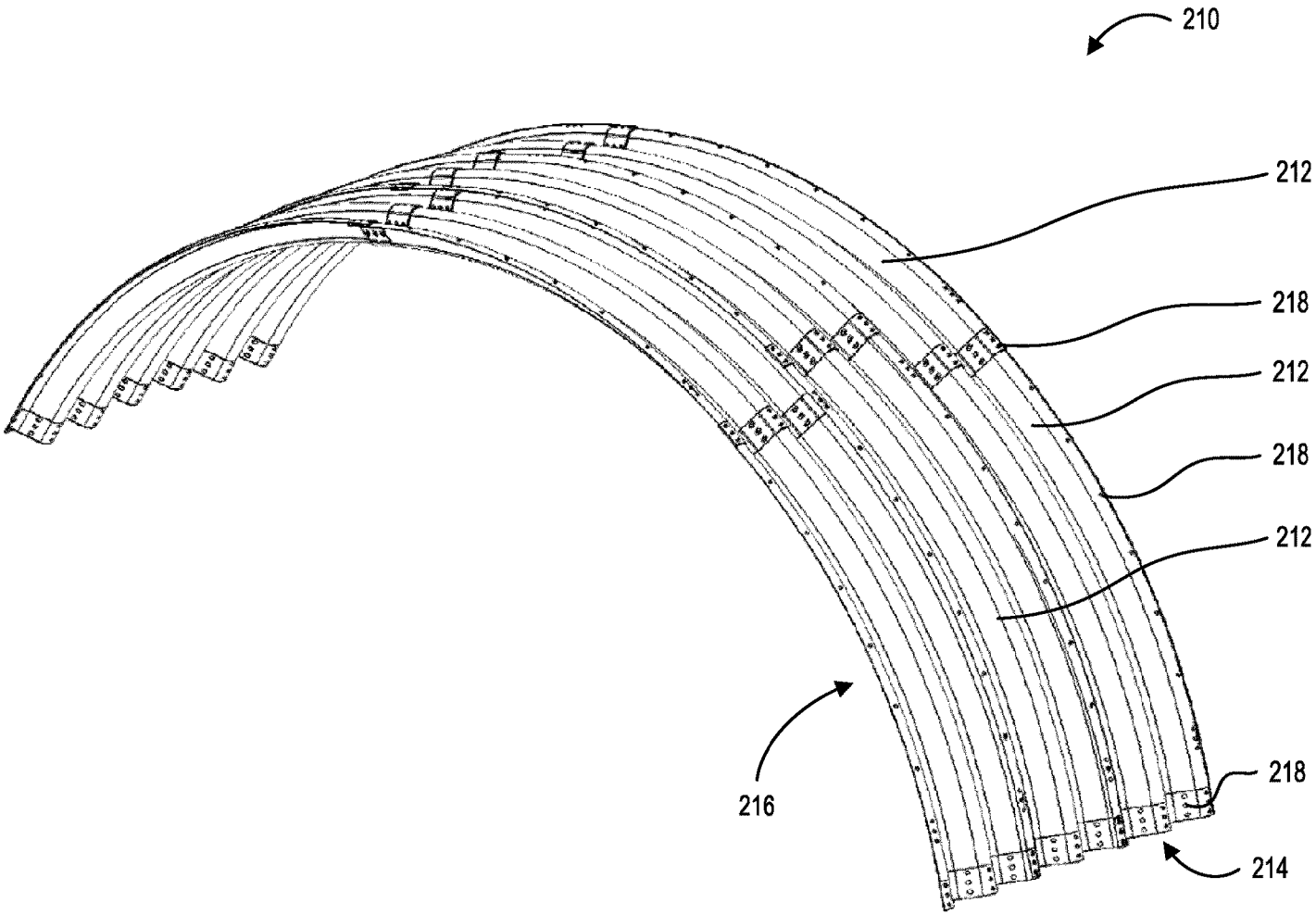
FIG. 2 illustrates a structural archway, in accordance with an embodiment of the present disclosure.

Reference is made to FIG. 2, which illustrates a metal archway 210 of an arch-shaped structure, in accordance with an embodiment of the present disclosure. The metal archway 210 may include a plurality of interconnected metal plates 212. In some embodiments, the metal plates 212 may be corrugated metal plates having corrugations extending transversely of a longitudinal length of the arch-shaped structure.

In FIG. 2, the respective metal plates 212 include one or more apertures 218 along a transverse end 214 or along a circumferential end 216 of the respective metal plates 212. The one or more apertures 218 may receive fasteners, such as bolt fasteners. When respective metal plates 212 are lapped with an adjacent metal plate 212 along a transverse end 214 or a circumferential end 216, the metal plates 212 may be interconnected by fastening bolts received within aligning apertures 218. Alternate suitable fasteners meeting the specific structural and/or load requirements may be contemplated.

In the example illustrated in FIG. 2, the metal plates 212 may be configured to have a radius, such that interconnection of a plurality of the metal plates 212 may provide an overall arch-shape. The arch-shape may be a standard arch, a multi-radius arch, a box culvert arch, or any other single or multi-radius arch configuration.

Figure 3:
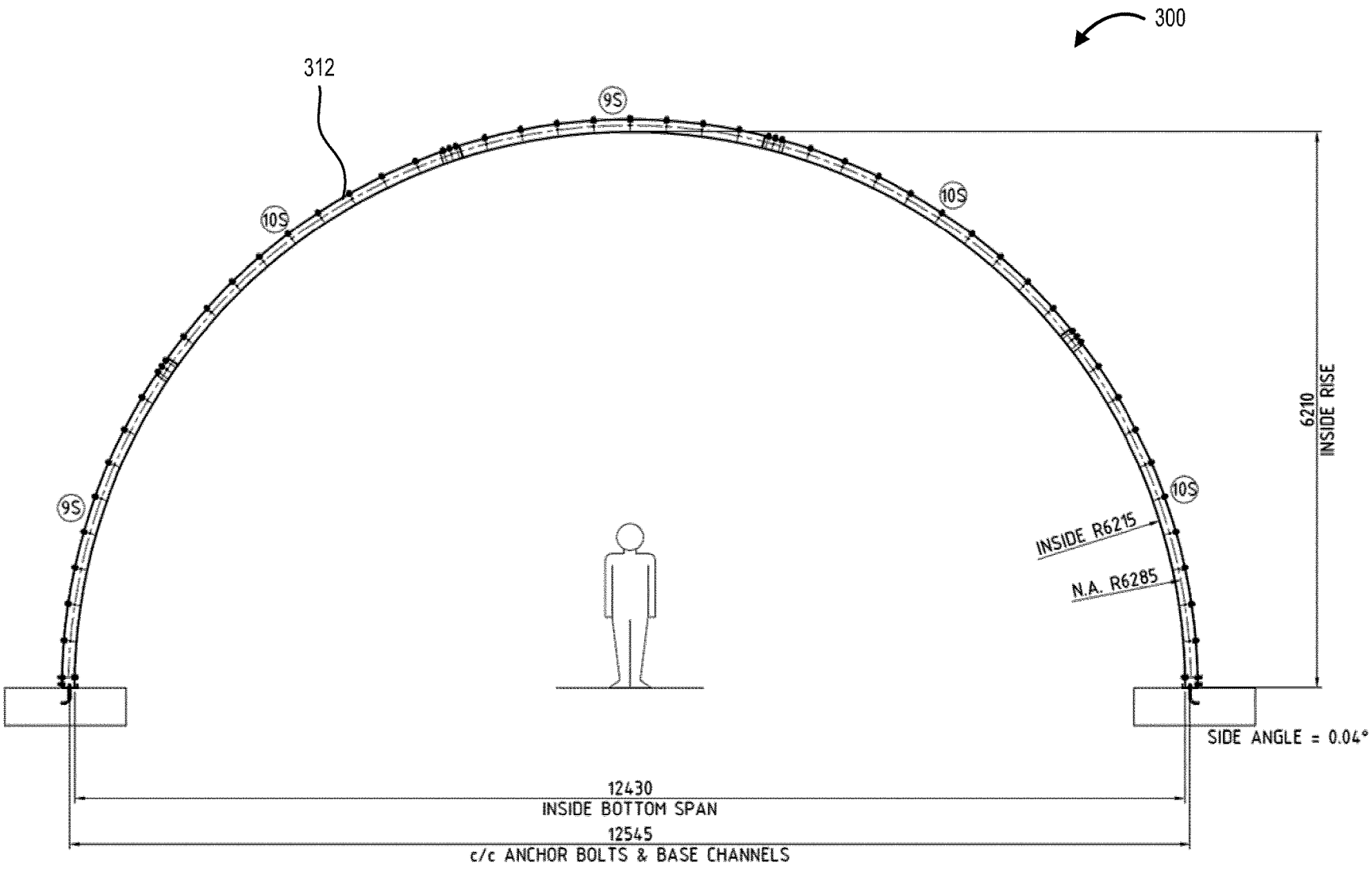
FIGS. 3, 4, and 5 illustrate cross-sectional views of box-shaped or arch-shaped structures, in accordance with embodiments of the present disclosure.
Figure 4:
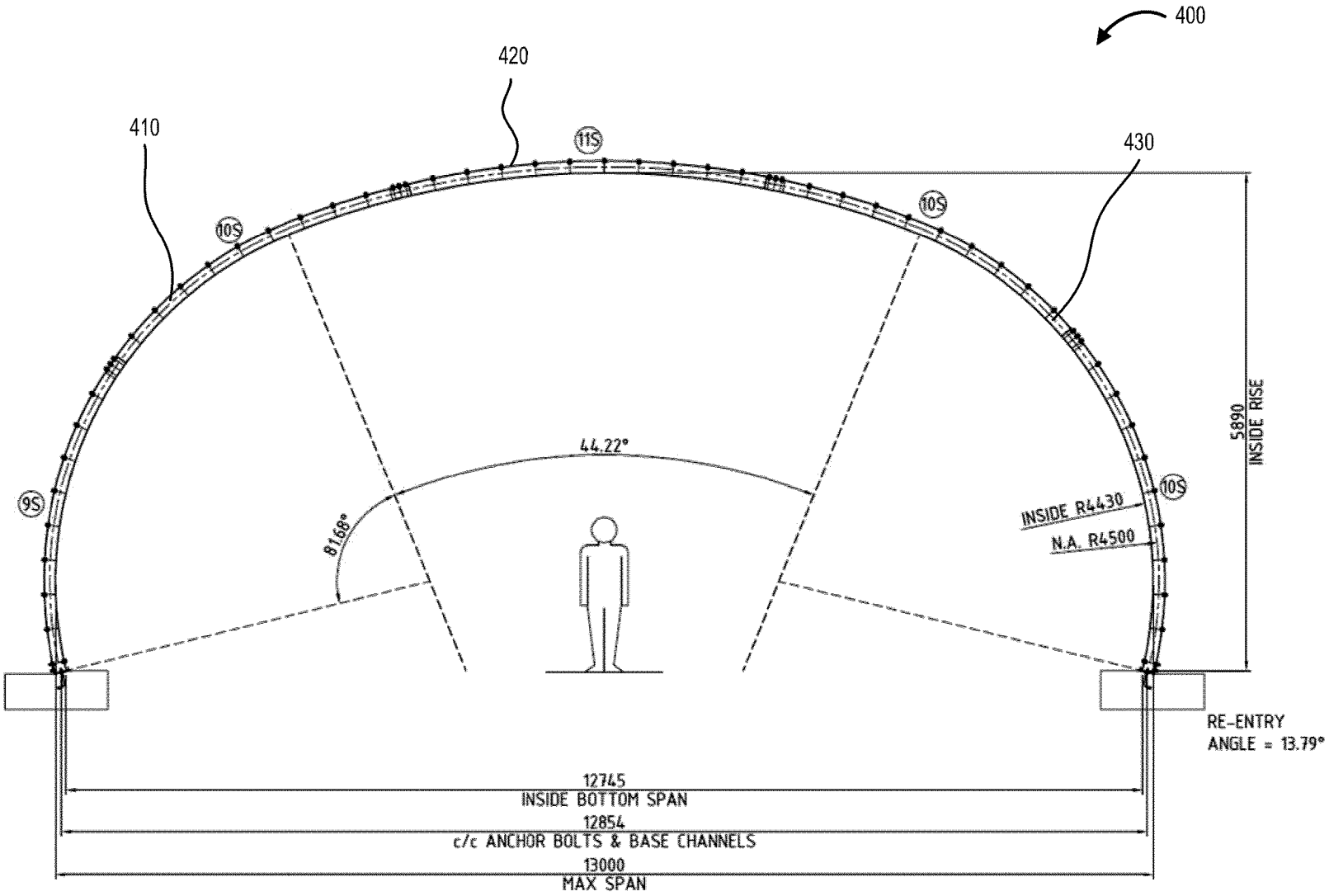
Figure 5:
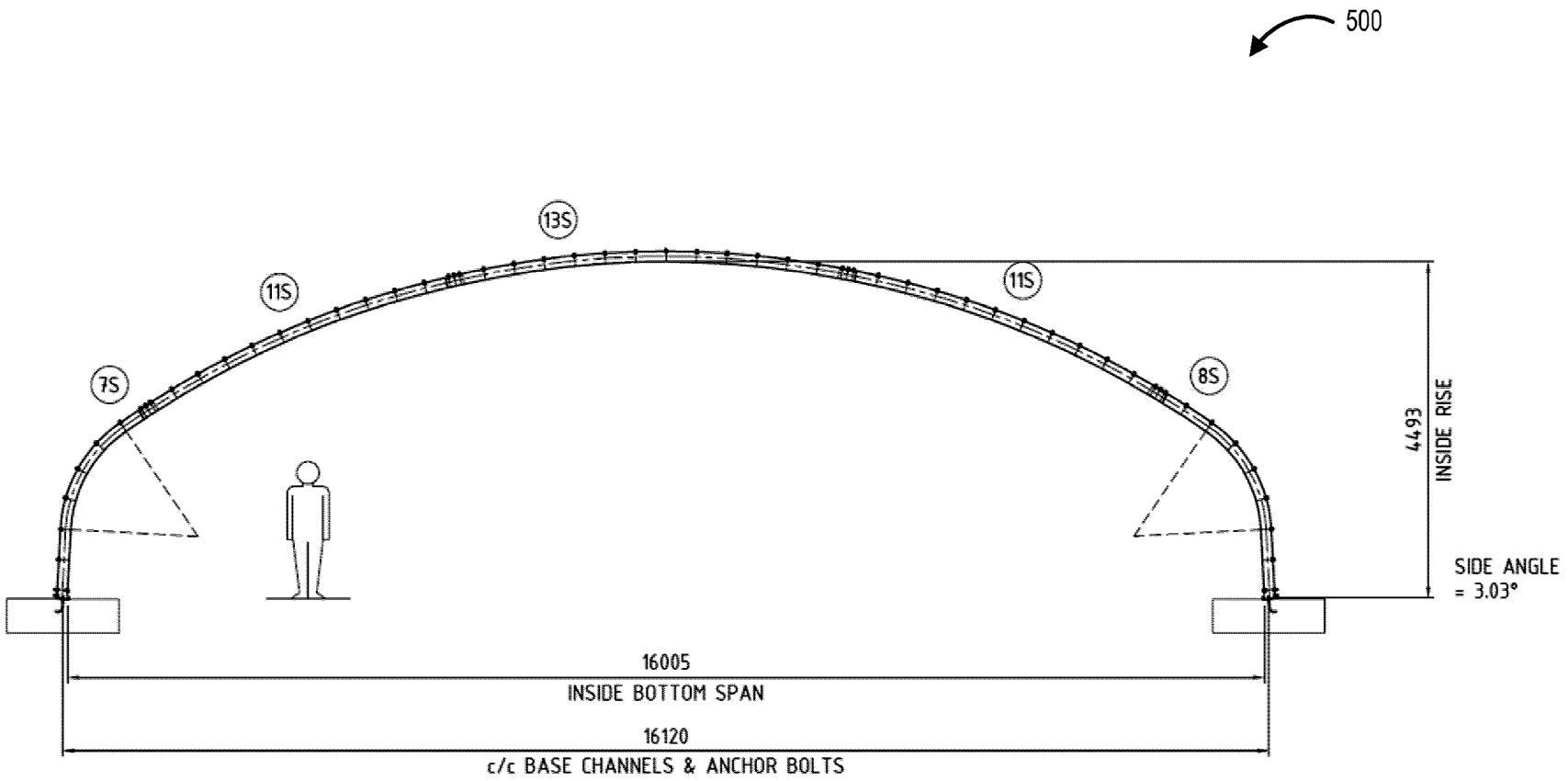

To illustrate, reference is made to FIGS. 3, 4, and 5, which illustrate cross-sectional views of arch-shaped structures, in accordance with embodiments of the present disclosure. FIG. 3 illustrates a plurality of interconnected metal plates 312, where the respective metal plates 312 may individually have a radius. The interconnected metal plates 312 may form a structural archway 300. The combination of the plurality of metal plates 312 may be configured to provide the structural archway 300 having a substantially single overall radius.

FIG. 4 illustrates a plurality of metal plates interconnected to form a metal archway 400. The metal archway 400 of FIG. 4 may have several portions of metal plates having different radiuses. For example, metal plates in a first section 410 and a third section 430 may have a substantially similar radius and metal plates in a second section 420 may individually have a larger radius as compared to the radius of the metal plates in the first section 410 and the third section 430. In FIG. 4, the combination of the plurality of metal plates of the first section 410, the second section 420, and the third section 430 may provide a multi-radius archway.

FIG. 5 illustrates a plurality of metal plates interconnected to form a metal archway 500. Similar to the metal archway 400 of FIG. 4, the metal archway 500 of FIG. 5 may include several portions of metal plates having varying radii. In FIG. 5, the proportion of metal plates along a cross-sectional perimeter of the archway 500 may differ from that illustrated in FIG. 4. In FIG. 5, the metal archway 500 is configured as a box culvert archway.

Construction of underpass systems 100 (FIG. 1), such as buried bridge systems, thoroughfare infrastructure, or the like, using large and/or long span metal overhead structures present challenging technical problems. Such systems or structures may be subject to extreme stresses during an initial construction process or during intended use (e.g., anticipated live/dead loads). As applications of such systems evolve to accommodate wider throughways, heavier loads, higher stockpiles, deeper portals, it may be desirable to increase the strength of structural plates that form such systems.

Structural strength of metal plates may be increased by increasing metal plate thickness. However, as the metal plate thickness increases, challenging problems may emerge. For example, as the metal plate thickness increases and when the respective metal plates are lapped with adjacent metal plates, the apertures along respective transverse ends or circumferential ends may not align.

Figure 6:
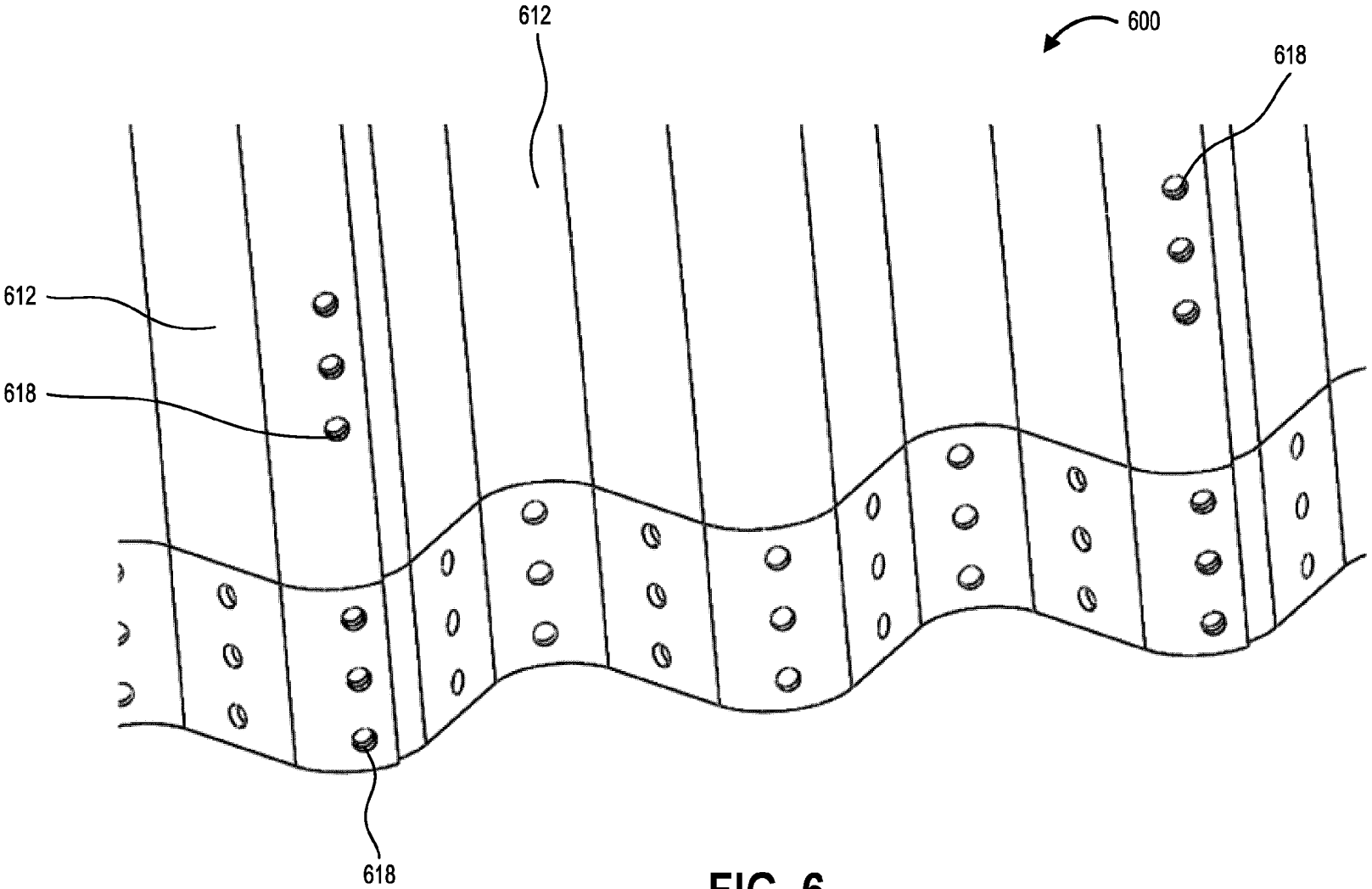
FIG. 6 illustrates an enlarged top view of structural plates lapping along transverse edges and/or circumferential edges, in accordance with embodiments of the present disclosure.

To illustrate, reference is made to FIG. 6, which illustrates an enlarged top view of metal plates 600 lapping along transverse edges or circumferential edges. One or more apertures 618 of a given plate 612 may be misaligned with one or more corresponding apertures 618 along a region where adjacent metal plates 612 may lap. In FIG. 6, example misaligned apertures indicated by reference numeral 618 may be associated with adjacent transverse ends of adjacent metal plates or with circumferential ends of adjacent metal plates.

When the respective apertures 618 of lapping metal plates 612 do not align, it may be challenging to insert bolts or fasteners through apertures of the lapping metal plates 612 for interconnecting and securing the metal plates 212 to form the metal archway 210 (FIG. 2). In some scenarios, when the apertures 618 of the respective metal plates 612 do not align, installation technicians may attempt to align the respective apertures 618 using pry bars and, once aligned, may temporarily insert drift pins into the aligned apertures while inserting bolts into other aligned apertures. Aligning apertures of lapping metal plates may be time consuming and may require trial-and-error effort by installation technicians who may iteratively shift positioning of the respective metal plates 612 to achieve aperture alignment. In some scenarios, installation technicians may ream or widen apertures using drilling tools, thereby altering the structural integrity of the respective structural plates. Improved devices and methods of interconnecting and securing metal plates 212 for forming arch-shaped structures, or other structures, are desirable.

Figure 7:
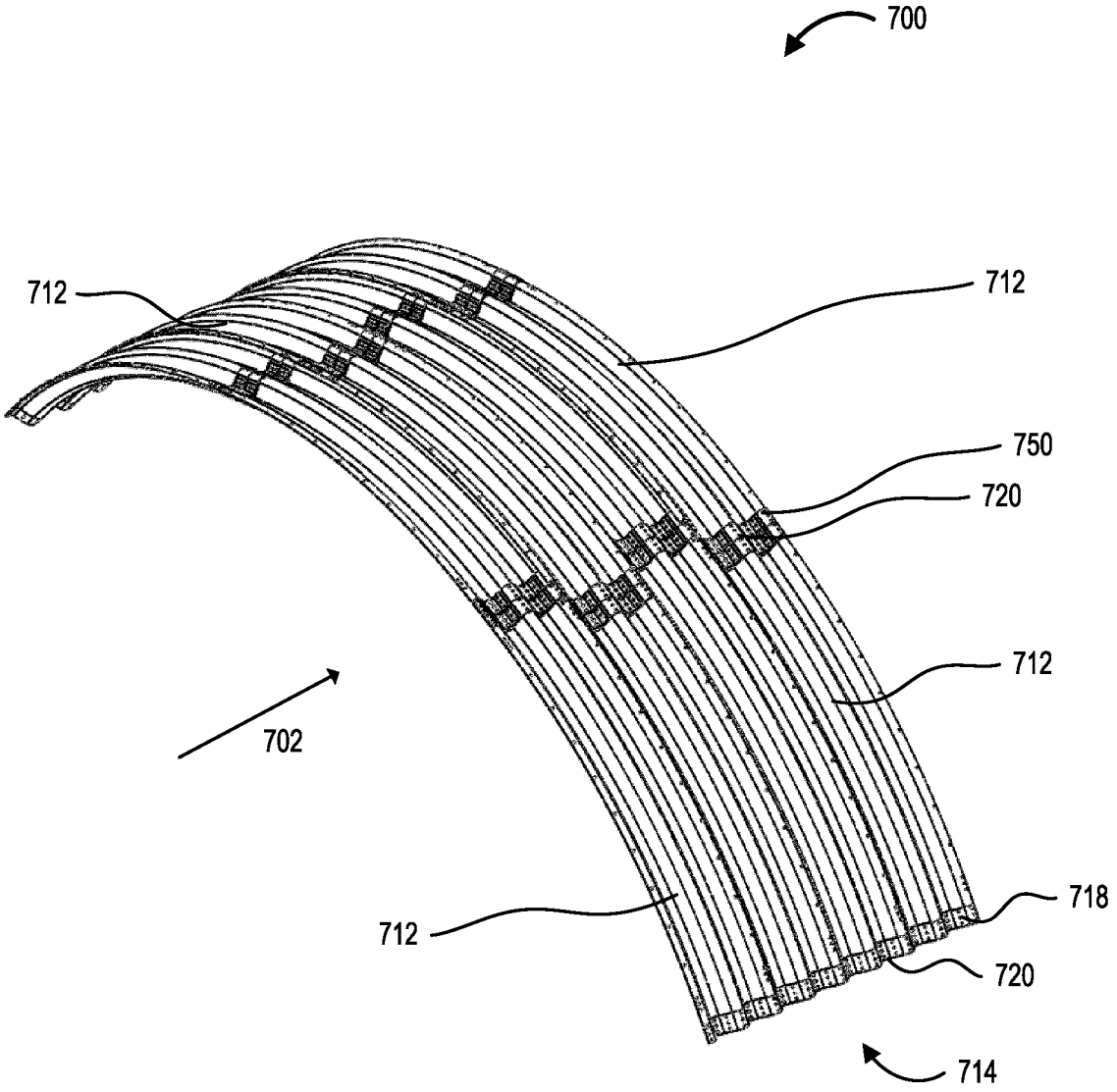
FIG. 7 illustrates an arch-shaped structure, in accordance with an embodiment of the present disclosure.

Reference is made to FIG. 7, which illustrates an arch-shaped structure 700, in accordance with an embodiment of the present disclosure. The arch-shaped structure 700 includes a plurality of metal plates 712. The examples described herein refer to metal plates; however, structural plates constructed of other materials may be contemplated. The respective metal plates 712 may have corrugations extending transversely of a longitudinal length or a longitudinal direction 702 of the arch-shaped structure 700. The respective metal plates 712 include transverse ends 714 and have at least one plate aperture 718 adjacent a transverse edge 720.

A joiner plate 750 may secure pairs of metal plates 712 (FIG. 7) in a non-overlapping arrangement at respective transverse edges 720. In some embodiments, the joiner plate 750 may include joiner corrugations nested with the plate corrugations.

Figure 8C:
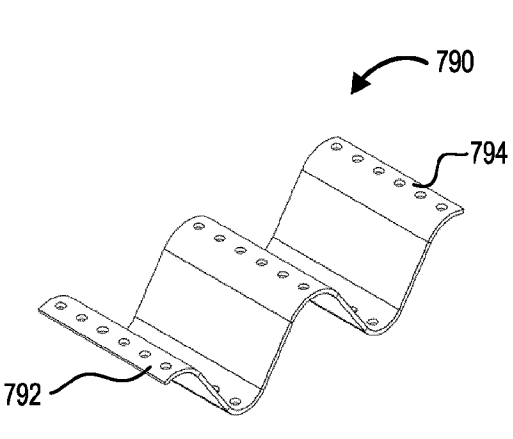
FIGS. 8A, 8B, and 8C illustrate enlarged perspective views of the joiner plate, in accordance with an embodiments of the present disclosure.
Figure 8B:
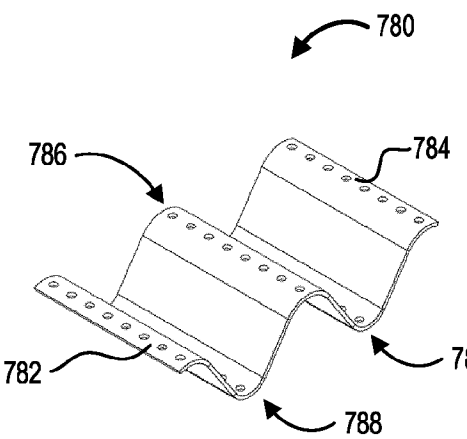
Figure 8A:
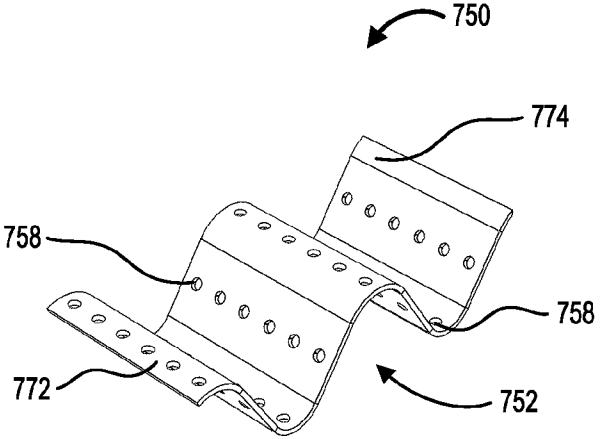

Reference is made to FIG. 8A, which illustrates an enlarged perspective view of the joiner plate 750 of FIG. 7, in accordance with an embodiment of the present disclosure. The joiner plate 750 may be for securing pairs of metal plates 712 in a non-overlapping arrangement at respective transverse edges 720 of the metal plates 712.

The joiner plate 750 may include a first circumferential joiner edge 772 and a second circumferential joiner edge 774. In some embodiments, the first circumferential joiner edge 772 may include one or a series of circumferential joiner edge apertures for aligning with apertures along a circumferential plate edge. In some embodiments, as will be illustrated, the second circumferential joiner edge 774 may not include circumferential joiner edge apertures, and may be configured to be positioned within a trough of a corrugated metal plate.

In some embodiments, the respective structural plates may include a pair of circumferential plate edges. Further, the joiner plate may include a pair of circumferential joiner edges. The respective circumferential edges may overlap a corresponding respective circumferential plate edge.

In some other embodiments, the joiner plate may include the first circumferential joiner edge 772 having one or a series of circumferential joiner edge apertures for aligning with apertures along a circumferential plate edge. In addition, the joiner plate may include a second circumferential joiner edge having one or another series of circumferential joiner edge apertures that may align with apertures along an opposing circumferential plate edge (not illustrated in FIG. 8A). That is, respective circumferential joiner edges may have one or more apertures aligning with one or more apertures along corresponding circumferential plate edges of an adjacent structural plate.

The joiner plate 750 may include joiner corrugations 752, such as at least one crest and at least one trough that may correspond to one or more crests or troughs of a pair of metal plates 712 when the joiner plate 750 secures the pair of metal plates 712.

The joiner plate 750 may include at least one joiner aperture 758 aligning with at least one plate aperture 718 (FIG. 7) when the joiner plate 750 is positioned to secure the pairs of metal plates 712 (FIG. 7). The joiner aperture 758 may be positioned on the joiner plate 750 at a location that may be based, at least in part, on plate thickness of the pair of metal plates 712. The at least one joiner aperture 758 may align with at least one plate aperture 718 when the joiner corrugations 752 may be nested with the plate corrugations.

Reference is made to FIGS. 8B and 8C, which illustrate enlarged perspective views of joiner plates, in accordance with embodiments of the present disclosure. In FIG. 8B, the joiner plate 780 may include a first circumferential joiner edge 782 having one or a series of circumferential joiner edge apertures for aligning with apertures along a circumferential plate edge. The joiner plate 780 may include a second circumferential joiner edge 784 having one or a series of circumferential joiner edge apertures for aligning with apertures along another circumferential plate edge (opposing the former circumferential joiner edge.

In FIG. 8B, the joiner plate 780 includes peak apertures 786 proximal a peak of the joiner plate 780 and trough apertures 788 proximal a trough of the joiner plate 780. In some embodiments, the peak apertures 786 and the trough apertures 788 may be positioned to align with apertures of structural plates for receiving fasteners. In the joiner plate illustrated in FIG. 8B, the first circumferential joiner edge 782, the second circumferential joiner edge 784, and positions proximal to the peaks and troughs may include 8 apertures, where 4 apertures may be configured for alignment with apertures in a first structural plate and 4 apertures may be configured for alignment with apertures in a second structural plate for interconnecting the first structural plate and the second structural plate. Although 8 apertures are illustrated along the respective circumferential joiner edges, other numbers of apertures may be contemplated. To illustrate, FIG. 8C illustrates a joiner plate 790, in accordance with embodiments of the present disclosure. In FIG. 8C, the joiner plate 790 includes 6 apertures along the first circumferential joiner edge 792, the second circumferential joiner edge 794, and positions proximal to the peaks and troughs.

Figure 9:
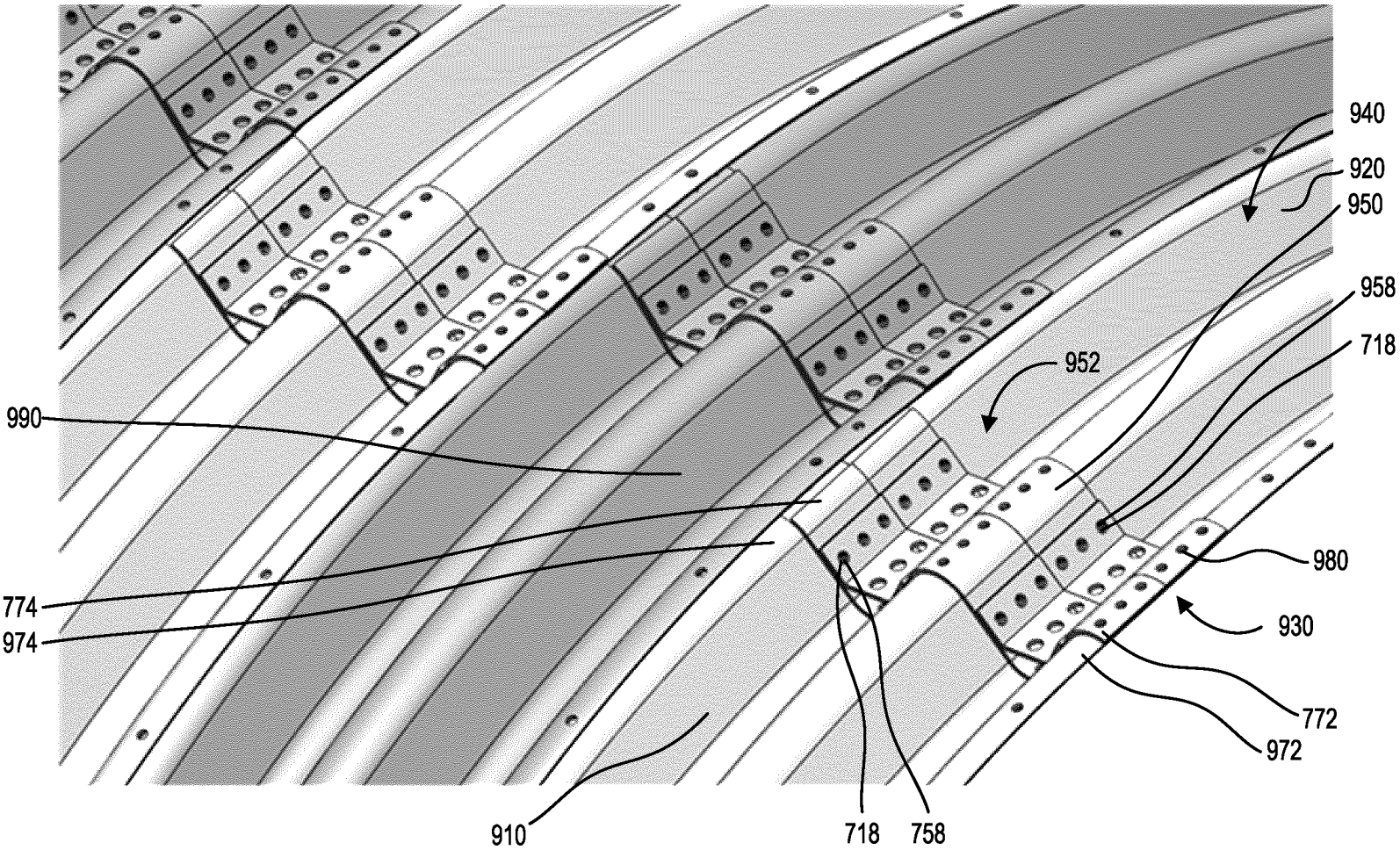
FIG. 9 illustrates an enlarged perspective view of the joiner plate securing a first metal plate and a second metal plate, in accordance with an embodiment of the present disclosure.

Reference is made to FIG. 9, which illustrates an enlarged perspective view of a joiner plate 950 securing a first metal plate 910 and a second metal plate 920, in accordance with an embodiment of the present disclosure.

The first metal plate 910 and the second metal plate 920 may respectively have plate corrugations. The first metal plate 910 has a transverse end having at least one plate aperture adjacent a transverse edge. Similarly, the second metal plate 920 has a transverse end having at least one plate aperture adjacent a transverse end.

The joiner plate 950 may secure the first metal plate 910 and the second metal plate in non-overlapping abutment at the respective transverse edges of the respective metal plates. In FIG. 9, the joiner plate 950 may secure the first metal plate 910 and the second metal plate 920 in non-overlapping abutment 930 at the respective transverse edges. Further, the joiner corrugations 952 may be nested with the plate corrugations 940.

To receive fasteners, such as fastening bolts, at least one joiner aperture 958 may be aligned with at least one plate aperture 718 of each of the first metal plate 910 and the second metal plate 920. In some embodiments, the joiner plate 950 may be configured such that the respective joiner apertures 758 may be positioned and offset from other joiner apertures 758 as a function of plate thickness of the first metal plate 910 and/or the second metal plate 920 to achieve alignment of joiner apertures 958 and corresponding plate apertures 718 when the joiner corrugations 952 are nested with the plate corrugations 940.

As the first metal plate 910 and the second metal plate 920 are in non-overlapping abutment 930 at respective transverse edges, and as the joiner apertures 958 are configured to be in alignment with the corresponding plate apertures 718, arch-shaped structures may be more easily assembled from a plurality of interconnected metal plates without reliance on pry bars or temporarily inserted drift pins for maintaining aperture alignment position during arch-shape structure assembly.

As described, a plurality of metal plates may be interconnected to form an arch-shaped structure. In FIG. 2, when transverse ends of adjacent metal plates are lapped and when fastening bolts are received within aligning apertures at the respective transverse ends, the metal plates may be interconnected. The plurality of fastening bolts may be configured to resist thrust loads. That is, the fastening bolts may be physically configured to resist shearing of the bolts. It may be appreciated, however, that thrust forces acting on the arch-shaped structure illustrated in FIG. 2 may be large. The strength of the arch-shaped structure may depend, at least in part, on the ability of the fastening bolts resist or withstand shearing from thrust forces acting on the arch-shaped structure.

To enhance transfer of thrust forces along the plurality of interconnected metal plates, non-overlapping abutments at respective transverse ends of the plurality of interconnected metal plates illustrated in FIGS. 7 and 9 may be used to withstand greater thrust forces as compared to using fastening bolt interconnection of lapped transverse edges of metal plates (e.g., FIG. 2). That is, configuring interconnecting metal plates using the joiner plate 750 described herein to provide non-overlapping abutments of transverse metal plate ends facilitates more efficient transfer of thrust forces through the successive metal plates of the arch-shaped structure, as opposed to transferring thrust forces through fastening bolts that secure lapped transverse ends of metal plates (e.g., FIG. 2)

The joiner corrugations 952 and the plate corrugations 940 may respectively include pitch, depth, and/or radius specifications. In some embodiments, at least one of the pitch, depth, and/or radius specification of the joiner corrugation 952 may differ from the pitch, depth, and/or radius specification of the plate corrugations 940 to allow greater nesting precision of the joiner corrugations 952 with the plate corrugations 940. For example, corrugations of the joiner plate 950 may include a sinusoidal curve profile that may be shallower than a sinusoidal curve profile of corrugations of corrugated metal plates. The nesting of the joiner corrugations 952 with the plate corrugations 940 may increase the strength of the joined first metal plate 910 and the joined second metal plate 920. By increasing the nesting precision of the joiner corrugations 952 with the plate corrugations 940, gaps between the joiner corrugations 952 and the plate corrugations 940 may be minimized, thereby increasing the ability to transmit thrust forces along the respective structural plates.

In some embodiments, the first metal plate 910 and the second metal plate 920 may respectively include a pair of circumferential plate edges. For example, the second metal plate 920 may include a first circumferential plate edge 972 and a second circumferential plate edge 974. In some embodiments, the first circumferential joiner edge 772 may overlap the first circumferential plate edge 972.

Further, in some embodiments, the second circumferential joiner edge 774 may not overlap the second circumferential plate edge 974. The second circumferential joiner edge 774 may be positioned within a respective trough of the first metal plate 910 and the second metal plate 920. By limiting overlap of circumferential joiner edge with a circumferential plate edge, embodiments of the joiner plate 950 may minimize occurrences of overlapping metal plates.

Further, in some embodiments, one or a series of spaced circumferential plate apertures positioned along the first circumferential plate edge 972 may align with one or a series of spaced circumferential joiner edge apertures 980 to receive fasteners, such as fastening bolts, for interconnecting metal plates along respective circumferential plate edges.

In FIG. 9, the first metal plate 910 and/or the second metal plate 920 may be in overlapping abutment with a circumferential plate edge of a third metal plate 990.

In some embodiments, a joiner plate having features similar to the foregoing may secure the third metal plate 990 to at least one of the first metal plate 910 and/or the second metal plate 920 in non-overlapping abutment at the respective circumferential plate edges.

In the illustration of FIG. 9, the joiner plate 950 may be positioned on an outer surface of the arch-shaped structure for securing the first metal plate 910 and the second metal plate 920 in non-overlapping abutment 930 at the respective transverse edges. However, in some other embodiments, the joiner plate 950 may be positioned on an inner surface of the arch-shaped structure for securing the first metal plate 910 and the second metal plate 920 in non-overlapping abutment 930. Positioning the joiner plate 950 on an inner surface of the arch-shaped structure may be desirable in scenarios where the arch-shaped structure may be erected underneath an existing roadway and where the outer surface of the arch-shaped structure may not be easily accessible.

In some embodiments, the arch-shaped structures described herein may include a sealing compound or sealing gasket received within or between the non-overlapping abutment of respective transverse edges of adjacent metal plates. In some embodiments, the arch-shaped structures described herein may include a sealing compound or sealing gasket received between lapping portions of the respective circumferential plate edges. As the joiner plate 950 secures adjacent metal plates in non-overlapping abutment 930 (FIG. 9) at respective transverse edges of the metal plates, the overall arch-shaped structure may have few gaps between adjacent metal plates, thereby increasing the ability of the arch-shaped structure to resist passage of fluids or fines (e.g., very small particles in backfill material) through gaps when sealing compounds or sealing gaskets are installed. The sealing gasket may be constructed of rubber material; however, other material for resisting passage of fluids or fines may be contemplated. In the present examples, placing a sealing gasket between or atop non-overlapping abutment of edges of adjacent metal plates may provide an economical structure for resisting passage of fluids or fines between the non-overlapping abutment of plate edges.

In the embodiments described above, adjacent structural plates may be joined along transverse edges using embodiments of the joiner plate described herein. Joining adjacent structural plates along transverse edges using joiner plates may reduce the number of lapping structural plate segments. As the number of lapping structural plate segments may be reduced, there may be a reduced number or likelihood of misaligned plate apertures when adjacent structural plates may be lapped along circumferential edges. In some embodiments, offsetting series of apertures on opposing circumferential edges of structural plates may not be necessary. Further, it may be unnecessary to assemble arch-shaped structures by erecting staggered "inner" structural rings and, subsequently, overlaying "outer" structural rings, as described herein. In some embodiments, adjacent structural plates may be joined along circumferential edges using a shingled pattern. For example, a shingled pattern may be include successive structural plates being positioned to overlap a predecessor structural plate along a circumferential edge.

Structural strength of metal plates may be increased by increasing metal plate thickness. However, as described, as the metal plate thickness increases and when respective metal plates are lapped with adjacent metal plates along circumferential plate edges, apertures along the circumferential plate edges may not align. To ameliorate or minimize misaligned apertures along lapped circumferential plate edges, in some embodiments apertures along a first circumferential plate edge may be offset from apertures along a second circumferential plate edge relative to a transverse edge for a given structural plate.

Figure 10:
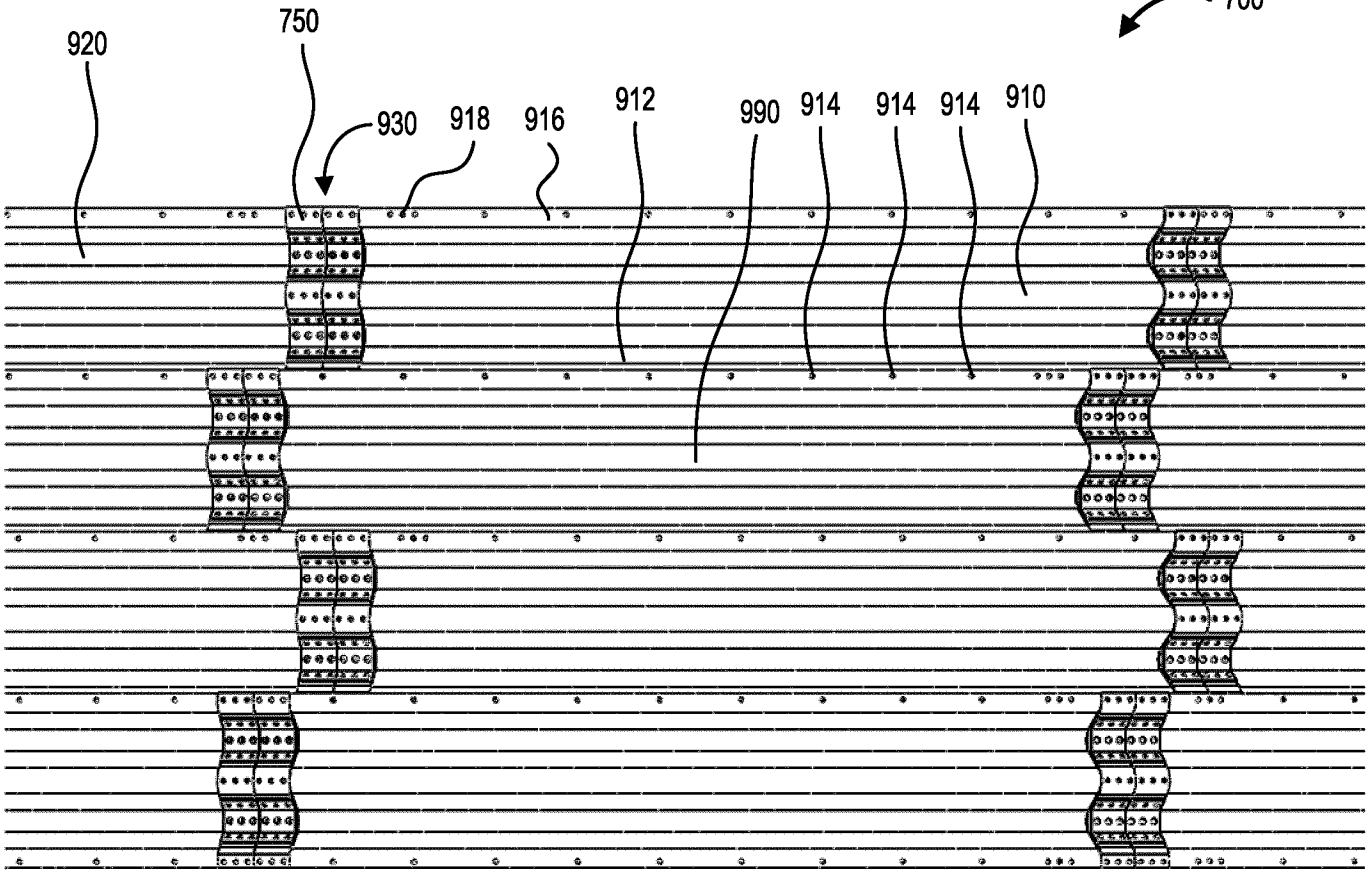
FIG. 10 illustrates a partial top view of the arch-shaped structure illustrated in FIG. 7.

To illustrate, reference is made to FIG. 10, which illustrates a partial top view of the arch-shaped structure 700 of FIG. 7. The joiner plate 750 may secure the first metal plate 910 and the second metal plate 920 in non-overlapping abutment 930 at respective transverse edges of the metal plates. Further, the first metal plate 910 (and/or the second metal plate 920) may be secured to the third metal plate 990 by overlapping abutment along the circumferential plate edge. However, the plate thickness of each of the respective metal plates may cause the apertures along the circumferential plate edges not to align. In addition, the likelihood of misaligned apertures may increase when the radius of the structural plate curvature decreases (e.g., tighter radius on structural plates promulgates the issue of misaligned apertures when adjacent structural plates are lapped). When the apertures along the respective circumferential plate edges do not align, fastening bolts may not be inserted to secure the metal plates along the respective circumferential plate edges.

To ameliorate misaligned apertures along the circumferential plate edges, in some embodiments, apertures along a first circumferential plate edge may be offset from apertures along a second circumferential plate edge of a given metal plate. In FIG. 10, the first plate 910 may include a first circumferential plate edge 912 having one or a first series of spaced apertures 914 adjacent the first circumferential plate edge 912. The one or the first series of spaced apertures 914 may be spaced from a transverse edge of the first metal plate 910.

Further, in FIG. 10, the first plate 910 may include a second circumferential plate edge 916 having one or a second series of spaced apertures 918 adjacent to the second circumferential plate edge 916. One or more of the second series of spaced apertures 918 may be offset from one or more of the first series of spaced apertures 914 relative to the transverse edge. Accordingly, the offset aperture in the second series of spaced apertures 918 of the first metal plate 910 may align with an aperture in a first series of spaced apertures adjacent a first circumferential plate edge of the third metal plate 990.

By offsetting one or more apertures relative to apertures on an opposing circumferential edge of a given metal plate, apertures along lapping circumferential plate edges of adjacent metal plates may align and installation technicians may not require use of pry bars or drift pins for manually pushing metal plates such that apertures may align for receiving fastening bolts.

In some embodiments, to minimize bending and stresses on the joiner plate 750, the joiner plate 750 may include lateral support members. To illustrate, reference is made to FIGS. 11A and 11B, which illustrate a first variant joiner plate 1100A and a second variant joiner plate 1100B, in accordance with embodiments of the present disclosure.

The first variant joiner plate 1100A and the second variant joiner plate 1100B may be configured to secure pairs of structural plates in non-overlapping arrangement at respective transverse edges of structural plates. The joiner plates may include joiner corrugations 1152 having alternating crests and troughs. The variant joiner plates may include at least one joiner aperture 1158 aligning with at least one plate aperture (not illustrated in FIGS. 11A and 11B) of the respective structural plates, such that fastening bolts may be received within aligning apertures.

Figure 11B:
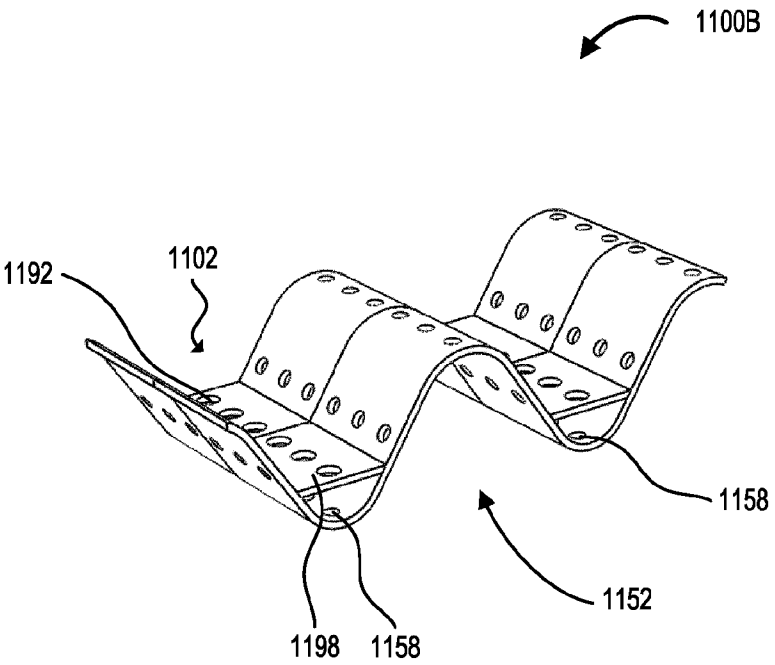
FIGS. 11A and 11B illustrate variant joiner plates, in accordance with embodiments of the present disclosure.
Figure 11A:
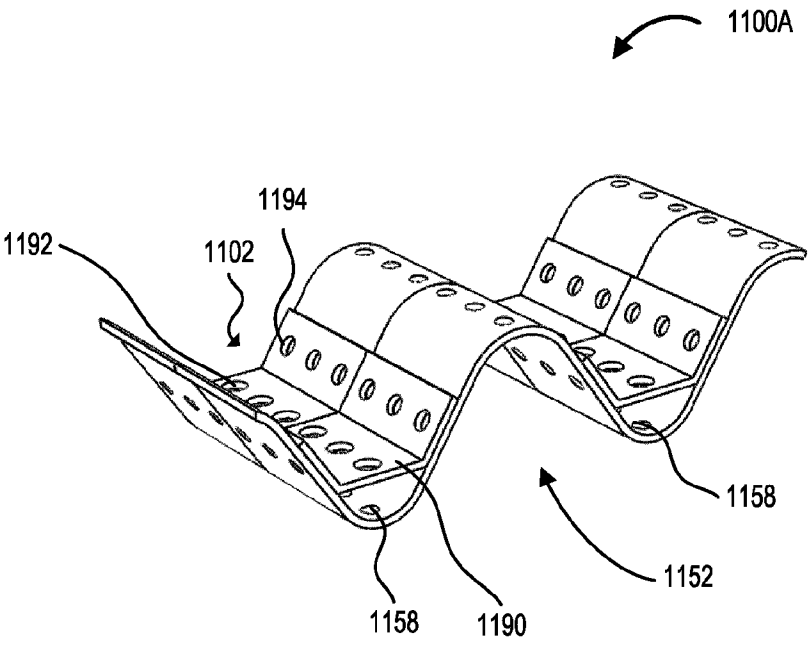

In FIG. 11A, the first variant joiner plate 1100A may include a bolted lateral support member 1190 that may be bolted to the first variant joiner plate 1100A. In some embodiments, the bolted lateral support member 1190 may be received within a trough 1102 of the first variant joiner plate 1100A. The bolted lateral support member 1190 may include one or a series of central apertures 1192 that may align with at least one joiner aperture 1158. In some embodiments, the series of central apertures 1192 may be clearance apertures having a diameter larger than a cross-sectional diameter of fastening bolts. The fastening bolts may drop through the central apertures 1192 and be received within the at least one joiner aperture 1158 for securing the first variant joiner plate 1100A to a metal structural plate via at least one plate aperture.

The bolted lateral support member 1190 may include one or a series of peripheral support apertures 1194 that may align with one or more other joiner apertures 1158. In FIG. 11A, the bolted lateral support member 1190 is secured to the first variant joiner plate 1100A via one or more fastening bolts.

In FIG. 11B, the second variant joiner plate 1100B may include a welded lateral support member 1198 that may be welded to the second variant joiner plate 1100B within a trough 1102 of the second variant joiner plate 1100B. Similar to the first variant joiner plate 1100A illustrated in FIG. 11A, the welded lateral support member 1198 may include a series of central support apertures 1192 that may align with at least one joiner aperture 1158 and may receive fastening bolts for securing the second variant joiner plate 1100B to a metal plate via at least one plate aperture (not illustrated in FIG. 11B).

In FIGS. 11A and 11B, the bolted lateral support member 1190 and the welded lateral support member 1198 may be configured to minimize bending and/or stresses on the joiner plate and/or the metal plate to which the joiner plate is affixed.

Embodiments of the joiner plate described herein may be configured to secure pairs of metal plates, such as corrugated metal plates, in non-overlapping abutment at respective transverse edges of the pair of metal plates. Corrugations in structural plates may be cold formed by roll forming or pressing over a die. A large force and/or pressure input may be necessary to corrugate a structural plate. In some embodiments, a maximum length of a corrugated structural plate that a press apparatus can produce may be a function of at least one of: thickness of the structural plate being corrugated, yield of the structural plate material (e.g., tensile yield of metal, or other yield measure), or a maximum operating force that the press apparatus may assert.

In a non-limiting example, operations for corrugating a structural plate having 12 mm plate thickness or more may be subject to limitations or constraints. The maximum length of a structural plate having 12 mm plate thickness may be relatively short. In some embodiments, the above-described example operations may be a function of press tonnage. As embodiments of the joiner plate described herein may secure pairs of metal plates in non-overlapping abutment at respective transverse edges of the metal plates, the total length or quantity of corrugated metal plate for constructing a given arch-shaped structure may be less than another configuration where adjacent corrugated metal plates may be joined using overlapping seams having fastening bolts (e.g., as illustrated in FIG. 2).

For example, a total length of corrugated structural plate for completing one ring in an arch-shaped structure for an example past project was approximately 42 meters and was constructed using 17 plates. If the arch-shaped structure were constructed by joining adjacent corrugated plates using overlapping seams and fastening bolts (e.g., as illustrated in FIG. 2), a given overlapping seam would account for approximately 380 mm of corrugated structural plate material. Accordingly, for an arch-shaped structure having a length of 42 meters, material attributed to overlapping seams would include approximately 6.08 meters of corrugated structural metal plate. Alternatively, if embodiments of the joiner plate described herein were configured to join structural plates for the above-described arch-shaped structure having a length of 42 meters, approximately 12 to 18% less corrugated structural plate material would be needed.

In some embodiments, corrugations in structural metal plates may be cold formed in a die, activated by a press. The press may include a two-part die consisting of 3 top cylinders atop 2 bottom cylinders. In some embodiments, corrugations in structural metal plates may be roll formed. A flat structural metal plate may be inserted between the cylinders and the structural metal plate may be subject to several tonnes of pressure to cold form the flat structural metal plate into a corrugated structural plate. For example, the structural metal plate may be subject to in excess of or greater than 1,000 tonnes of force. In some embodiments, plate apertures may be laser cut prior to corrugation operations. In some embodiments, the plate apertures may be stamped or punched following corrugation operations.

Once structural metal plates have been corrugated, the corrugated metal plates may be formed via an apparatus having three rollers: a 1-roll top roller and a 2-roll bottom roller. In some embodiments, the apparatus may have 4-rolls. It may be appreciated that other apparatus types may be used to form metal plates to have a radius.

Corrugated metal plates may be curved with a radius when passed through the above-described forming apparatus. The radius of forming may be based on the orientation/placement of the 1-roll top roller and the 2-roll bottom roller relative to the corrugated metal plates. In some embodiments, the forming apparatus may be unable to radius end portions of corrugated metal plates. Because end portions of corrugated metal plates manufactured by forming apparatus described above may be flat relative to portions of the corrugated metal plates between the end portions, in some embodiments, the joiner plate may include a brake portion positioned between transverse ends of the joiner plate. The brake portion may position opposing ends of the joiner plate to align or abut respective flat portions of the corrugated metal plate for securing the metal plates in non-overlapping abutment.

Figure 12C:
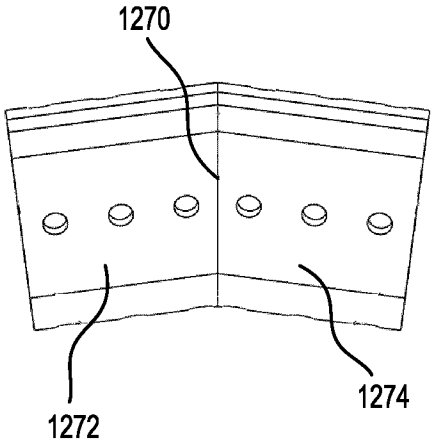
FIGS. 12A, 12B, and 12C illustrate joiner plates and an enlarged view of an inflection score of the joiner plate, in accordance with embodiments of the present disclosure.
Figure 12B:
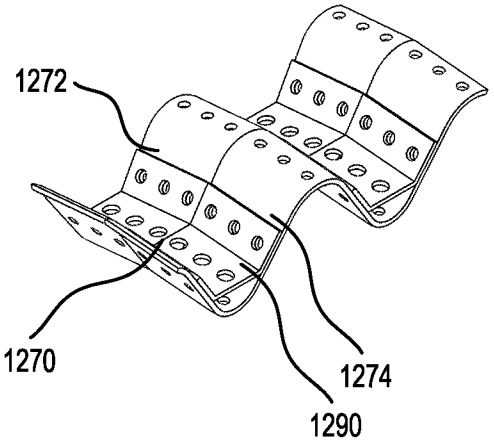
Figure 12A:
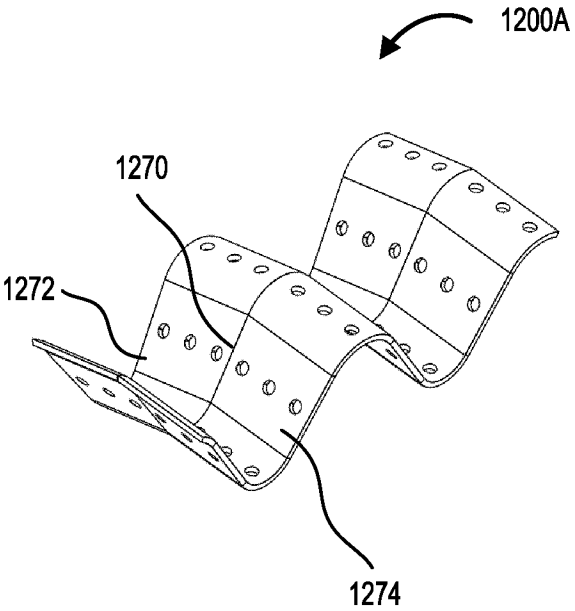

Reference is made to FIG. 12A, which illustrates a perspective view of a joiner plate 1200A, in accordance with an embodiment of the present disclosure. The joiner plate 1200A may include an inflection score 1270 between transverse edges of the joiner plate 1200. A first portion surface 1272 on a first side of the inflection score 1270 may be in a different plane than a second portion surface 1274 on an opposing side of the inflection score 1270. By configuring the respective sides of opposing sides of the inflection score 1270 to be in different planes, the joiner plate 1200 may accommodate flat portions of corrugated metal plates that the forming apparatus described above is unable to curve with a radius.

FIG. 12B illustrates the joiner plate 1200A illustrated in FIG. 12A, and with a lateral support member 1290 affixed thereto.

FIG. 12C illustrates an enlarged view of the inflection score 1270 of FIG. 12A. In FIG. 12C, the first surface portion 1272 may be in a different plane of the three-dimensional space than the second surface portion 1274. The inflection score 1270 may be a break or point of inflection where the respective surface portions of the joiner plate 1200A may extend in different planes.

Figure 13:
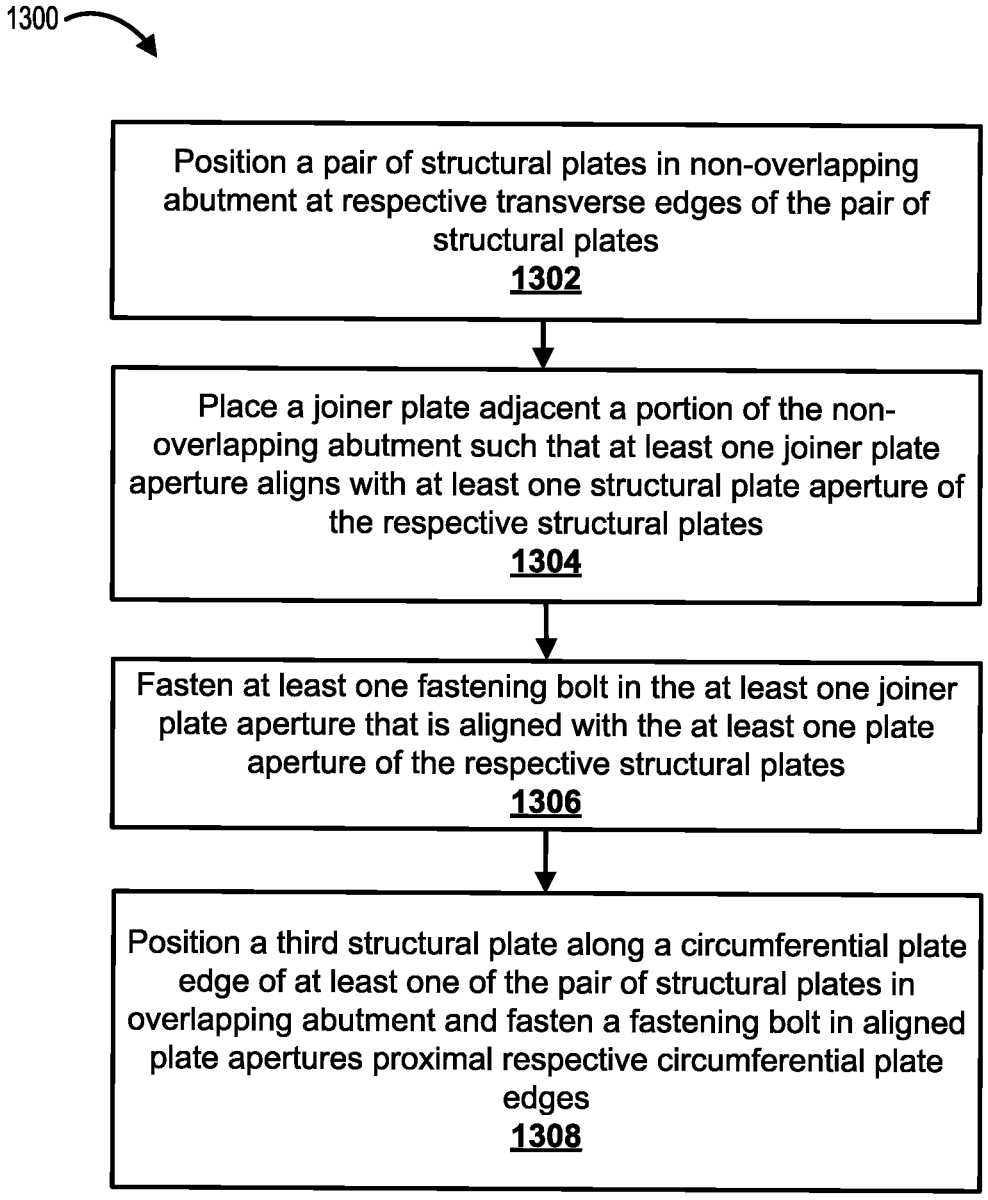
FIG. 13 illustrates a flowchart of a method of assembling an arch-shaped structure, in accordance with an embodiment of the present disclosure.

Reference is made to FIG. 13, which illustrates a flowchart of a method 1300 of assembling an arch-shaped structure, in accordance with an embodiment of the present disclosure. The method 1300 may include operations by an installation technician, an installation apparatus, an installation robot, or the like.

The arch-shaped structure includes a plurality of interconnected structural plates. The respective structural plates include a transverse end having at least one plate aperture adjacent a transverse edge. In some embodiments, the structural plates may have plate corrugations extending transversely of a longitudinal length of the arch-shaped structure.

A joiner plate may secure the pair of structural plates in non-overlapping arrangement at the respective transverse edges of the pair of structural plates. The joiner plate may include at least one joiner plate aperture aligning with the at least one structural plate aperture of the respective structural plates for receiving fastening bolts.

At operation 1302, a pair of structural plates may be positioned in non-overlapping abutment at respective transverse edges of the pair of structural plates.

At operation 1304, the joiner plate may be placed adjacent a portion of the non-overlapping abutment such that at least one joiner plate aperture aligns with at least one structural plate aperture of the respective structural plates.

In some embodiments, the joiner plate may include joiner corrugations and the method may include aligning the plate corrugations with the joiner corrugations to nest the joiner corrugations with the plate corrugations.

At operation 1306, at least one fastening bolt may be fastened in the at least one joiner plate aperture that is aligned with the at least one plate aperture of the respective structural plates.

In some embodiments, a structural plate may be secured along a circumferential edge of a given structural plate. At operation 1308, a third structural plate may be positioned along a circumferential plate edge of at least one of the pair of structural plates in overlapping abutment; and a fastening bolt may be fastened in aligned plate apertures proximal the respective circumferential plate edge of the third structural plate and at least one of the pair of structural plates.

Figure 14B:
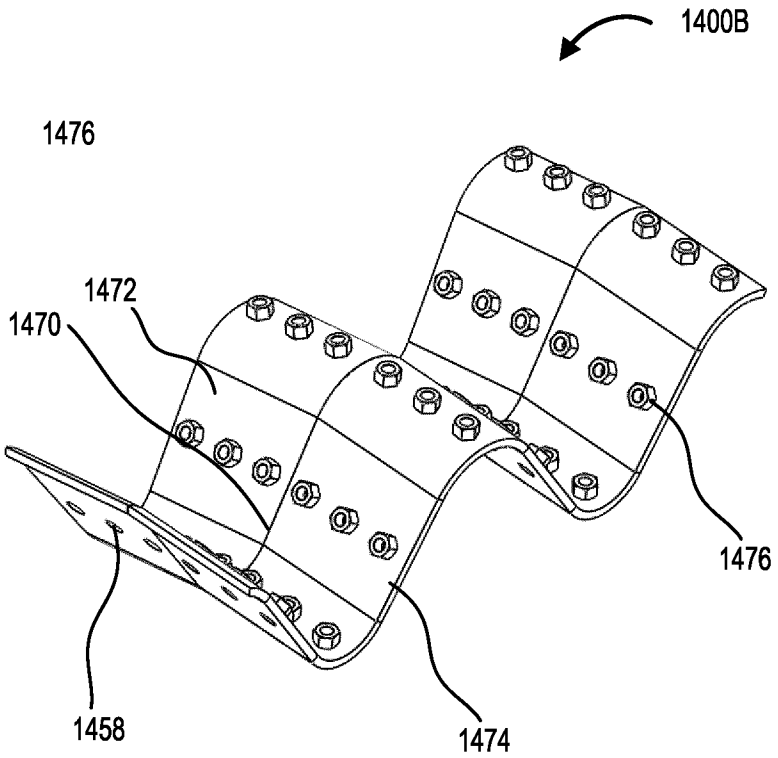
FIGS. 14A and 14B illustrate joiner plates having one or more fastening nuts attached thereto, in accordance with an embodiment of the present disclosure.
Figure 14A:
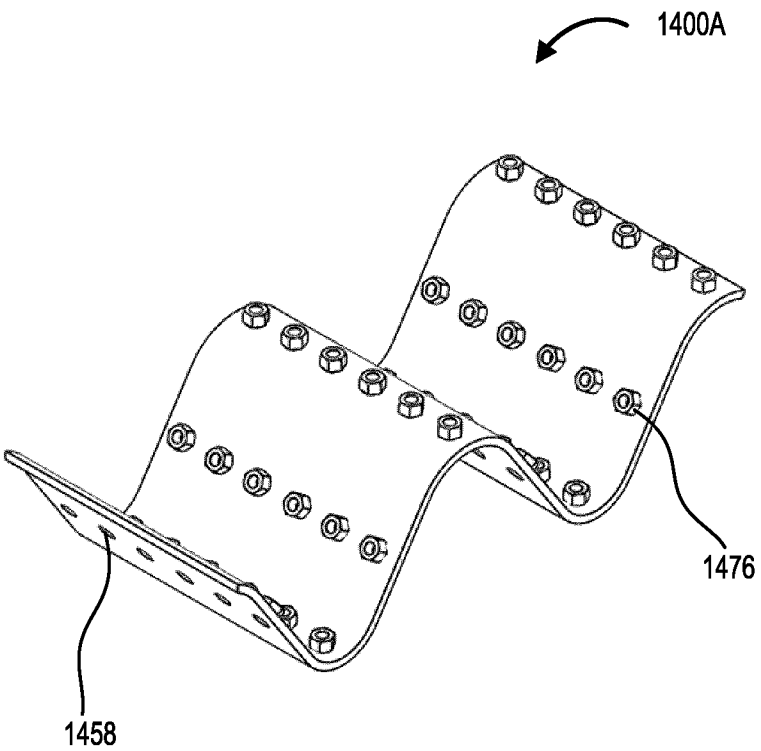

Reference is made to FIG. 14A, which illustrates a joiner plate 1400A having one or more fastening nuts 1476 fastened thereto, in accordance with another embodiment of the present disclosure. For example, fastening nuts 1476 may be welded adjacent respective joiner apertures 1458. The one or more fastening nuts 1476 may be threaded and may be configured to receive a fastening bolt that is threaded through the respective joiner aperture 1458 and through the fastening nut 1476 that is welded adjacent the respective joiner aperture 1458. In some embodiments, fastening nuts 1476 may be welded to a subset of the joiner apertures 1458, while remaining joiner apertures 1458 may not have fastening nuts 1476 welded thereto. In some scenarios, fastening nuts 1476 welded adjacent to a joiner aperture 1458 may allow installation of the joiner plate 1400 from a single side of an arch-shaped structure. Being able to install the joiner plate 1400 from a single side of an arch-shaped structure may be desirable when the opposing side of the arch-shaped structure may not be easily accessible.

Reference is made to FIG. 14B, which illustrates a joiner plate 1400B having one or more fastening nuts 1476 fastened thereto, in accordance with another embodiment of the present disclosure. The joiner plate 1400B may be similar to the joiner plate 1400A illustrated in FIG. 14A and may additionally include an inflection score 1470 between transverse edges of the joiner plate 1400B. Similar to the example joiner plate illustrated in FIG. 12A, a first surface portion 1472 on a first side of the inflection score 1470 may be in a different plate of the three-dimensional space than a second surface portion 1474 on an opposing side of the inflection score 1470. As described, in some embodiments, the respective first surface portion 1472 and the second surface portion 1474 may be configured to align or abut flat portions of corrugated metal plates being secured in non-overlapping abutment.

Figure 15B:
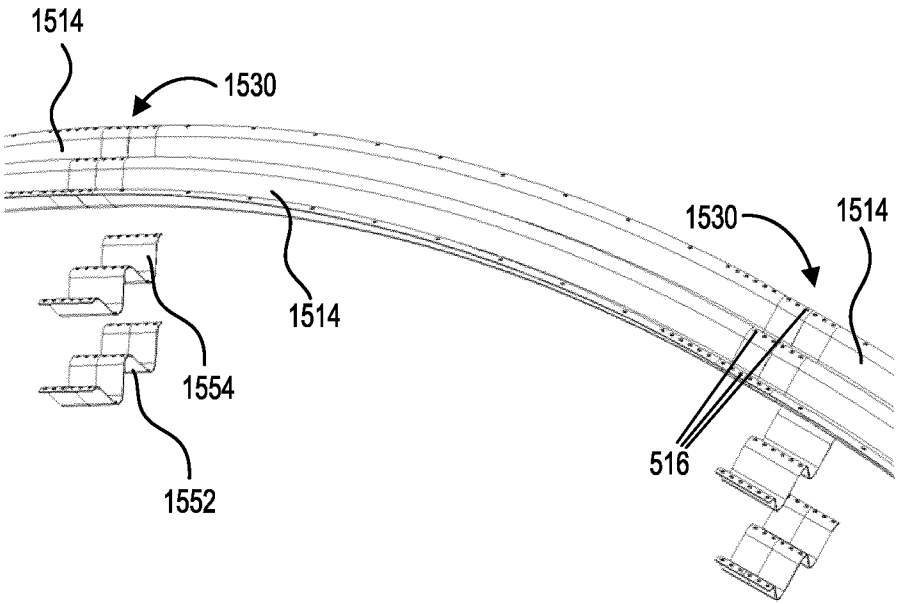
FIGS. 15A and 15B illustrate exploded views of abutting structural plates and joiner plates, in accordance with embodiments of the present disclosure.
Figure 15A:
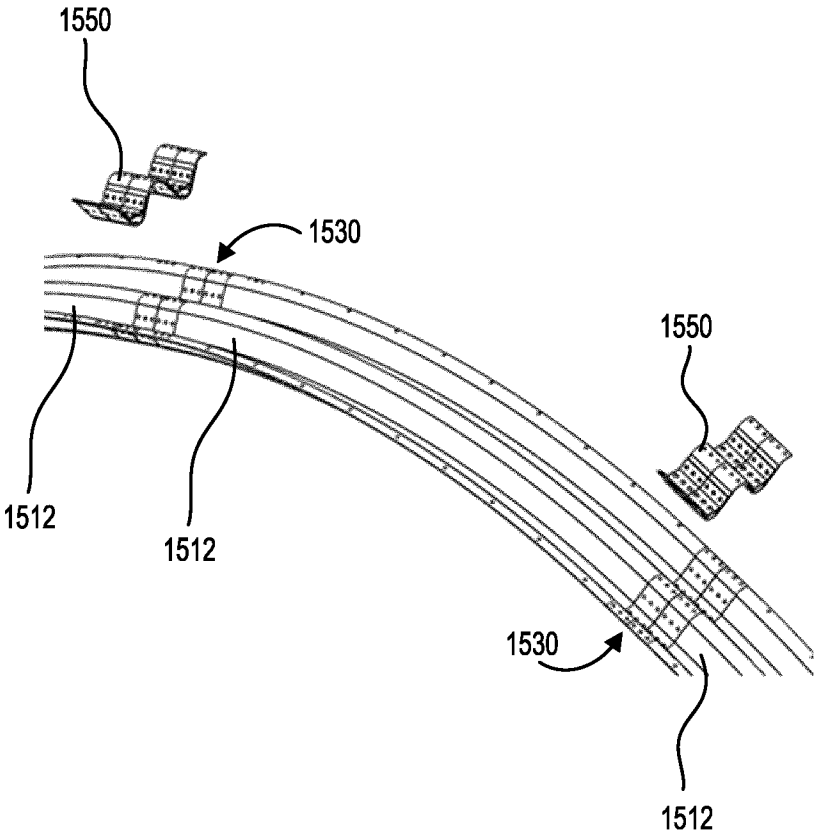

Reference is made to FIG. 15A, which illustrates an exploded view of abutting structural plates 1512 and joiner plates 1550, in accordance with an embodiment of the present disclosure. In FIG. 15, the abutting structural plates 1512 may be in non-overlapping abutment 1530 at respective transverse edges of the structural plates 1512.

To join abutting structural plates 1512 at the non-overlapping abutments 1530, corrugations of the joiner plates 1550 may be nested with corresponding corrugations of the structural plates 1512. Joiner apertures may be aligned with plate apertures and fastening bolts (or other fasteners) may be received within the aligned joiner apertures/plate apertures. In FIG. 15A, the illustrated joiner plate 1550 may be installed for joining the abutting structural plates 1512 on an outer surface of an arch-shaped structure.

Reference is made to FIG. 15B, which illustrates an exploded view of abutting structural plates 1514 in a non-overlapping arrangement at respective transverse edges of the structural plates 1514. The exploded view is similar to structural plates of FIG. 15A, but may not include transverse apertures at a tangent portion of corrugations proximal to transverse ends of the respective structural plates 1514. For example, the structural plates 1514 in FIG. 15B include transverse apertures 516 that may be: (i) proximal to the transverse edges; and (ii) circumferential edges, peaks, and valleys/troughs of the corrugations.

To join abutting structural plates 1512 at the non-overlapping abutments 1530, corrugations of the joiner plates 1552 may be nested with corresponding corrugations of the structural plates 1512. Joiner apertures may be aligned with transverse apertures 516 of the structural plates 1512, and fastening bolts (or other fasteners) may be received within the aligned joiner apertures/transverse apertures 516.

In some embodiments, a gasket 1554 may be corrugated and may be positioned between the abutting structural plates 1512 and the joiner plate 1552. The gasket 1554 may be constructed of rubber material, or other types of material to reduce passage of fluids or fines (e.g., small particles found in backfill material) through gaps of the non-overlapping abutments 1530.

Figure 16B:
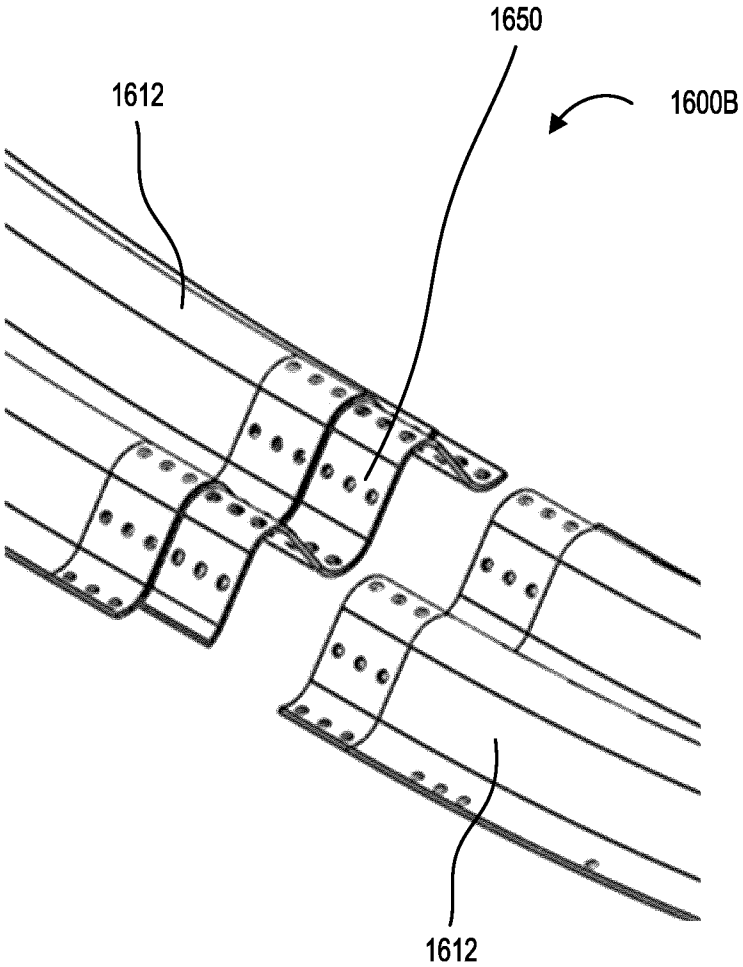
FIGS. 16A and 16B illustrate an enlarged exploded view and a partial exploded view, respectively, of adjacent structural plates.
Figure 16A:
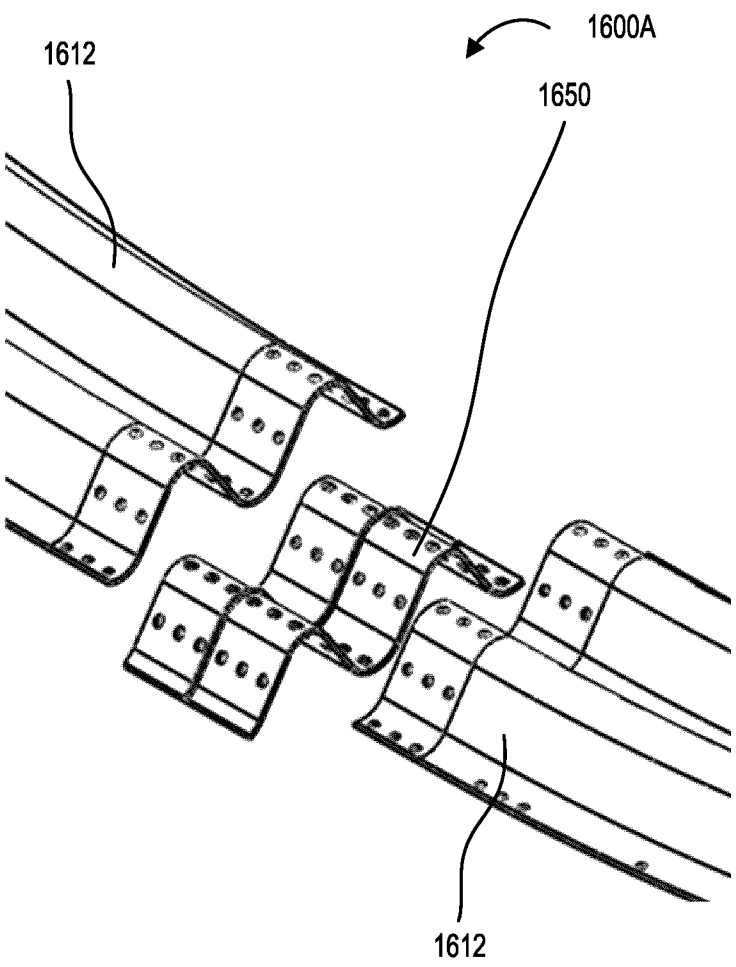

Reference is made to FIGS. 16A and 16B, which illustrate an enlarged exploded view 1600A and a partial exploded view 1600B, respectively, of adjacent structural plates 1612. In FIG. 16A, the respective structural plates 1612 and the joiner plate 1650 are unassembled. In some embodiments, the joiner plate 1650 may be similar to the joiner plate 750 illustrated in FIG. 8 or the joiner plate 1200A illustrated in FIG. 12A.

In FIG. 16B, the crests and troughs of the joiner plate 1650 may be nested on the crests and troughs of one of the structural plates 1612. The other of the structural plates 1612 is unassembled from the joiner plate 1650. In FIG. 16B, the illustrated joiner plate 1650 may be installed for joining the abutting structural plates 1612 to form an arch-shaped structure.

Figure 17B:
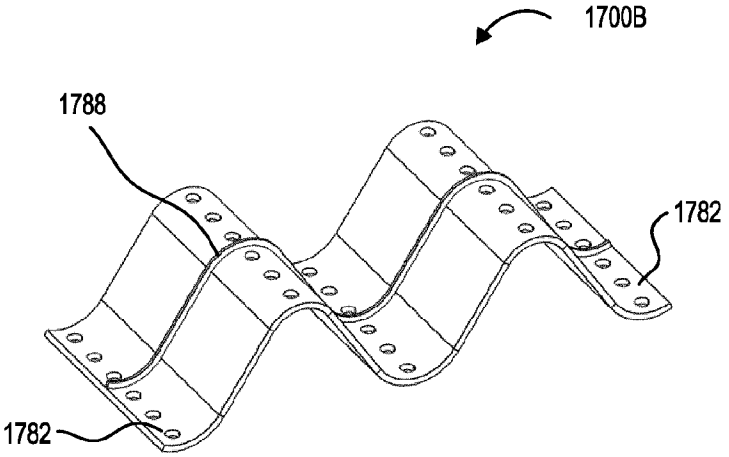
FIGS. 17A and 17B illustrate joiner plates having a transverse rib, in accordance with embodiments of the present disclosure.
Figure 17A:
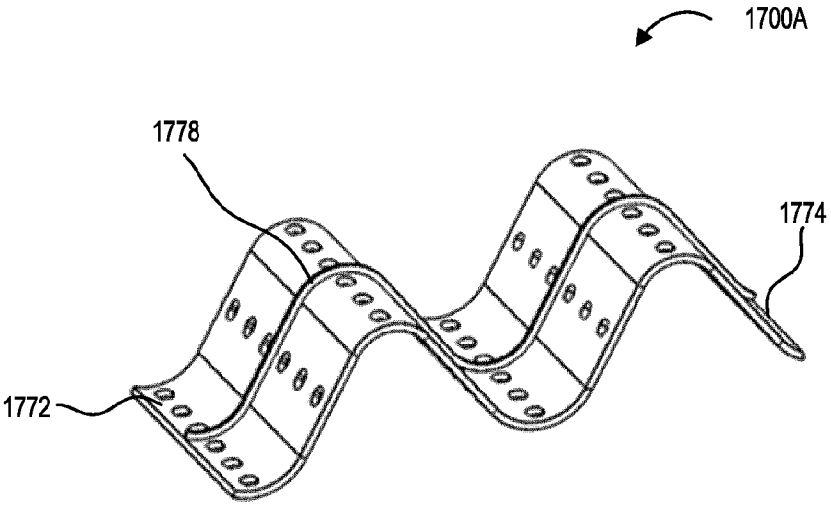

Reference is made to FIG. 17A, which illustrates a joiner plate 1700A having a transverse rib 1778, in accordance with embodiments of the present disclosure. The transverse rib 1778 may extend between a first circumferential joiner edge 1772 and a second circumferential joiner edge 1774. The transverse rib 1178 may be positioned between the transverse ends of the joiner plate 1700A. The joiner plate 1700A may be configured to join adjacent structural plates at transverse edges of structural plates.

In some embodiments, adjacent structural plates may be secured by the joiner plate 1700A by non-overlapping arrangement. For example, a transverse edge of a structural plate may not abut a transverse edge of an adjacent structural plate. The respective transverse edges of the structural plate may abut the transverse rib 1778.

In some embodiments, the transverse rib 1778 may be constructed of polyvinyl chloride (PVC), rubber, or other material that may be configured to prevent or reduce passage of fluids through the non-overlapping interface between transverse edges of the respective adjacent structural plates that are joined by the joiner plate 1700A.

In some embodiments, the joiner plate 1700A having the transverse rib 1778 may be the joiner plate 1650 illustrated in FIGS. 16A and 16B.

Reference is made to FIG. 17B, which illustrates a joiner plate 1700B having a transverse rib 1788. Similar to the example in FIG. 17A, the transverse rib 1788 may be constructed of PVC, rubber, or other material configured to prevent or reduce passage of fluids through a non-overlapping interface between transverse edges of respective adjacent structural plates joined by the joiner plate 1700B.

The joiner plate 1700B of FIG. 17B includes opposing circumferential joiner edges 1782 having one or more joiner apertures positioned thereto. When the joiner plate 1700B may be positioned at a non-overlapping abutment of transverse edges of adjacent structural plates, the opposing circumferential joiner edges 1782 may overlap with corresponding circumferential edge portions of the structural plates. The one or more joiner apertures of the joiner plate 1700B may substantially align with apertures of the respective structural plates for receiving fasteners.

In the illustration of FIG. 17B, the joiner plate 1700B may include joiner apertures at one or more peaks and troughs/valleys of the corrugations for aligning and overlapping with apertures of structural plates.

Figure 18B:
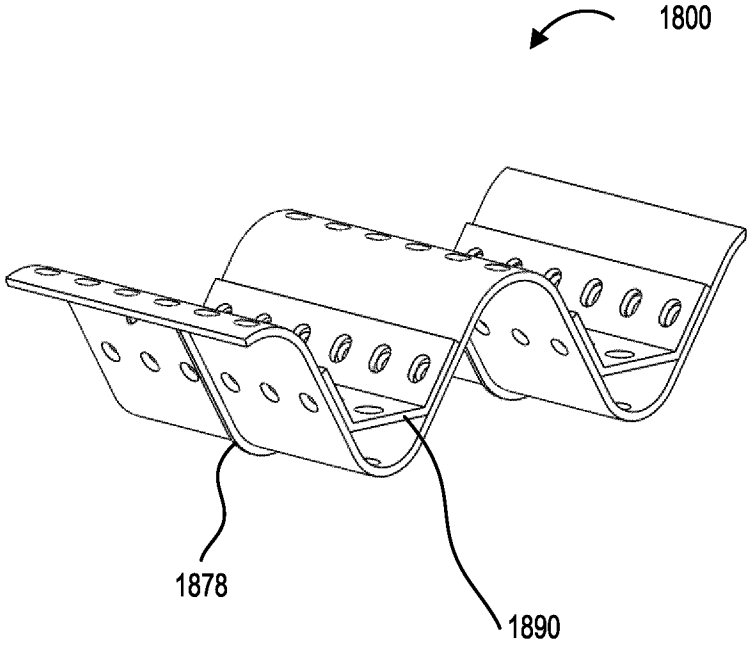
FIGS. 18A and 18B illustrate further variants of joiner plates, in accordance with embodiments of the present disclosure.
Figure 18A:
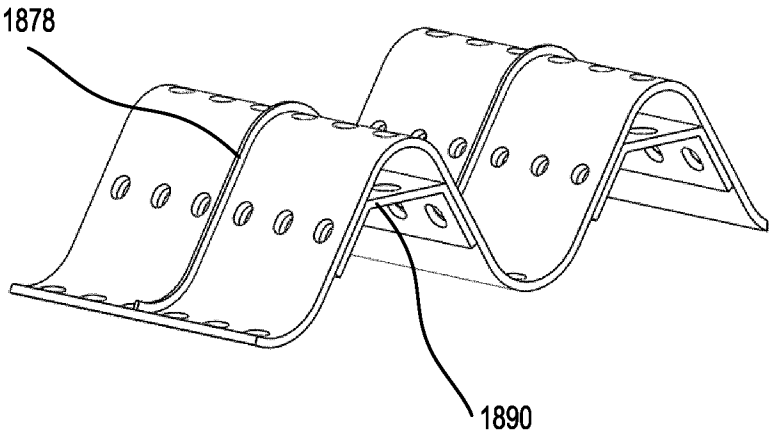

Reference is made to FIGS. 18A and 18B, which illustrate further variants of joiner plates, in accordance with embodiments of the present disclosure. In FIG. 18A, the joiner plate 1800 may be similar to the variant joiner plate 1700 of FIG. 17 and may include a transverse rib 1878 and a bolted lateral support member 1890. The bolted lateral support member 1890 may be configured to minimize bending and stresses on the joiner plate 1800.

In the illustrated orientation of FIG. 18A, the joiner plate 1800 may be configured to join adjacent structural plates that form an arch-shaped structure on an inner surface of the arch-shaped structure. In some scenarios, the joiner plate 1800A may be rotated or oriented to join adjacent structural plates that form an arch-shaped structure on an outer surface of the arch-shaped structure, as illustrated in FIG. 18B.

Figure 19:
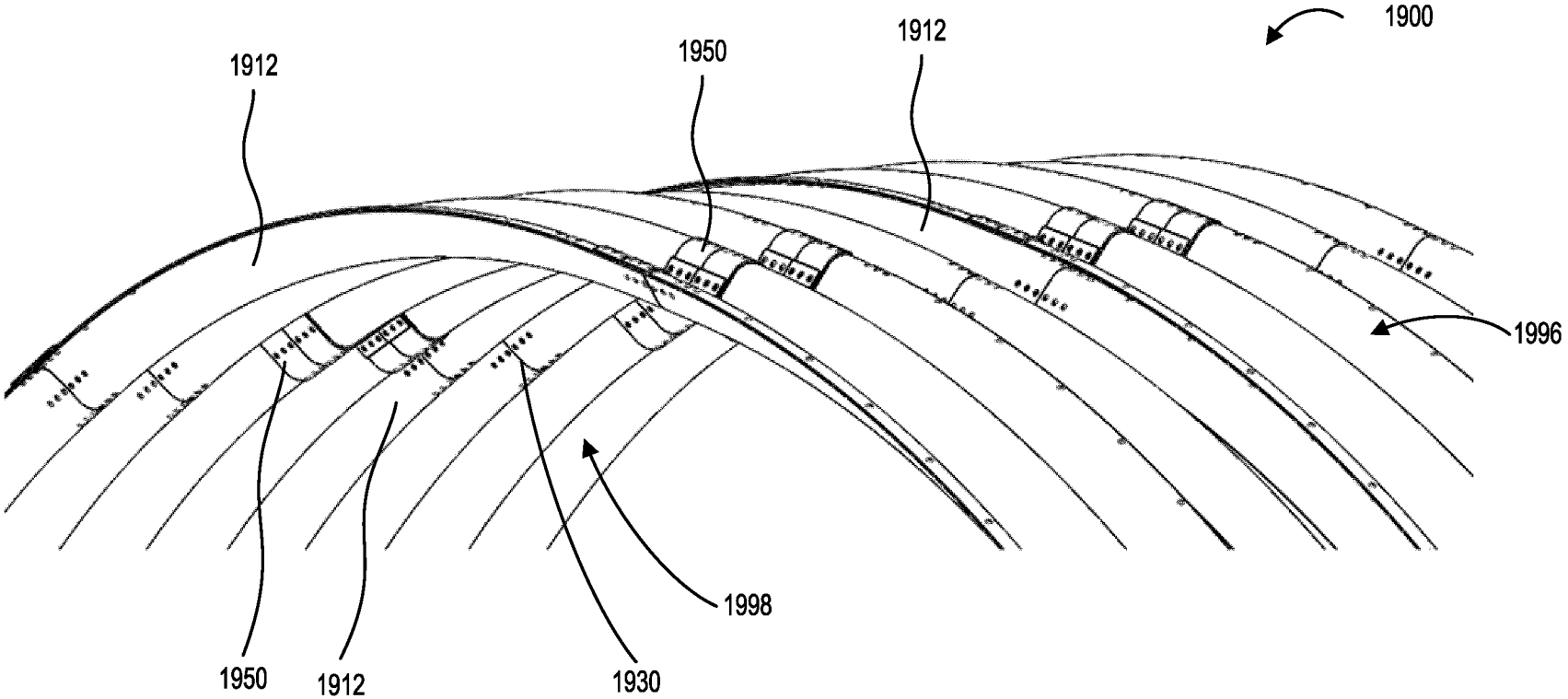
FIG. 19 illustrates an enlarged partial perspective view of an arch-shaped structure, in accordance with embodiments of the present disclosure.

Reference is made to FIG. 19, which an enlarged partial perspective view of an arch-shaped structure 1900, in accordance with embodiments of the present disclosure. The arch-shaped structure 1900 includes a plurality of structural plates, and the plurality of structural plates may be secured at non-overlapping abutting transverse ends 1930 of the respective structural plates. The plurality of structural plates may be joined by a plurality of joiner plates 1950.

In some embodiments, the joiner plates 1950 may be installed on an outer surface 1996 of the arch-shaped structure 1900. In some embodiments, the joiner plates 1950 may be installed on an inner surface 1998 of the arch-shaped structure 1900. In some embodiments, the plurality of joiner plates 1950 may be installed on the outer surface 1996 of the arch-shaped structure 1900 when the inner surface 1998 may be inaccessible or not easily accessible during assembly operations. In some embodiments, the plurality of joiner plates 1950 may be installed on the inner surface 1998 of the arch-shaped structure 1900 when the outer surface 1996 may be inaccessible or not easily accessible during assembly operations.

In some embodiments, the plurality of joiner plates 1950 may be installed on a combination of the inner surface 1998 and the outer surface 1996, as illustrated in FIG. 19.

Figure 20:
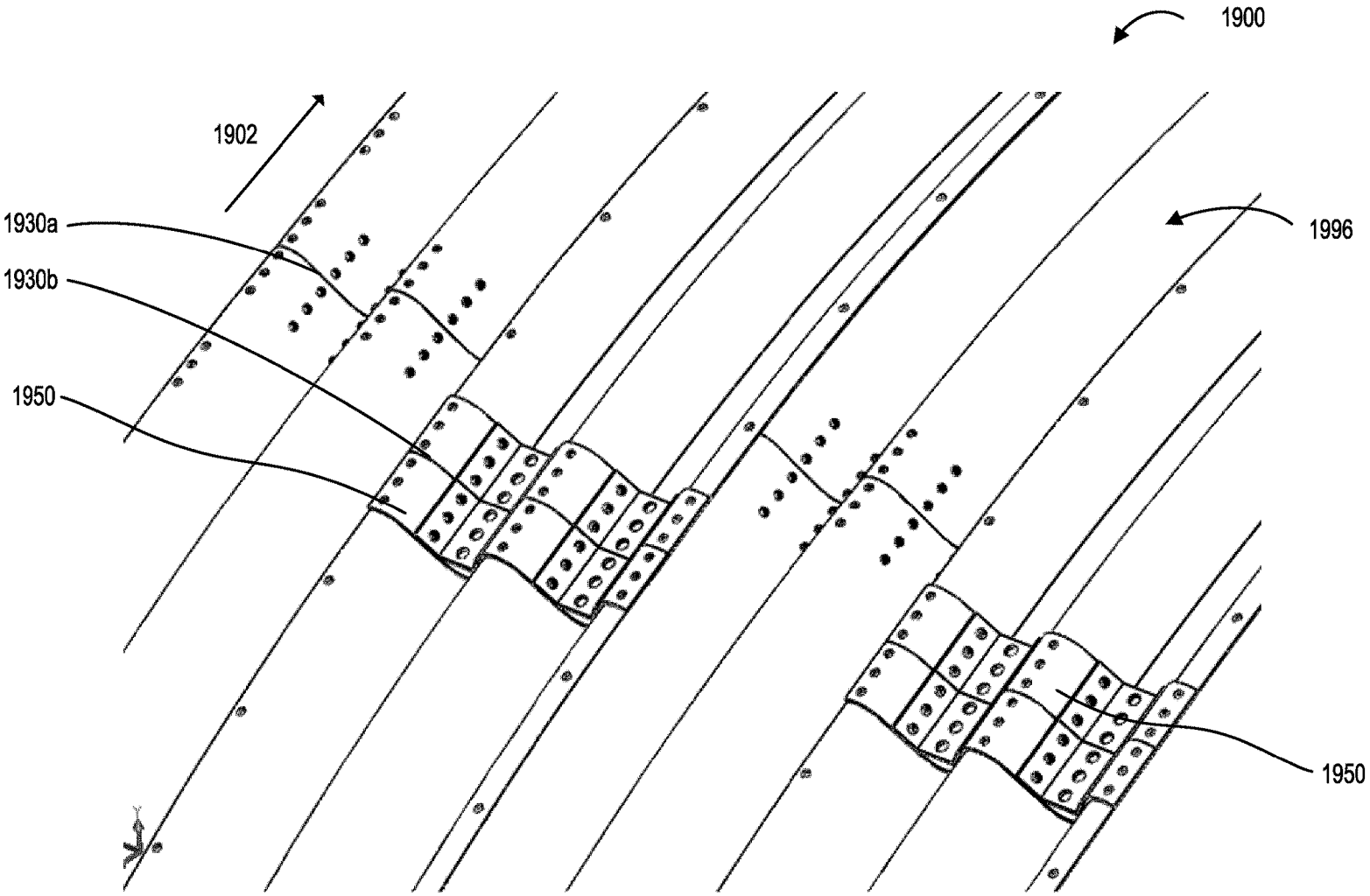
FIG. 20 illustrates an enlarged top view of the arch-shaped structure of FIG. 19.

FIG. 20 illustrates an enlarged top view of the arch-shaped structure 1900 of FIG. 19, illustrating the outer surface 1996 of the arch-shaped structure 1900. The plurality of non-overlapping abutting transverse ends may be staggered in a circumferential direction 1902. For example, a first non-overlapping abutting transverse end 1930*a* may be offset from a second non-overlapping abutting transverse end 1930*b* of an adjacent structural plate in the circumferential direction 1902.

In some embodiments, the structural plates of the arch-shaped structure may be joined by a combination of joiner plates 1950 installed on the outer surface 1996 and the inner surface. A joiner plate 1950 may be installed on an inner surface of the arch-shaped structure 1900, for example, at the first non-overlapping abutting transverse end 1930*a*.

Figure 21B:
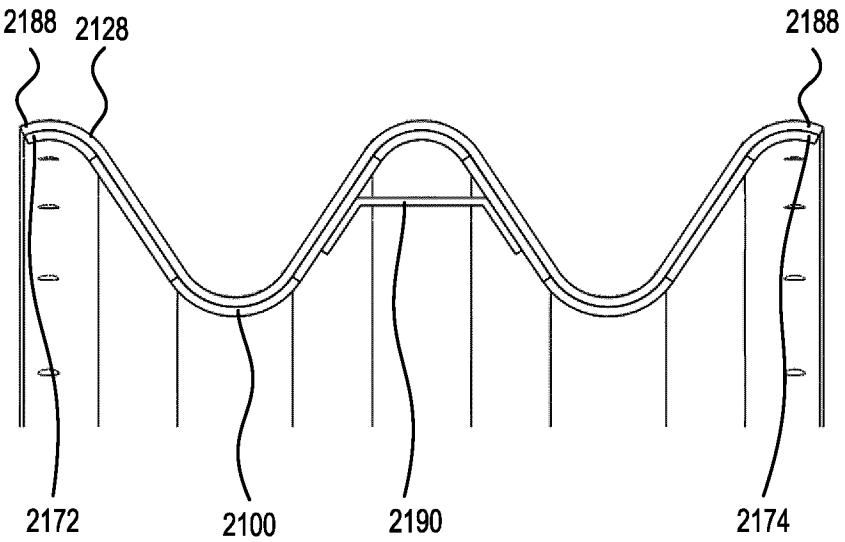
FIGS. 21A and 21B illustrate a joiner plate having a lateral support member and an enlarged cross-sectional view of the joiner plate installed on a structural plate, respectively, in accordance with embodiments of the present disclosure.
Figure 21A:
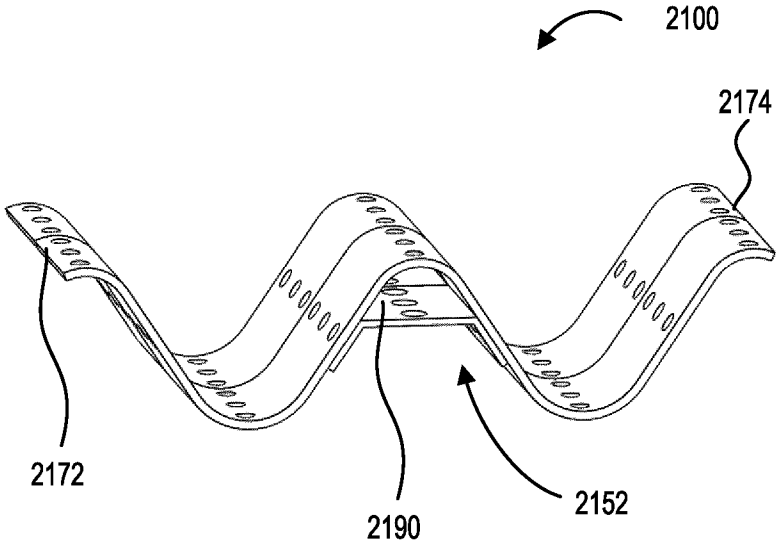

Reference is made to FIG. 21A, which illustrates a joiner plate 2100 having a lateral support member 2190, in accordance with another embodiment of the present disclosure. In the orientation illustrated in FIG. 21A, the lateral support member 2190 may be configured within a crest 2152 of the joiner plate 2100. Further, the joiner plate 2100 may be configured to include a first circumferential joiner edge 2172 to overlap a circumferential plate edge of a structural plate and a second circumferential joiner edge 2174 to overlap another circumferential plate edge of the structural plate. Thus, the joiner plate 2100 may overlap from circumferential plate edge to an opposing circumferential plate edge of the structural plate. In contrast, the second circumferential joiner edge 774 of the joiner plate illustrated in FIG. 8 described above may be positioned within a trough of the structural plate.

Reference is made to FIG. 21B, which illustrates an enlarged cross-sectional view of the joiner plate 2100 installed on an inner surface of a structural plate 2128. The first circumferential joiner edge 2172 and the second circumferential joiner edge 2174 may overlap corresponding circumferential plate edges 2188 of the structural plate 2128.

Figure 22B:
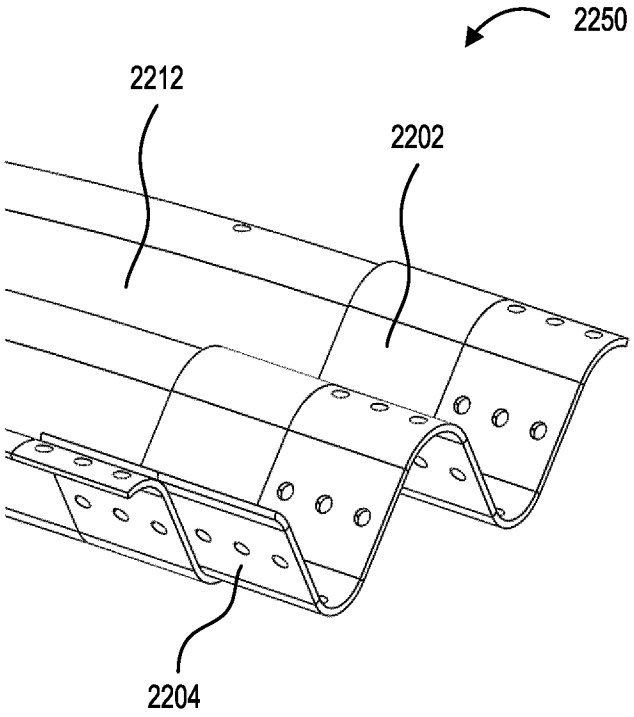
FIGS. 22A and 22B illustrate variant joiner plates having a portion configured to be welded to a structural plate, in accordance with embodiments of the present disclosure.
Figure 22A:
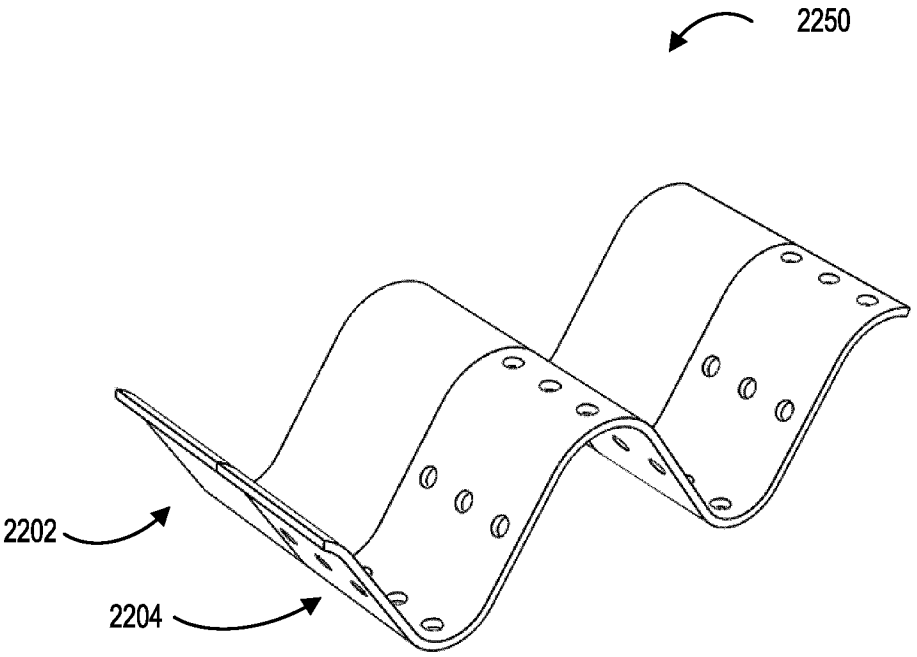

Reference is made to FIG. 22A, which illustrates a variant joiner plate 2250, in accordance with an embodiment of the present disclosure. The variant joiner plate 2250 may include a weldable portion 2202 and a boltable portion 2204.

The weldable portion 2202 may be welded to a transverse end of a structural plate. In some scenarios, to minimize on-site assembly of structural plates and joiner plates, the variant joiner plate 2250 may be welded to the transverse end of the structural plate during manufacturing of the structural plate. In some other scenarios, installation technicians may weld the variant joiner plate 2250 to a structural plate via the weldable portion 2202 at the installation site.

Illustrated in FIG. 22B is the variant joiner plate 2250 of FIG. 22A welded to a structural plate 2212 at a transverse end of the structural plate 2212. The structural plate 2212 may be joined to a second structural plate when a transverse edge of the second structural plate is positioned against or abutting the boltable portion 2204 of the variant joiner plate 2250. The second structural plate may be joined to the variant joiner plate 2250 by fastening bolts, or other suitable fasteners.

Figure 23:
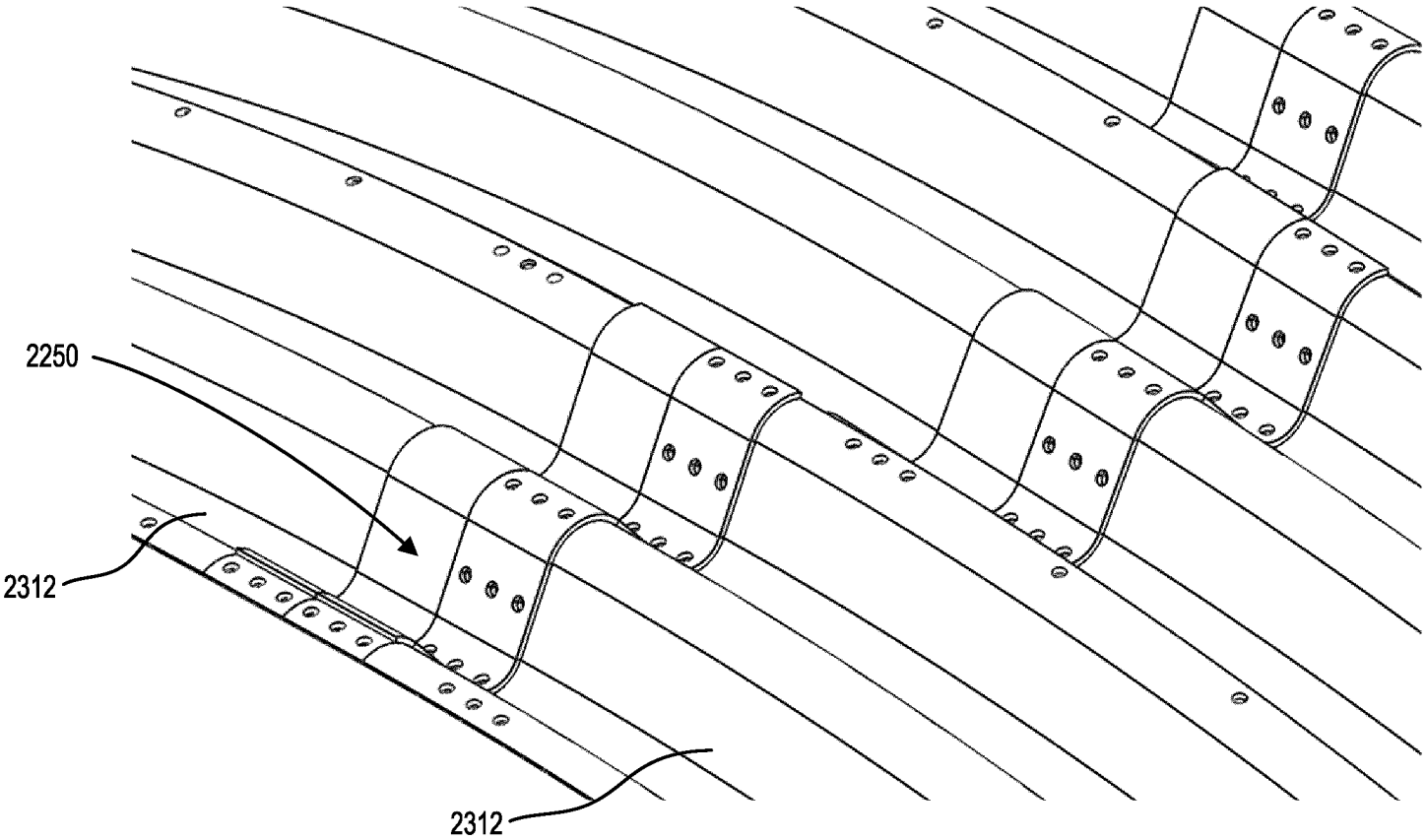
FIG. 23 illustrates a plurality of structural plates joined along non-overlapping abutment ends by the variant joiner plate of FIG. 22A, in accordance with an embodiment of the present disclosure.

Reference is made to FIG. 23, which illustrates a plurality of structural plates 2312 joined along non-overlapping abutment ends by the variant joiner plate 2250 of FIG. 22A. The weldable portion 2202 of the variant joiner plate 2250 may be welded to a transverse end of a first structural plate and the boltable portion 2204 of the variant joiner plate 2250 may be configured to be bolted to a transverse end of a second structural plate.

In FIG. 23, the structural plates may be assembled, using the variant joiner plate 2250, as structural rings, and the respective structural rings may be joined along circumferential edges of the structural rings via fastening bolts within aligned circumferential apertures. In some embodiments, the plurality of joiner plates 2250 of a first structural ring may be offset from the plurality of joiner plates 2250 of an adjacent second structural ring, thereby minimizing overlap of circumferential joiner edges of the respective joiner plates 2250.

Figure 24:
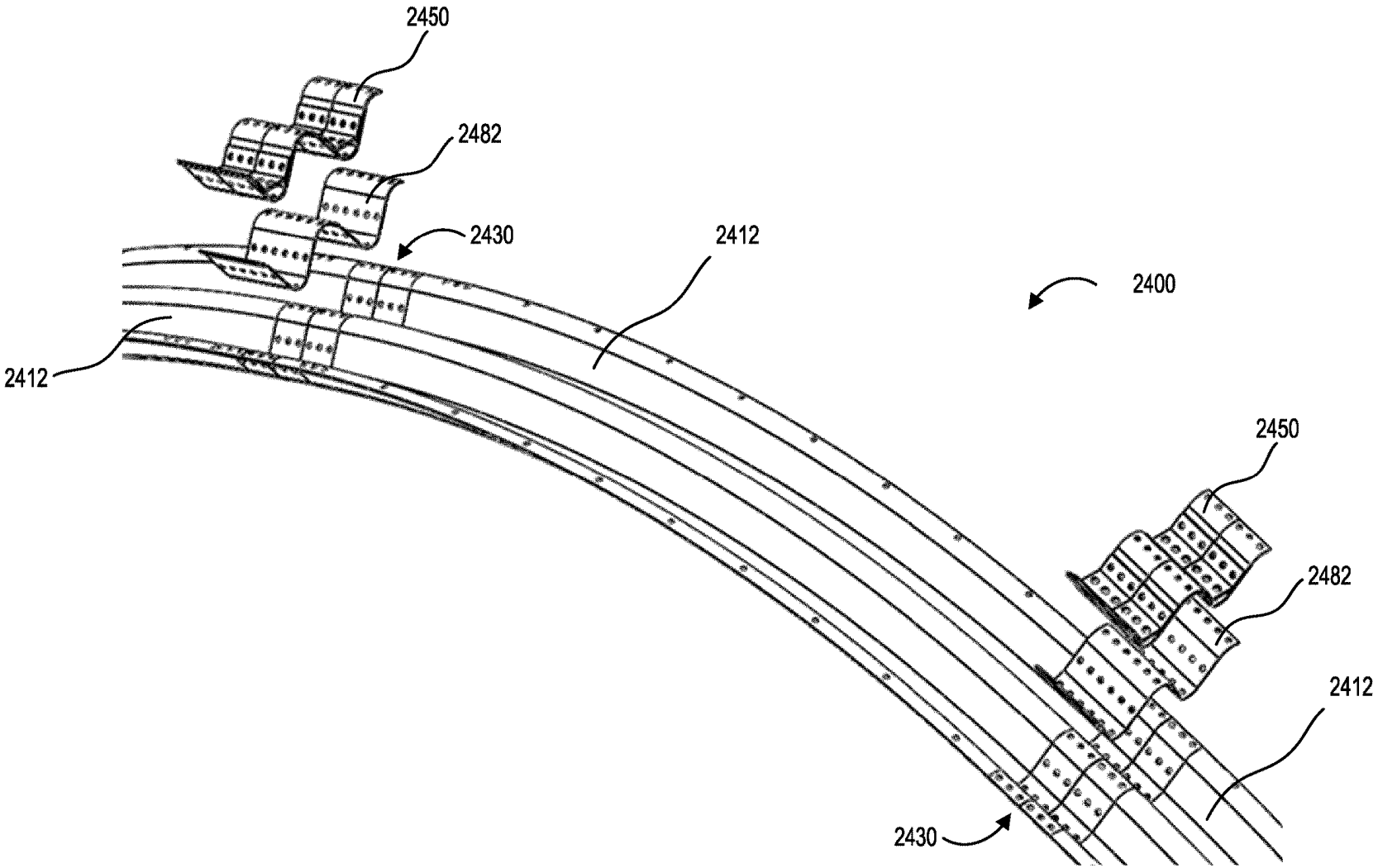
FIG. 24 illustrates an exploded view of a structural ring assembled from a plurality of structural plates, a joiner plate, and a sealing gasket, in accordance with an embodiment of the present disclosure.

Reference is made to FIG. 24, which illustrates an exploded view of a structural ring 2400, in accordance with embodiments of the present disclosure. The structural ring 2400 may include a plurality of structural plates 2412 joined at respective transverse ends in a non-overlapping abutment 2430. The plurality of structural plates 2412 may be joined at the respective non-overlapping abutments 2430 by a joiner plate 2450.

In some embodiments, placed between the respective non-overlapping abutments 2430 and the joiner plates 2450 may be a sealing gasket 2482. The sealing gasket 2482 may be constructed of rubber, PVC, or the like that may be configured to prevent or minimize passage of fluids through the non-overlapping abutments 2430. In some embodiments, the sealing gasket 2482 may be placed atop or adjacent to the non-overlapping abutment 2430. In some other embodiments, at least a portion of the sealing gasket 2482 may be pushed between the respective transverse ends of the structural plates at the non-overlapping abutment 2430.

Other features configured for minimizing or reducing bending moments or stresses on embodiment joiner plates described herein may be contemplated. For example, supplemental structural plates may be welded to corrugated joiner plates. In some other examples, supplemental structural masses may be affixed within crests or troughs of corrugated joiner plates. To illustrate, reference is made to FIGS. 25A, 25B, and 26, which illustrates perspective views of joiner plates having features configured to minimize or reduce bending moments or stresses on joiner plates, in accordance with embodiments of the present disclosure.

Figure 25B:
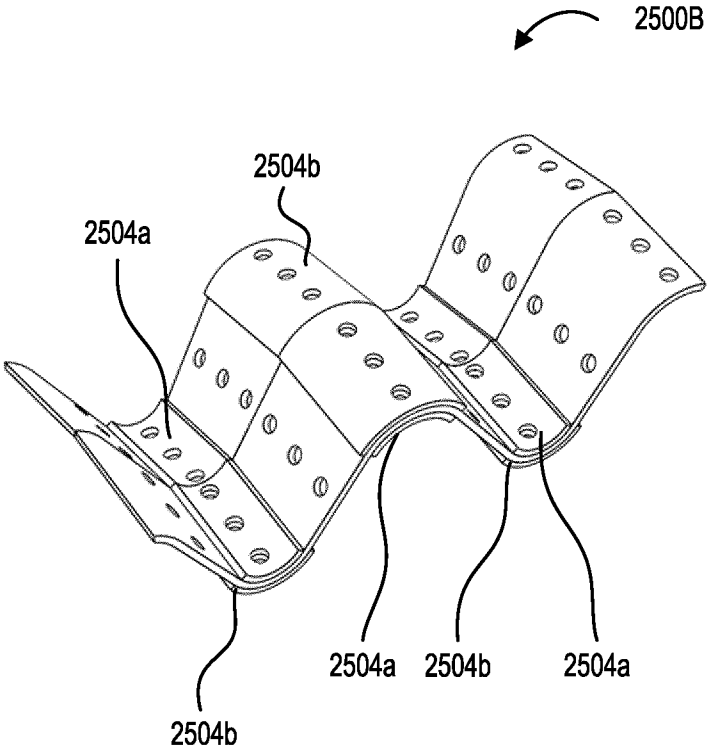
FIGS. 25A and 25B illustrate joiner plates having reinforcing elements affixed thereto, in accordance with embodiments of the present disclosure.
Figure 25A:
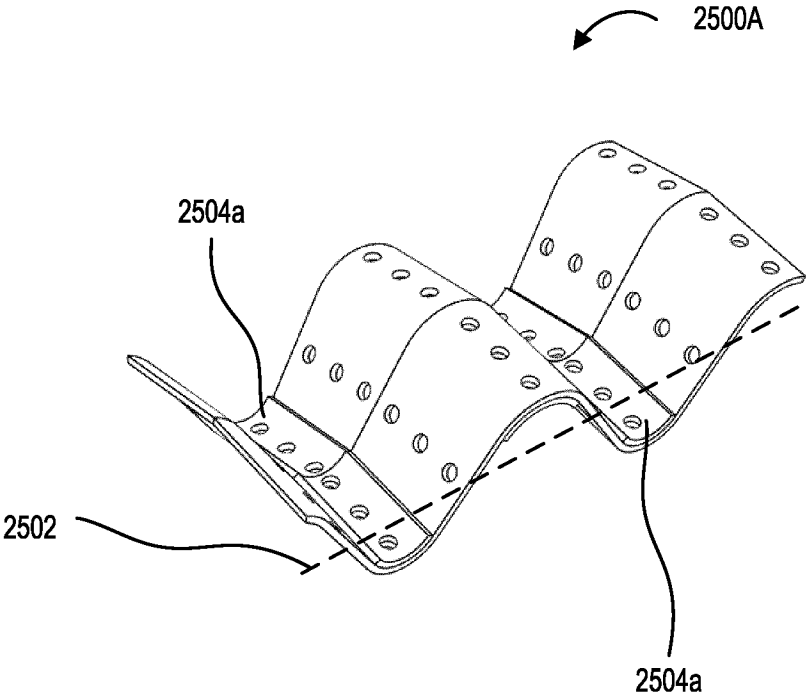

Bending moments or stresses on the joiner plates described herein may be about a neutral axis 2502, as illustrated in FIG. 25A. The bending moments or stresses may be caused, at least in part, by live loads (e.g., vehicles atop arch-shaped structures) or dead loads (e.g., backfill material). In some examples, the neutral axis 2502 may be located at a position that may be approximately half of the overall depth of the joiner plate corrugations. In an example, where joiner plate corrugations may have a depth of 9.5 inches, the neutral axis may be approximately 4.75 inches above a lowest position within a trough of the joiner plate corrugations. In some embodiments, the structural features for resisting bending moments or stresses may be positioned away from the neutral axis 2502.

In some embodiments, to reduce bending moments or stresses, the thickness of the joiner plate 2500 may be increased. In some scenarios, there may be an upper bound to the joiner plate thickness. As the joiner plate thickness increases, the likelihood that a joiner plate aperture may be misaligned with a structural plate aperture may increase. Other structural features for resisting bending moments or stresses may be included.

In some embodiments, to reduce bending moments or stresses, the joiner plate may include a lateral support member. The lateral support member may be bolted within a crest or a trough of a corrugation of the joiner plate. The lateral support member may be similar, for example, to the lateral support member 2190 illustrated in FIG. 21A.

In some embodiments, to reduce bending moments or stresses on the joiner plate 2500A, the joiner plate 2500A may include one or more reinforcement masses 2504*a* affixed at a position within a crest or a trough of a respective joiner corrugation. The one or more reinforcement masses 2504*a* may be positioned such that the respective reinforcement masses 2504*a* may be bolted, welded, or otherwise affixed at a position away from the neutral axis 2502 of bending moments on the joiner plate. In FIG. 25A, the one or more reinforcement masses 2504*a* may be positioned within a crest or within a trough of respective joiner corrugations. The positioning of the respective reinforcement masses 2504*a* in FIG. 25A is for illustration. When implemented, the positioning of the respective reinforcement masses 2504*a* may be positioned on a sole side (e.g., either outer or inner side) of the joiner plate 2500A, such that the joiner plate 2500A may be nested with corrugations of a structural plate. An illustration of a joiner plate having reinforcement masses on a sole side of the joiner plate will be shown in a subsequent drawing.

FIG. 25B illustrates the joiner plate 2500B including one or more reinforcement masses 2504*a* positioned within a crest or within a trough of respective corrugations and also on an opposing side of the respective crest or trough. Supplemental masses positioned on opposing sides of supplemental masses 2504*a* may be identified with reference numeral 2504*b*. When implemented, the positioning of the respective reinforcement masses (2504*a*, 2504*b*) may be positioned on a sole side (e.g., either outer or inner side) of the joiner plate 2500B, such that the joiner plate may be nested with corrugations of a structural plate. An illustration of a joiner plate having reinforcement masses on a sole side of the joiner plate will be shown in a subsequent drawing.

The example reinforcement masses described herein may be bolted to, welded to, or otherwise affixed to the joiner plate.

In some examples, the reinforcement masses may be constructed of metal. The reinforcement masses may be substantially the same material as the joiner plate or may be a different material as compared to the joiner plate.

Figure 26:
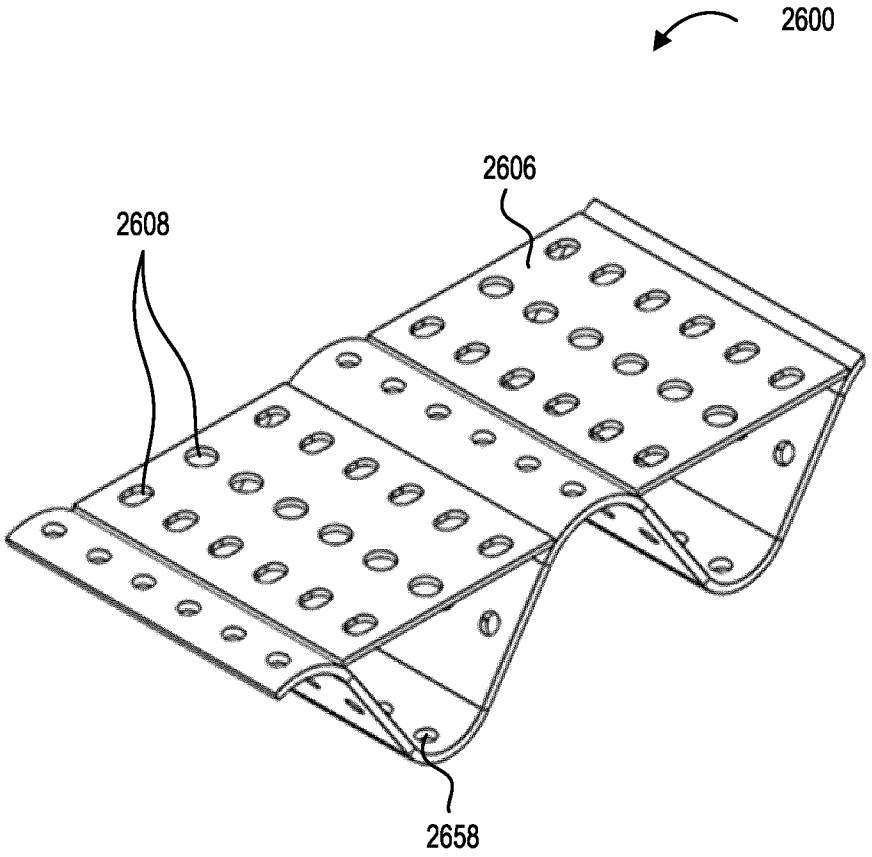
FIG. 26 illustrates a joiner plate having a reinforcing element, in accordance with an embodiment of the present disclosure.

FIG. 26 illustrates a joiner plate 2600 having a supplemental structural plate 2606 positioned substantially across peak points of adjacent crests or troughs of the joiner plate 2600, in accordance with an embodiment of the present disclosure. The supplemental structural plate 2606 may include a plurality of supplemental apertures 2608. The supplemental apertures 2608 may be clearance apertures having a diameter larger than a cross-sectional diameter of fastening bolts, such that fastening bolts may drop through the supplemental apertures 2608 and be received within a joiner aperture 2658. The fastening bolt may secure the joiner plate 2600 to a structural plate via the joiner aperture 2658.

As described in various embodiments of the present disclosure, a plurality of structural plates may be interconnected to produce box-shaped or arch-shaped structures. Respective structural plates may be interconnected with adjacent structural plates along one or more of the transverse edges or along one or more of the circumferential edges.

When a series of structural plates (respectively having a radius) are interconnected along respective transverse edges, a ring-shaped structure may be provided. It may be beneficial to interconnect structural plates along respective transverse edges in a non-overlapping arrangement thereby reducing the quantity of structural plate material that otherwise would be needed for a given circumferential length of the ring-shaped structure. Embodiments described herein may include joiner plates for interconnecting structural plates along transverse edges of respective structural plates. Interconnecting structural plates along transverse edges via joiner plates may reduce the quantity of required overlapping interconnections for producing a given arch-shaped structure.

In some scenarios, it may be beneficial to customize structural plates from a general or generic structural plates. Pre-manufacturing structural plates with pre-positioned apertures along transverse edges may require pre-manufacturing of numerous stock-keeping units (SKU) or structural plate versions. It may be beneficial to produce structural plates having an undefined circumferential length and to cut structural plates to desirable circumferential length as required for particular box-shaped structure infrastructure projects. Embodiments described herein include joiner plates that may interconnect custom-length structural plates, thereby reducing requirements to have numerous SKUs of pre-manufactured structural plates with pre-positioned transverse edge apertures.

Figure 27:
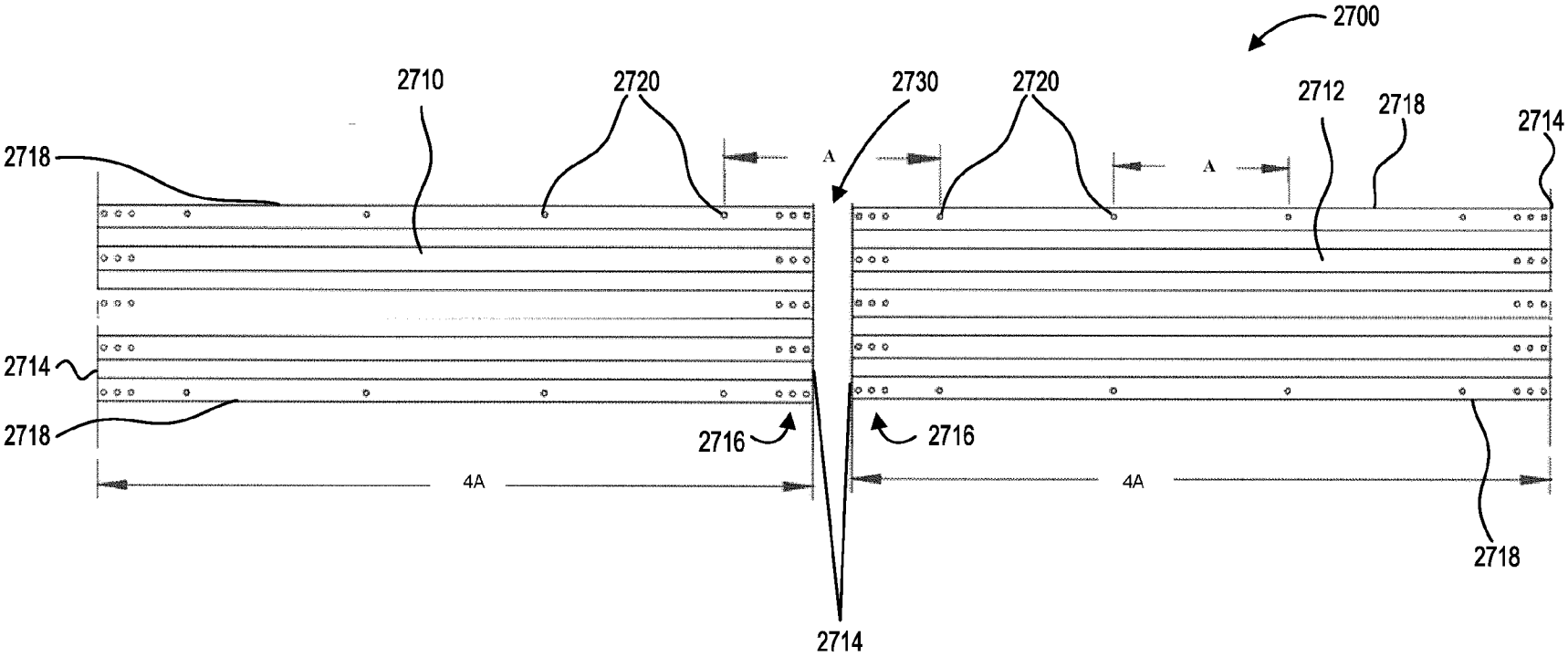
FIG. 27 illustrates a top plan view of a pair of structural plates, in accordance with embodiments of the present disclosure.

Reference is made to FIG. 27, which illustrates top plan view a pair of structural plates 2700, in accordance with embodiments of the present disclosure. The pair of structural plates 2700 may include a first structural plate 2710 and a second structural plate 2712. In some embodiments, the pair of structural plates 2700 may include plate corrugations.

The pair of structural plates 2700 may include transverse edges, generally identified as transverse edges 2714. The pair of structural plates 2700 may include circumferential edges, generally identified as circumferential edges 2718.

The respective transverse edges 2714 may include at least one plate aperture 2716 adjacent the respective transverse edges 2714. The respective circumferential edges 2718 may include at least one circumferential aperture 2720 adjacent the respective circumferential edges 2718. In some scenarios, circumferential apertures 2720 may be positioned along the respective circumferential edges 2718 at regularly spaced intervals. In FIG. 27, a series of respective circumferential apertures 2720 may be positioned a pre-defined distance from an adjacent circumferential aperture 2720. The first structural plate 2710 may be secured to an adjacent structural plate (not explicitly illustrated in FIG. 27) along respective circumferential edges via fasteners received within aligning circumferential apertures of the respective structural plates.

In some embodiments, it may be beneficial to maintain a recurring aperture-to-aperture spacing among circumferential apertures, such that the circumferential apertures of the first structural plate 2710 and the second structural plate 2712 may correspond to circumferential apertures of circumferential edges of adjacent structural plates. In FIG. 27, the aperture-to-aperture spacing among circumferential apertures of a structural plate may be the pre-defined distance (illustrated in FIG. 27 as distance value "A"). A spectrum of aperture-to-aperture spacing distance values may be contemplated. In some embodiments, a given aperture-to-aperture spacing distance value may be chosen from a range from several hundred millimeters to thousands of millimeters.

In some embodiments, the first structural plate 2710 and the second structural plate 2712 may be positioned in a non-overlapping arrangement at respective transverse edges 2714. To maintain a recurring aperture-to-aperture spacing among the circumferential apertures, the first structural plate 2710 may be positioned relative to the second structural plate 2712 at respective transverse edges 2714 in a non-overlapping arrangement, such that the recurring aperture-to-aperture spacing between the pair of structural plates 2700 corresponds to the recurring aperture-to-aperture spacing distance value among circumferential apertures of the first structural plate 2710 and the second structural plate 2712. Embodiments of a joiner plate disclosed herein may secure the pair of structural plates 2700 in the non-overlapping arrangement at the respective transverse edges 2714.

In FIG. 27, to maintain the recurring aperture-to-aperture spacing distance value, the first structural plate 2710 and the second structural plate 2712 may be positioned such that a transverse gap 2730 may be between transverse edges 2714 of the structural plates. For instance, the non-overlapping arrangement among the first structural plate 2710 and the second structural plate 2712 may include the transverse gap 2730. One or more embodiments of joiner plates disclosed herein (not explicitly illustrated in FIG. 27) may secure the pair of structural plates 2700 at the respective transverse ends 2714. Securing the pair of structural plates 2700 in non-overlapping arrangement may be across the transverse gap 2730 and using fasteners received within aligned: (i) joiner plate apertures; and (ii) plate apertures 2716 adjacent the respective transverse edges 2714.

As embodiments of joiner plates may secure the pair of structural plates 2700 at respective transverse edges 2714 for producing elongate structures (e.g., ring-shaped structures when the respective structural plates have a radius), structural plates may be configured (e.g., cut to length, etc.) near a construction site and need not be pre-configured at an early, up-stream manufacturing facility. As structural plates 2700 or series of structural plates may be secured in a non-overlapping arrangement along respective transverse edges 2714, the quantity of structural plate material for producing a given elongate structure length (e.g., given ring-shaped structure length) may be less than otherwise would be required if respective transverse edges 2714 were secured in an overlapping arrangement. Features illustrated in FIG. 27 may not be to scale, and are for ease of exposition only.

Figure 28:
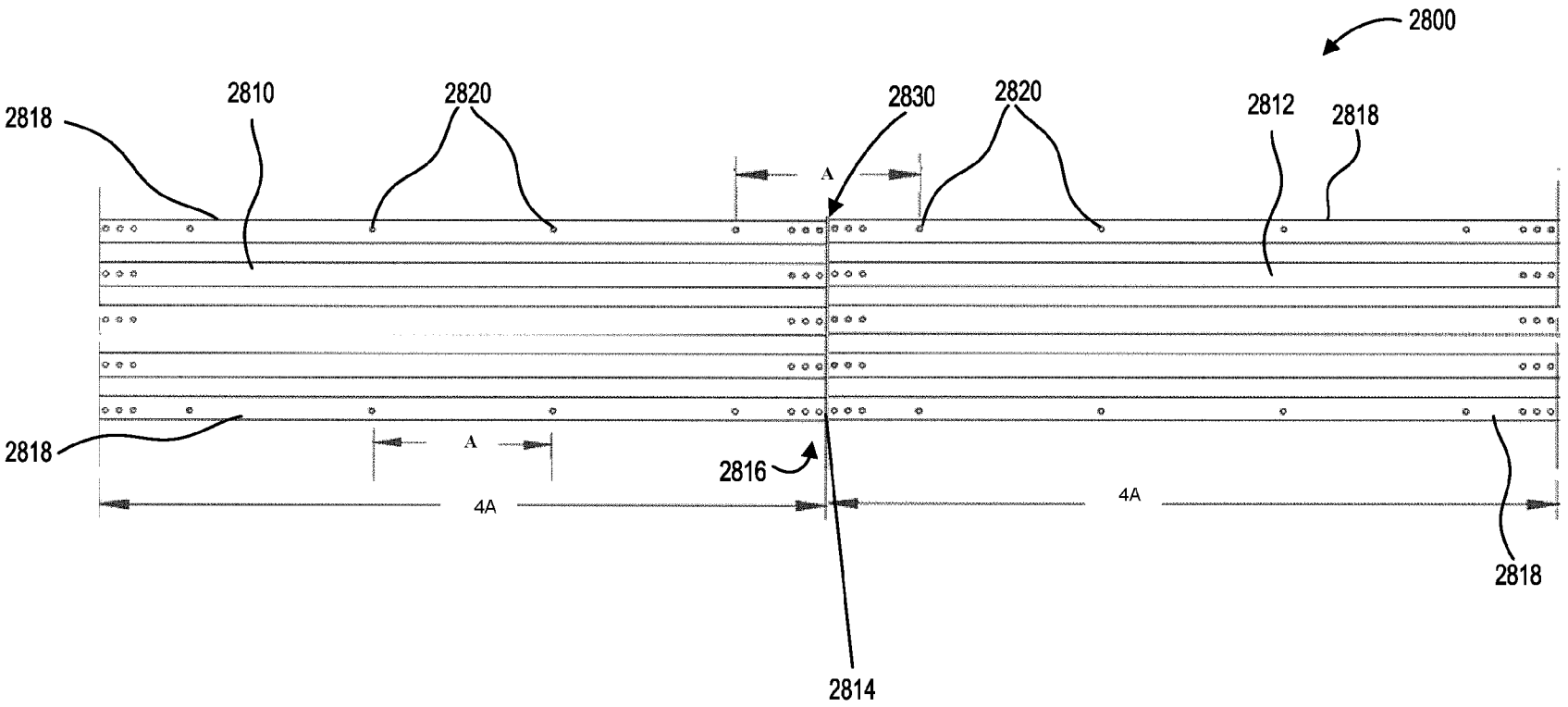
FIG. 28 illustrates a top plan view of a pair of structural plates, in accordance with embodiments of the present disclosure.

Reference is made to FIG. 28, which illustrates a top plan view of a pair of structural plates 2800, in accordance with embodiments of the present disclosure. The pair of structural plates 2800 may include a first structural plate 2810 and a second structural plate 2812. In some embodiments, the pair of structural plates 2800 may include plate corrugations.

The pair of structural plates 2800 may include transverse ends, generally identified as transverse edges 2814. The pair of structural plates 2800 may include circumferential ends, generally identified as circumferential edges 2818. The respective transverse edges 2814 may include at least one plate aperture 2816 adjacent the respective transverse edges 2814. The respective circumferential edges 2818 may include at least one circumferential aperture 2820 adjacent the respective circumferential edges 2818. In some scenarios, circumferential apertures 2820 may be positioned along the respective circumferential edges 2818 at regularly spaced intervals (e.g., identified as distance value "A" in FIG. 28 for ease of exposition). In some scenarios, the first structural plate 2810 may be secured to an adjacent structural plate (not illustrated in FIG. 28) along respective circumferential edges via fasteners received within aligning circumferential apertures of the respective structural plates.

In the example in FIG. 28, to maintain the recurring aperture-to-aperture spacing among circumferential apertures, the first structural plate 2710 and the second structural plate 2812 may be positioned in a non-overlapping, abutting arrangement at respective transverse edges 2814. In the present example, the non-overlapping arrangement of the first structural plate 2810 and the second structural plate 2812 may include an abutment 2830 at the respective transverse edges 2814.

One or more embodiments of joiner plates disclosed herein may be configured to secure the pair of structural plates 2800 at the respective transverse edges 2814 based on fasteners received within the at least one plate apertures 2816 and corresponding joiner aperture (not explicitly illustrated) of a joiner plate. By securing the structural plates along transverse edges 2814 in a non-overlapping arrangement using a joiner plate, elongate structures (e.g., ring-shaped structures when the respective structural plates have a radius, etc.) may be constructed with less quantity of structural plate material than otherwise would be required if respective transverse edges 2814 were secured in an overlapping arrangement. Further, in some scenarios, the joiner plate may be configured to secure the pair of structural plates 2800 to maintain a recurring aperture-to-aperture spacing among circumferential apertures nearest the transverse edges 2814 of the respective structural plates.

In some scenarios, structural plates in a non-overlapping arrangement may be abutting at transverse edges. In the example scenarios where structural plates may substantially abut at transverse edges, the abutting transverse edges may assist with transferring thrust loads from one structural plate to another structural plate.

When a series of structural plates respectively having a radius are interconnected along circumferential edges, a longitudinal length of a box-shaped or arch-shaped structure may be extended. For example, interconnecting a series of structural plates along circumferential edges may build-out a box-shaped or an arch-shaped structure (e.g., an underpass tunnel) in a longitudinal direction. In some embodiments, a circumferential edge of a first structural plate may be secured to a circumferential edge of an adjacent structural plate in an overlapping arrangement. In some embodiments, apertures along the respective circumferential edges may substantially overlap and fasteners may be received within the overlapping apertures for securing the structural plates along respective circumferential edges.

In some scenarios, one or more structural plates for producing the arch-shaped structure may have a radius. The structural plates may be curved, such that a combination of structural plates having a radius may produce a box-shaped or arch-shaped structure extending in a longitudinal direction. As structural plates may have a defined thickness and as the structural plates may have a radius, when apertures along a circumferential edge of a first structural plate are positioned to overlap apertures along circumferential edge of an adjacent structural plate, at least a subset of the overlapping apertures may not substantially align thereby making it challenging to insert fasteners within the respective overlapping apertures.

Figure 29:
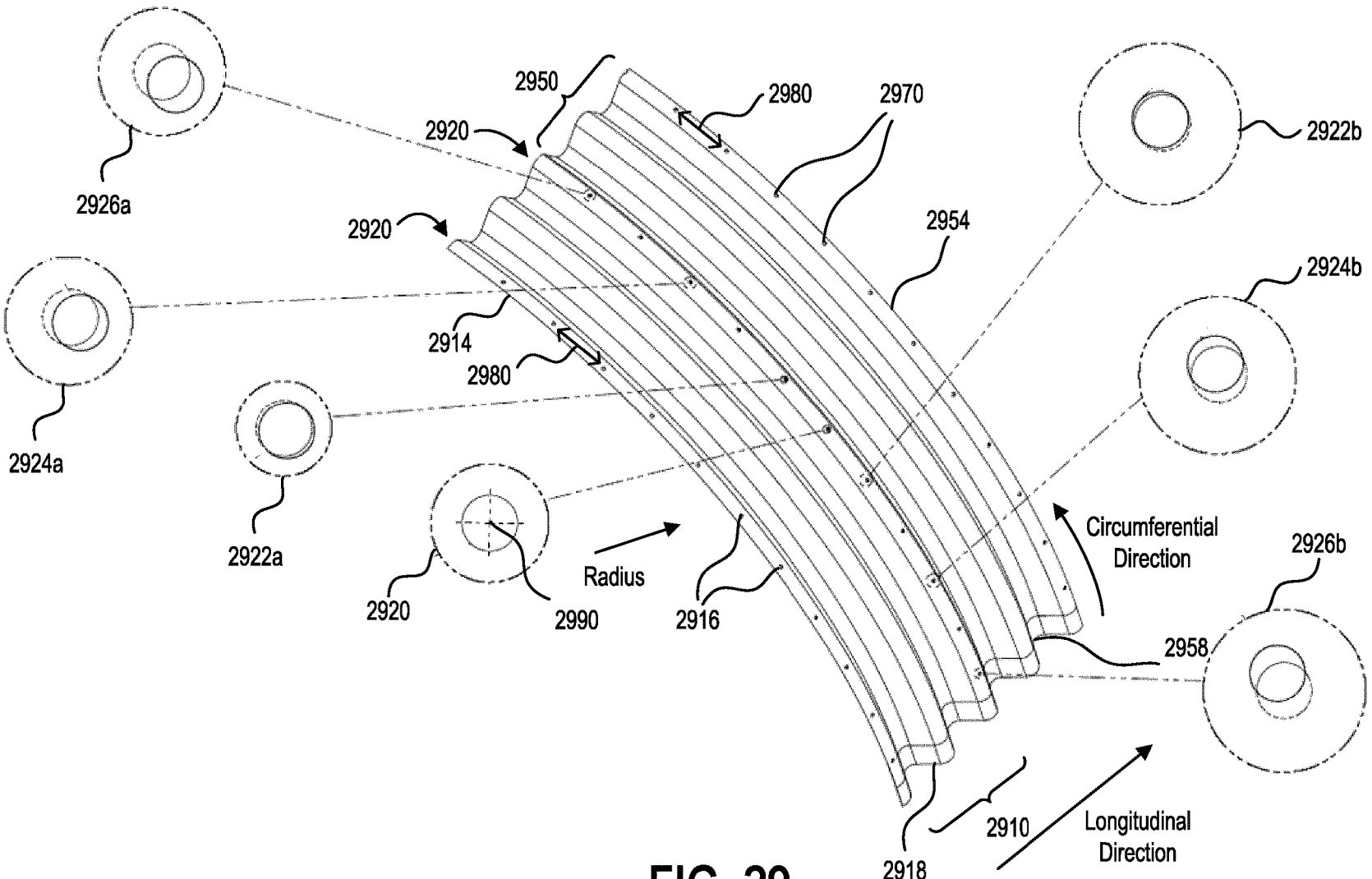
FIG. 29 illustrates a first structural plate and an adjacent structural plate positioned to be interconnected along respective circumferential edges, in accordance with embodiments of the present disclosure.

Reference is made to FIG. 29, which illustrates a first structural plate 2910 and an adjacent structural plate 2950 positioned to be interconnected along respective circumferential edges via circumferential apertures, in accordance with an embodiment of the present disclosure.

In the example illustrated in FIG. 29, the first structural plate 2910 and the adjacent structural plate 2950 may have a substantially similar radius (e.g., curvature along the circumferential direction). The first structural plate 2910 may have opposing circumferential edges 2914 and a plurality of circumferential apertures 2916 adjacent the circumferential edges 2914.

The adjacent structural plate 2950 may also include opposing circumferential edges 2954 and a plurality of circumferential apertures 2970 adjacent the circumferential edges 2954. To illustrate at least one above-described challenge related to misaligned apertures, in FIG. 29, circumferential apertures 2916 of the first structural plate 2910 and circumferential apertures 2970 of the adjacent structural plate 2950 may have a substantially similar aperture-to-aperture distance value 2980. The first structural plate 2910 may be substantially similar to the adjacent structural plate 2950, and may have substantially similar physical features thereon.

For ease of exposition, an illustration of an aperture-to-aperture distance value 2980 is illustrated with respect to the adjacent structural plate 2950. The aperture-to-aperture distance 2980 may be a distance measure between any two adjacent apertures along circumferential edges.

During interconnection of the pair of structural plates, a technician may align a circumferential aperture of the first structural plate 2910 and a circumferential aperture of the adjacent structural plate 2950 as a starting point to provide an initial circumferential aperture set 2920. For ease of exposition, an enlarged, top plan view of example overlapping circumferential apertures may be identified as an initial circumferential aperture set 2920. Circumferential apertures may be substantially aligned when a centroid 2990 of the respective circumferential apertures are substantially aligned. In some examples, a centroid may be the arithmetic mean position of all points of a polygon of plate figure.

As the circumferential apertures of the initial circumferential aperture set 2920 may be substantially aligned, a fastener (e.g., bolt, etc.) may be received within the initial circumferential aperture set 2920 for interconnecting the pair of structural plates. In the present example, the initial circumferential aperture set 2920 corresponds to circumferential apertures approximately mid-way between transverse edges (2918, 2958) of the respective structural plates; however, the initial circumferential aperture set 2920 may correspond to any other circumferential apertures along a circumferential edge (2914, 2954).

FIG. 29 illustrates further enlarged, top plan views of overlapping apertures identified as adjacent circumferential aperture sets. For example, on opposing sides of the initial circumferential aperture set 2920 along respective circumferential edges, a second circumferential aperture set (identified with reference numeral 2922*a* and 2922*b*) is illustrated. Further along the respective circumferential edges, a third circumferential aperture set (identified with reference numerals 2924*a* and 2924*b*) and a fourth circumferential aperture set (identified with reference numerals 2926*a* and 2926*b*) are illustrated.

As a distance along respective circumferential edges increases from the initial circumferential aperture set 2920, misalignment of corresponding circumferential apertures of the first structural plate 2910 and the adjacent structural plate 2950 may increase. For example, in FIG. 29, a relatively small misalignment may manifest at the second circumferential aperture set (2922*a*, 2922*b*). Additional increasing misalignment may manifest at the third circumferential aperture set (2924*a*, 2924*b*). A further increasing misalignment may manifest at the fourth circumferential aperture set (2926*a*, 2926*b*). In some scenarios, the magnitude of misalignment of circumferential apertures may be a function of at least one of structural plate thickness and a radius of the structural plate. The radius of the structural plate may be associated with the degree of curvature of the structural plate.

In some scenarios, it may not be feasible to insert a suitable fastener within overlapping circumferential apertures at the fourth circumferential aperture set (2926*a*, 2926*b*) or the third circumferential aperture set (2924*a*, 2924*b*). When overlapping circumferential apertures do not substantially align, in some scenarios, technicians may attempt to ream or widen apertures using drilling tools, thereby altering the structural integrity of the respective plates. In some other scenarios, technicians may attempt to insert fasteners that may be inappropriately sized (e.g., small bolt diameter) into the misaligned apertures. Utilizing fasteners that may be inappropriately sized may alter integrity of the interconnection at the circumferential edges thereby deviating from a design specification associated with interconnection strength at the overlapped circumferential edges. For example, fasteners that may be inappropriately sized may not be suitable for withstanding shear forces expected to be experienced at the fastener. It may be beneficial to provide structural plates to include features to provide aligning circumferential apertures along circumferential edges of adjacent structural plates.

Figure 30:
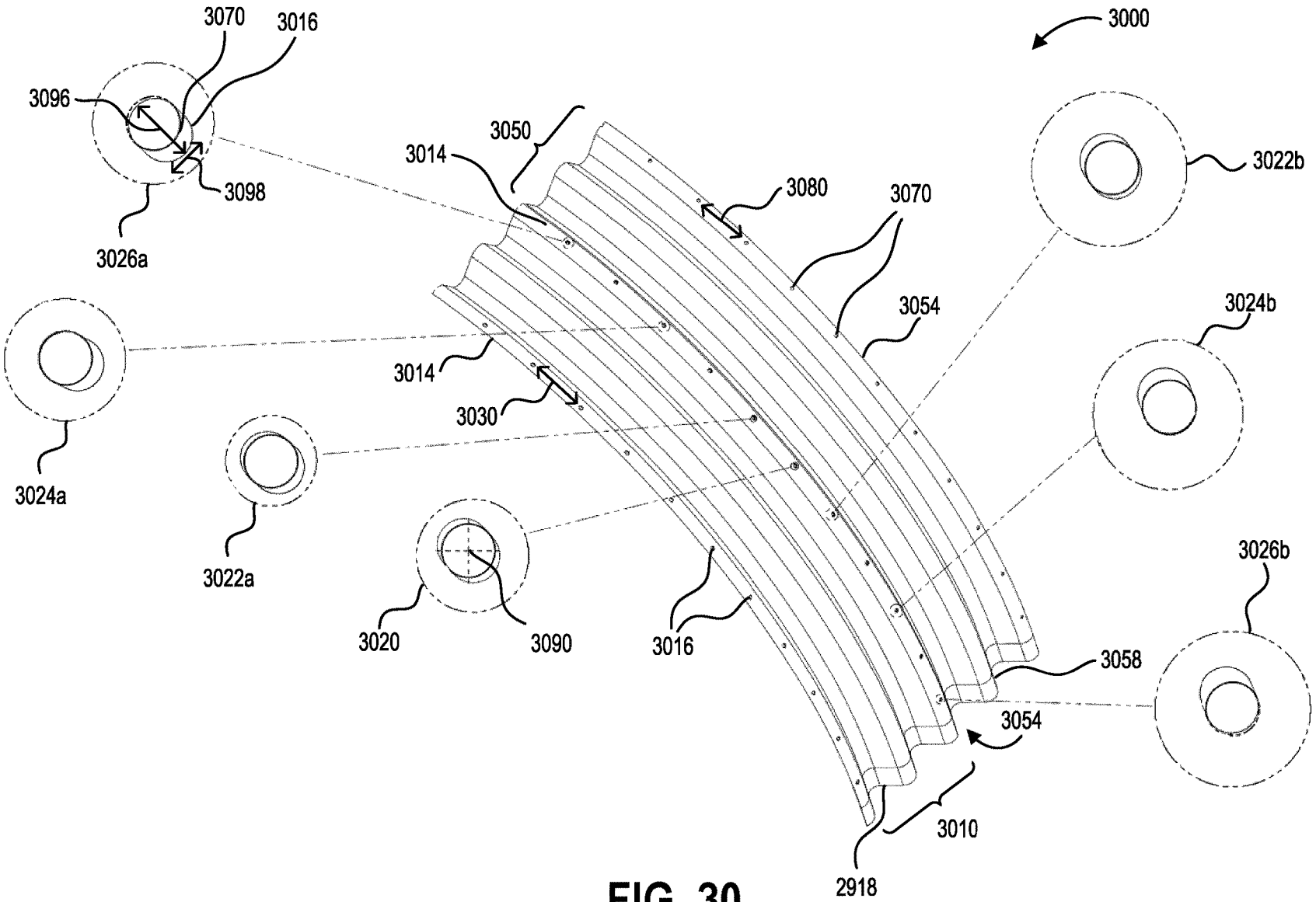
FIG. 30 illustrates a first structural plate and an adjacent structural plate positioned to be interconnected, in accordance with embodiments of the present disclosure.

Reference is made to FIG. 30, which illustrates a first structural plate 3010 and an adjacent structural plate 3050 positioned to be interconnected along respective circumferential edges via circumferential apertures, in accordance with an embodiments of the present disclosure. The first structural plate 3010 and the adjacent structural plate 3050 may have a substantially similar radius (e.g., curvature along the circumferential direction). The first structural plate 3010 may have opposing circumferential edges 3014 and a plurality of circumferential apertures 3016 adjacent the respective circumferential edges 3014.

In some embodiments, the plurality of circumferential apertures 3016 of the first structural plate 3010 may be slotted apertures. In some embodiments, the slotted aperture may be produced by elongating a circular aperture. In some embodiments, the slotted aperture may be an oval-shaped aperture. For ease of exposition, a slotted aperture may include a slot width 3096 and slot length 3098. The slotted aperture may circumscribe a void that may receive a fastener. As a non-limiting example, the slotted aperture may include a slot length 3098 that may be approximately 25 percent larger than a slot width 3096. In some embodiments, the slot width 3096 may be substantially similar as a round-holed aperture 3070. Other ratios or relations among the slot length 3098 and the slot width 3096 may be contemplated.

The adjacent structural plate 3050 may also have opposing circumferential edges 3054 and a plurality of circumferential apertures 3070. The plurality of circumferential apertures 3070 may be positioned on both of the opposing circumferential edges 3054.

In embodiments where the plurality of circumferential apertures 3016 of the first structural plate 3010 may be slotted apertures (described above), the plurality of circumferential apertures 3070 of the second structural plate 3050 may be substantially round-holed apertures. In some embodiments, the substantially round-holed apertures may have a diameter sized to be substantially equal to a slot width 3098 dimension of the slotted apertures of the first structural plate 3010.

The example in FIG. 30 includes the first structural plate 3010 having slotted apertures and the second structural plate 3050 having substantially round-holed apertures. In some other embodiments, the first structural plate 3010 may have substantially round-holed apertures and the second structural plate 3050 may have slotted apertures.

As will be described, when the plurality of circumferential apertures 3070 of the adjacent structural plate 3050 may differ in shape as compared to the shape of the plurality of circumferential apertures 3016 of the first structural plate 3010, positioning the first structural plate 3010 in an overlap arrangement with the second structural plate 3050 at corresponding circumferential edges may result in desirable overlapping alignment of circumferential apertures (3016, 3070) of the plurality of overlapping circumferential apertures (3016, 3070) along a substantial portion of the overlapping circumferential edges. In some examples, desirable overlapping alignment of circumferential apertures may allow suitable fasteners to be received therein.

It may appreciated that only enlarging circumferential apertures to be physically larger (e.g., longer, wider, etc.) may in some embodiments assist with addressing misalignment of overlapping apertures of overlapping circumferential edges. However, enlarging circumferential apertures may reduce the structural integrity of circumferential edges (or structural plates). It may be beneficial to provide adjacent structural plates having circumferential aperture features for providing suitably aligned circumferential apertures for a range of structural plate radii. As described herein, circumferential aperture features may include an aperture-to-aperture space distance value associated with structural plates, aperture shape/dimension, among other examples.

Providing structural plates with circumferential aperture features that may provide desirable overlapping alignment of circumferential apertures (when edges are overlapped) for a range of structural plate radii may reduce the number of structural plate versions or SKUs for supporting infrastructure projects having box-shaped structures.

In some embodiments, the structural plate radii range may span 30 meters or more. For example, the structural plate may be radiused based on a radius value within a range of 30 or more meters and may benefit from the circumferential features disclosed herein. To illustrate, the box culvert archway illustrated in FIG. 5 may include a plurality of adjacent structural plates having varying radii. Embodiments of structural plates described herein having circumferential aperture features may be radiused near the construction site for supporting the structural plate requirements having varying radii. In some example, radiusing a structural plate may include imparting a curvature to the structural plate, such that the structural plate may have a particular radius if bent into a circle. For example, a bend radius may be a measure of an inside curvature of a structural plate, and radiusing a structural plate may include curving or otherwise bending the structural plate to provide an inside curvature with a particular target radius. As only one or two structural plate SKUs having the circumferential aperture features disclosed herein may be required, features disclosed herein may reduce the requirement to maintain multiple structural plate versions or SKUs for supporting a given infrastructure project.

In some embodiments, the structural plates may include aperture-to-aperture spacing features contributing to desirable overlapping alignment of circumferential apertures (3016, 3070). In particular, the aperture-to-aperture spacing distance of circumferential apertures of the first structural plate 3010 may be greater than the aperture spacing distance of circumferential apertures of the adjacent structural plate 3050 by a margin value. As a non-limiting example, if the aperture-to-aperture spacing distance associated with the adjacent structural plate 3050 is a pre-defined dimension "A", the aperture-to-aperture spacing distance associated with the first structural plate 3010 may be a pre-defined dimension "A" plus a margin value. In some examples, the margin value may be a percentage or a fraction of the pre-defined dimension. For illustration, the margin value may be on the order of or less than 1 percent of the pre-defined dimension "A". In some embodiments, the margin value may be on the order of or less than 0.5 percent of the pre-defined dimension "A". In some embodiments, the margin value may be approximately 0.2 percent of the pre-defined dimension "A". In some embodiments, the margin value may be a percentage of the aperture-to-aperture spacing associated with any one of the structural plates being interconnected. Other magnitudes or values of different aperture-to-aperture spacing distance values may be contemplated.

In some scenarios, a range of pre-manufactured structural plate versions each having a specific structural plate thickness and structural plate radii may respectively be optimized for a circumferential aperture-to-aperture spacing distance value such that interconnecting the respective structural plates along circumferential edges would result in alignment of circumferential apertures. However, it may be appreciated that maintaining the numerous quantity and range of pre-manufactured structural plate versions may not be beneficial and may result in discarded structural plate material when structural plates may need to be cut to size. Embodiments of structural plates having circumferential aperture features disclosed herein and embodiments of joiner plates herein may address one or more challenges disclosed throughout the present disclosure.

Referring still to FIG. 30, the circumferential apertures 3016 of the first structural plate 3010 may have a defined first aperture-to-aperture spacing distance 3030 between pairs of adjacent circumferential apertures 3016. Further, the circumferential apertures 3070 of the second structural plate 3050 may have a defined second aperture-to-aperture spacing 3080 between pairs of adjacent circumferential apertures 3070. In some embodiments, the defined first aperture-to-aperture spacing distance 3030 may be greater than the second aperture-to-aperture spacing distance 3080 among pairs of adjacent circumferential apertures (3016, 3070) of the respective structural plates (3010, 3050). Rather than maintaining numerous pre-manufactured structural plate versions each having specific structural plate radii and thickness, the above-described features may promulgate fewer versions of structural plates for supporting a wide range of structural plate requirements, which may be customized at a point in time that may be nearer to assembly of structural plates at an infrastructure project site In embodiments of the present disclosure, fewer versions of structural plates for supporting a wide range of structural plate requirements (e.g., a range of structural plate radii, structural plate circumferential length, among other examples) while achieving desirable overlapping alignment of circumferential apertures along overlapping circumferential edges may be provided by a combination of features including: (i) a difference in circumferential aperture shape among the first structural plate 3010 and the second structural plate 3050; and (ii) a difference in aperture-to-aperture spacing distance among the first structural plate 3010 and the second structural plate 3050.

FIG. 30 illustrates an enlarged top plan view of example overlapping circumferential apertures may be identified as an initial circumferential aperture set 3020. In the present example, the initial circumferential aperture set 3020 may be chosen as a reference point that may be approximately mid-way between transverse edges 3018 of the first structural plate 3010 and transverse edges 3058 of the second structural plate 3058, respectively. Other overlapping circumferential apertures may be chosen as an initial circumferential aperture set 3020, and the example chosen in FIG. 30 is for ease of exposition.

As the initial circumferential aperture set 3020 may be substantially aligned about a centroid 3090 of the respective circumferential apertures, a fastener (e.g., bolt, etc.) may be received within the initial circumferential aperture set 3020 for securing and interconnecting the pair of structural plates.

FIG. 30 illustrates further enlarged, top plan views of overlapping apertures identified as adjacent circumferential aperture sets. For example, on opposing sides of the initial circumferential aperture set 3020 along respective circumferential edges, a second circumferential aperture set (identified with reference numerals 3022*a*, 3022*b* is illustrated. Further along the respective circumferential edges, a third circumferential aperture set (identified with reference numerals 3024*a* and 3024*b*) and a fourth circumferential aperture set (identified with reference numerals 3026*a* and 3026*b*).

For circumferential apertures positioned away from the initial circumferential aperture set 3020, features of embodiments described in the present disclosure may provide desirable overlapping arrangement of circumferential edges such that overlapping apertures may receive fasteners sized at least for a circular aperture (of the adjacent structural plate 3050) having a diameter substantially equal to a width dimension of the slotted aperture (of the first structural plate 3010).

In some embodiments, when a centroid of a circumferential aperture 3016 of the first structural plate 3010 is misaligned with a centroid of a circumferential aperture 3070 of the adjacent structural plate 3050, an area circumscribed by the circumferential aperture 3070 of the adjacent structural plate 3050 may nonetheless substantially overlap a portion of an area circumscribed by the circumferential aperture 3016 of the first structural plate 3010. The substantial overlap of the respective areas circumscribed by the circumferential apertures may allow for fasteners to be received therein.

As an example, the fourth circumferential aperture set 3026*a* in FIG. 30 may illustrate. Despite misalignment of respective centroids of a circumferential aperture 3016 of the first structural plate 3010 relative to a circumferential aperture 3070 of the second structural plate 3070, the overlapping arrangement at the respective circumferential edges may allow a fastener sized at least for the circumferential aperture 3070 of the second structural plate 3070 to be received within the overlapping arrangement.

Based at least on the above described examples, embodiments of structural plates disclosed herein may include structural plates having features to address scenarios where centroids of circumferential apertures of pairs of structural plates are misaligned, while maximizing structural integrity of the respective circumferential edges. Although circumferential apertures may be reamed or widened using drilling tools or may be substantially enlarged in size to accommodate misaligned centroids of overlapping circumferential apertures, it may be beneficial to provide features that minimize circumferential aperture size, while accommodating misalignment of centroids associated with respective circumferential apertures.

Various embodiments of structural plates may include a combination of: (i) an outer structural plate (e.g., first structural plate 3010) having adjacent circumferential apertures respectively spaced nominally greater than adjacent circumferential apertures of an inner structural plate (e.g., adjacent structural plate 3050); and (ii) the outer structural plate having nominally enlarged circumferential apertures (as compared to circumferential apertures of the inner structural plate) such that the embodiment structural plates may be radiused to a variety of different radii while achieving desirable overlapping alignment of apertures along overlapping circumferential edges for receiving fasteners therein. Reducing the number of pre-manufactured structural plate versions or SKUs for specific radii, plate length, among other features reduces complicated inventory/supply chain management, thereby simplifying infrastructure projects.

In some embodiments, a desirable overlapping alignment may include: (a) overlapping apertures having aligned centroids; or (b) where overlapping apertures may not have aligned centroids, overlapping apertures having a portion of an area circumscribed by the aperture substantially overlap with at least a portion of an area circumscribed by an overlapping aperture.

As disclosed herein, structural plates may be interconnected for assembling structures, such as arch-shaped structures. In some embodiments, structural plates may be corrugated plates. The structural plates may include transverse edges and circumferential edges. Adjacent structural plates may be secured in an overlapping arrangement at circumferential edges based on structural plate features described in the present disclosure.

Adjacent structural plates may be secured in a non-overlapping arrangement at transverse edges via embodiments of joiner plates described herein. In some embodiment joiner plates described above, joiner plates may include a first circumferential joiner edge configured to overlap a circumferential plate edge of a structural plate and a second circumferential joiner edge that may be configured to be positioned at least partially within a trough of a corrugated metal plate. Such embodiments of joiner plates may be beneficial when structural plates may be interconnected along respective circumferential edges by a shingled pattern.

Joining structural plates in a "shingled" configuration may be illustrated with reference to FIG. 9, where structural plates of a series of interconnected structural plates may be configured to: (i) have one circumferential edge be overlapped by an adjacent structural plate; and (ii) have the other opposing circumferential edge overlap a circumferential edge of another adjacent structural plate. For ease of exposition, FIG. 9 illustrates adjacent structural plates with varying greyscale shading to highlight the overlap or "underlap" of respective circumferential edges.

Figure 31:
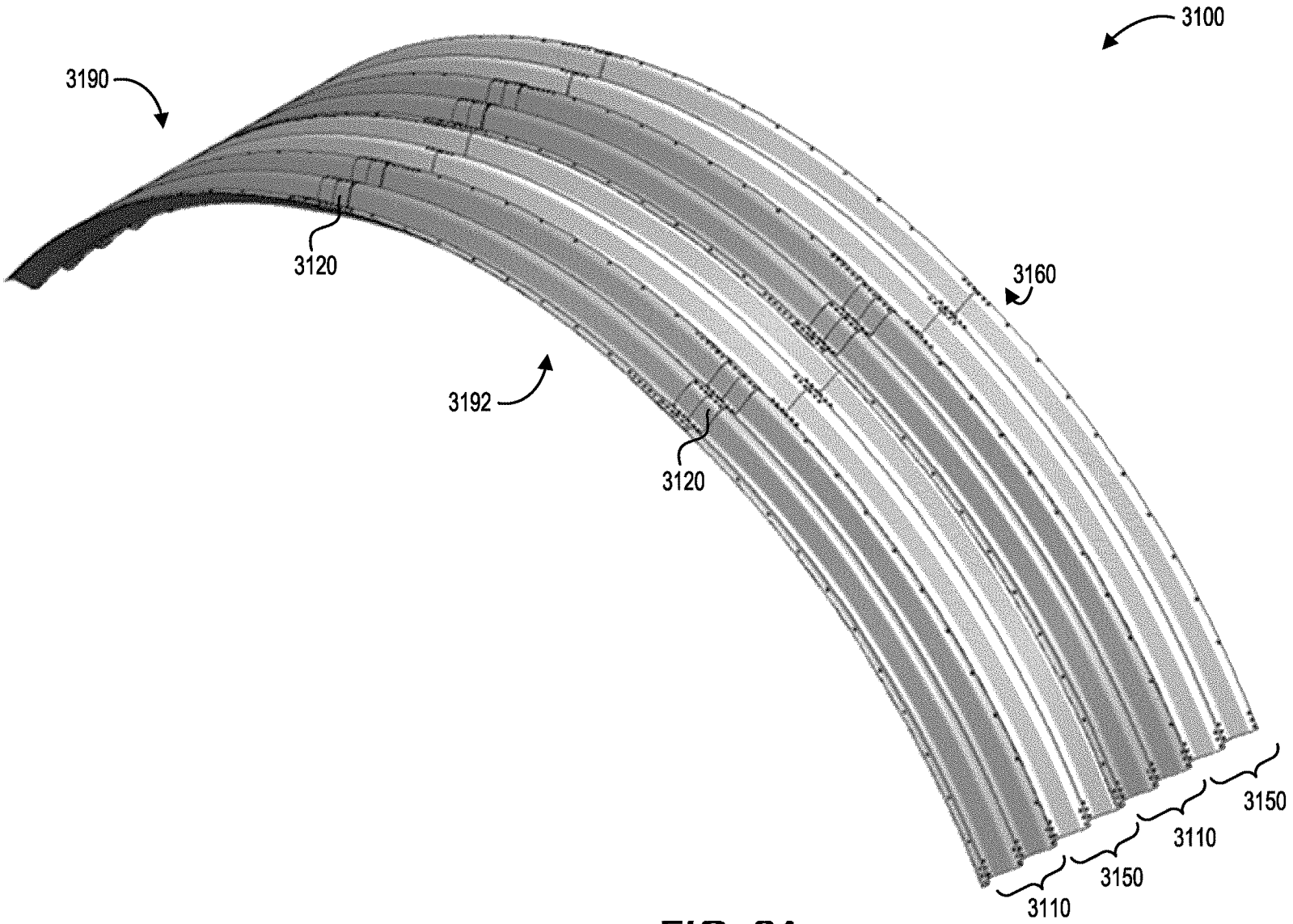
FIG. 31 is a front perspective view of a box-shaped structure, in accordance with embodiments of the present disclosure.
Figure 32:
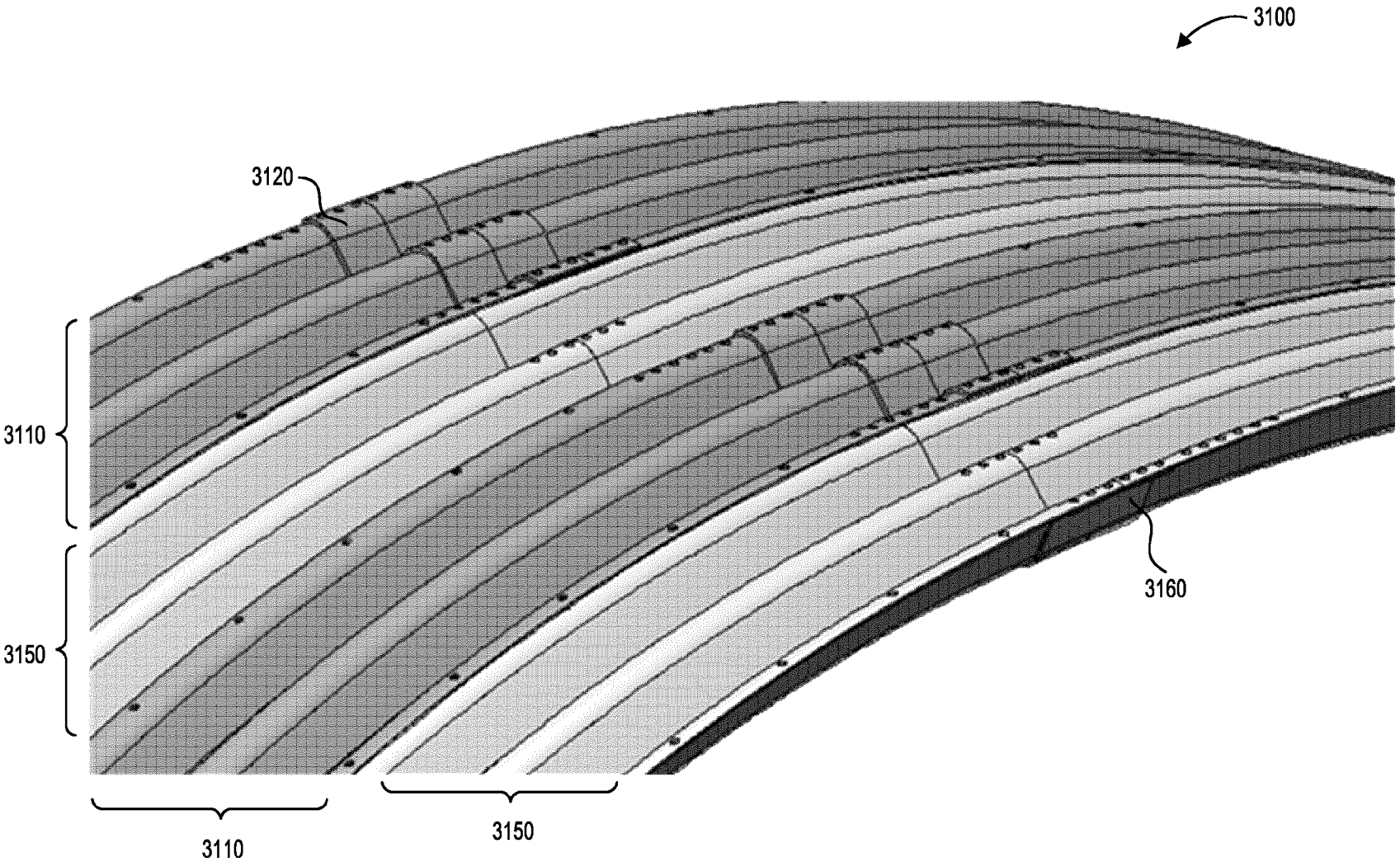
FIG. 32 illustrates an enlarged, rear perspective view of the box-shaped structure of FIG. 31.
Figure 33:
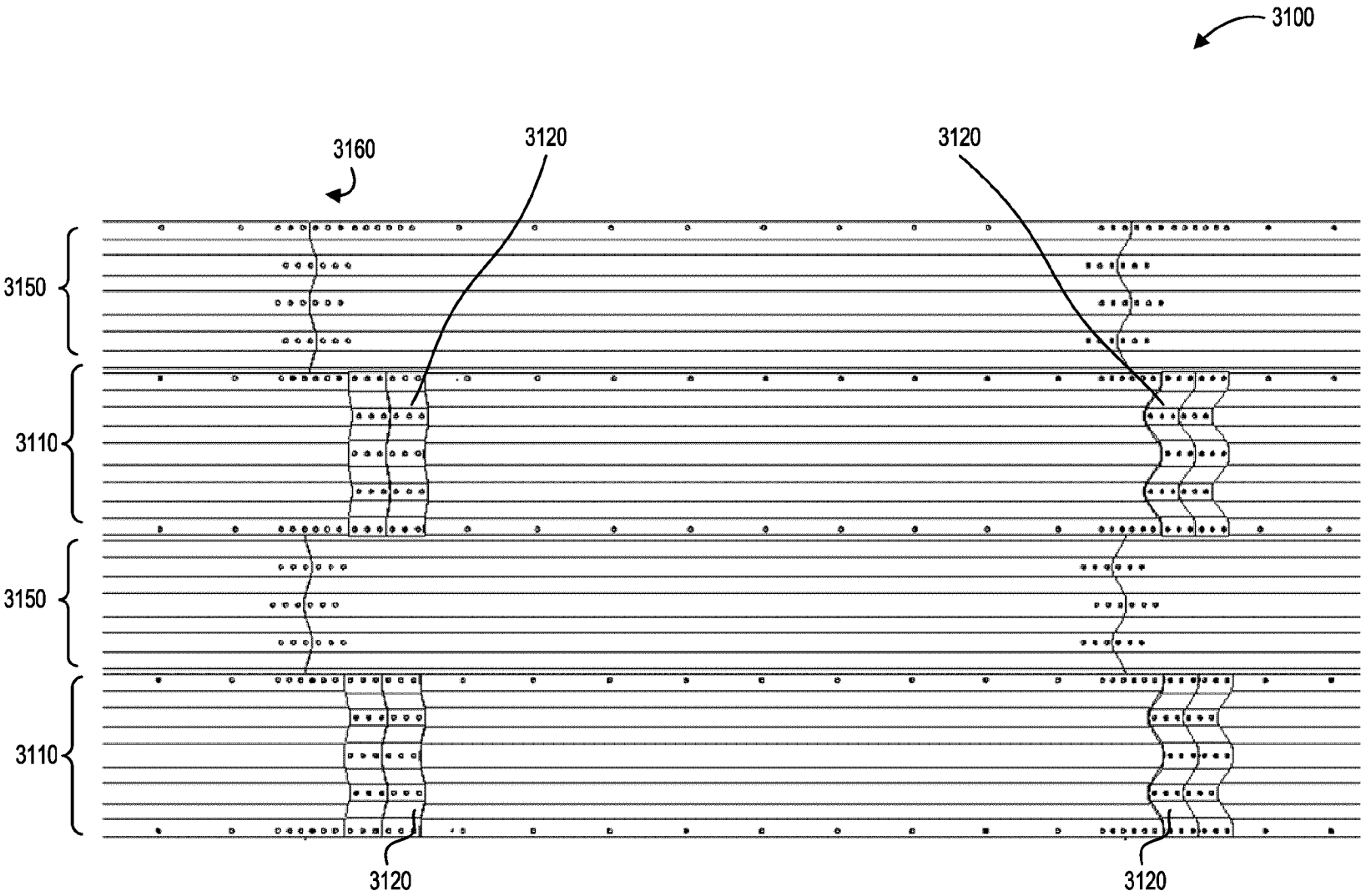
FIG. 33 illustrates a top plan view of the box-shaped structure of FIG. 31.

In some other embodiments described herein, it may be beneficial to interconnect structural plates based on the "over-under" structural plate configuration described in the present disclosure. With "over-under" structural plate configurations, some embodiments of joiner plates may include opposing circumferential joiner edges configured to overlap corresponding opposing circumferential plate edges of structural plates being interconnected. Reference is made to FIGS. 31, 32, and 33, which illustrate interconnected structural plates in an "over-under" structural plate configuration, in accordance with embodiments of the present disclosure.

FIG. 31 is a front perspective view of a box-shaped or arch-shaped structure 3100. The arch-shaped structure 3100 may include a plurality of alternating "over" structural plates 3110 and "under" structural plates 3150. Circumferential structural plate edges of the "over" structural plates may be positioned and secured in overlapping arrangement with circumferential plate edges of the "under" structural plates. Fasteners, such as bolts, may be received within aligned circumferential apertures of the "over" structural plates and the "under" structural plates.

In the embodiment illustrated in FIG. 31, the "over" structural plates 3110 may have an aperture-to-aperture distance between respective adjacent pairs of apertures that is greater than that of the "under" structural plates 3110. Further, the "over" structural plates 3110 may include apertures that may be slotted apertures, and the "under" structural plates 3150 may include apertures that may be round apertures. The round apertures may have a diameter that may be substantially equal to the width of the slotted apertures of the "over" structural plates 3110.

Based on the combination of features of: (i) aperture-to-aperture distance among adjacent pairs of apertures of the "over" structural plate 3110 being greater than that of the "under" structural plate 3150; and (ii) the "over" structural plate 3110 including slotted apertures, in contrast to the "under" structural plate including round apertures, interconnected structural plates may have overlapping alignment of apertures allowing fasteners to be received therein, despite misalignment of centroids of the respective overlapped circumferential apertures.

Although some embodiments describe the "over" structural plate as having slotted apertures, in some embodiments, the "under" structural plate may have slotted apertures whilst the "over" structural plate may have substantially round apertures.

To strengthen an interconnection of structural plates at adjacent transverse edges, it may be beneficial for opposing joiner plate edges to be configured to overlap corresponding opposing structural plate circumferential edges. To configure such joiner plate features, in some embodiments, joiner plates may be alternately positioned on an "outer" surface and an "inner" surface of the arch-shaped structure. For example, for the alternating "over" structural plates 3110, the joiner plates 3120 may be positioned on an "outer" surface 3190 of the arch-shaped structure 3100.

As the arch-shaped structure 3100 may be constructed with alternating "over" structural plates 3110 and "under" structural plates 3150, it may not be feasible to position joiner plates that interconnect "under" structural plates on the "outer" surface of the arch-shaped structure 3100. In some embodiments, joiner plates 3160 for securing adjacent "under" structural plates 3150 may be positioned on an "inner" surface 3192 of the arch-shaped structure 3100.

In some embodiments, the positioning of: (a) the joiner plates 3120 positioned on the "outer" surface 3190 of the arch-shaped structure 3100; and (b) the joiner plates 3160 positioned on the "inner" surface 3192 of the arch-shaped structure 3100 may be staggered, as illustrated in FIG. 31.

FIG. 32 illustrates an enlarged, rear perspective view of the arch-shaped structure 3100 of FIG. 31. In FIG. 32, the joiner plates 3160 for securing "under" structural plates 3160 is shown.

FIG. 33 illustrates a top plan view of the arch-shaped structure 3100 of FIG. 31. As illustrated in FIG. 33, the interconnection position of transverse edges of the "over" structural plates 3110 may be offset or staggered from the interconnection position of transverse edges of the "under" structural plates 3150. Other offset or staggering positions may be contemplated.

Further, the joiner plate 3120 illustrated in FIG. 33 may be known as a "full-width" joiner plate at least because the opposing joiner circumferential edges may overlap with the corresponding opposing circumferential edges of the structural plates.

"Full-width" joiner plates may be contrasted with joiner plates having at least one joiner circumferential edge configured to be positioned at least partially in a trough portion of a structural plate (see e.g., the second circumferential joiner plate 774 illustrated in FIG. 8).

Figure 34C:
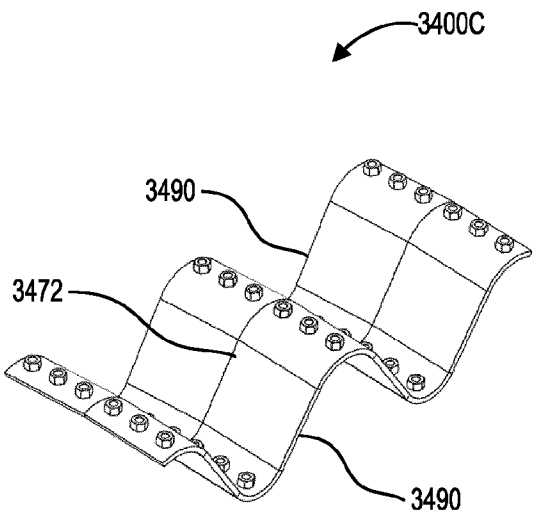
FIGS. 34A, 34B, and 34C illustrate perspective views of joiner plates, in accordance with embodiments of the present disclosure.
Figure 34B:
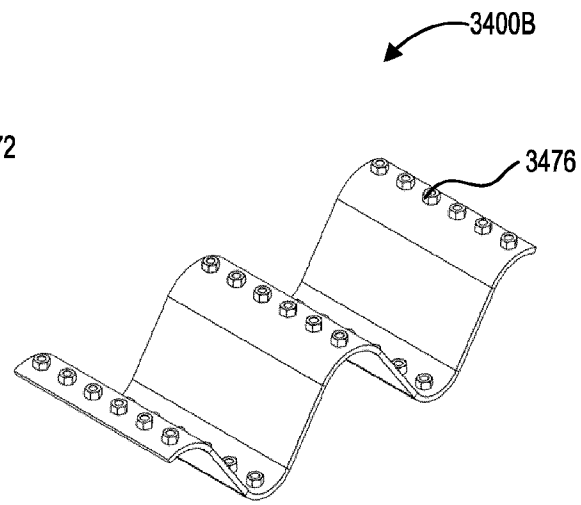
Figure 34A:
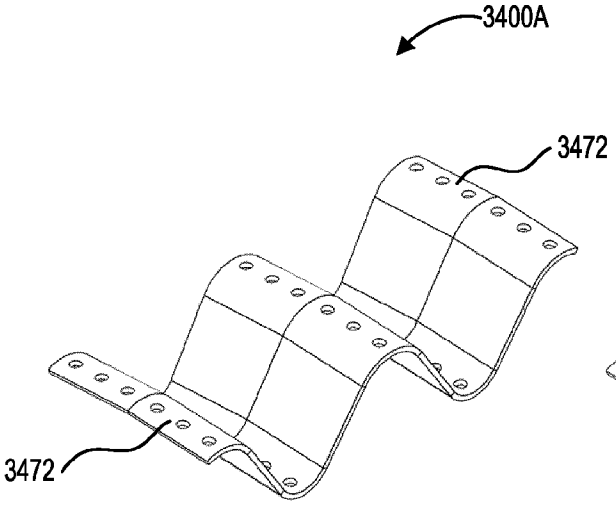

Reference is made to FIGS. 34A, 34B, and 34C, which illustrate joiner plates, in accordance with embodiments of the present disclosure. FIG. 34A illustrates a joiner plate 3400A that may be a "full-width" joiner plate. For example, the joiner plate 3400A may include opposing joiner circumferential edges configured to overlap with corresponding circumferential edges of a structural plate. The joiner plate 3400A may include apertures positioned at the peak corrugation portion and the trough corrugation portions.

FIG. 34B illustrates a joiner plate 3400B having features similar to the joiner plate 3400A of FIG. 34A. In FIG. 34B, the joiner plate 3400B additionally includes one or more fastening nuts 3476 welded adjacent respective joiner apertures. In some embodiments, the fastening nuts may be threaded and may be configured to receive a fastening bolt that may be threaded through the respective joiner aperture.

FIG. 34C illustrates a joiner plate 3400C having features similar to joiner plate 3400B. In FIG. 34C, the joiner plate 3400C may include an inflection score 3470 between transverse joiner edges 3490. The inflection score 3470 may divide portions of the joiner plate 3400C being in different planes. The joiner plate 3400C may accommodate flat portions of corrugated metal plates that may not be curved with a radius (similar to inflection score features described with reference to FIG. 12A).

Figure 35B:
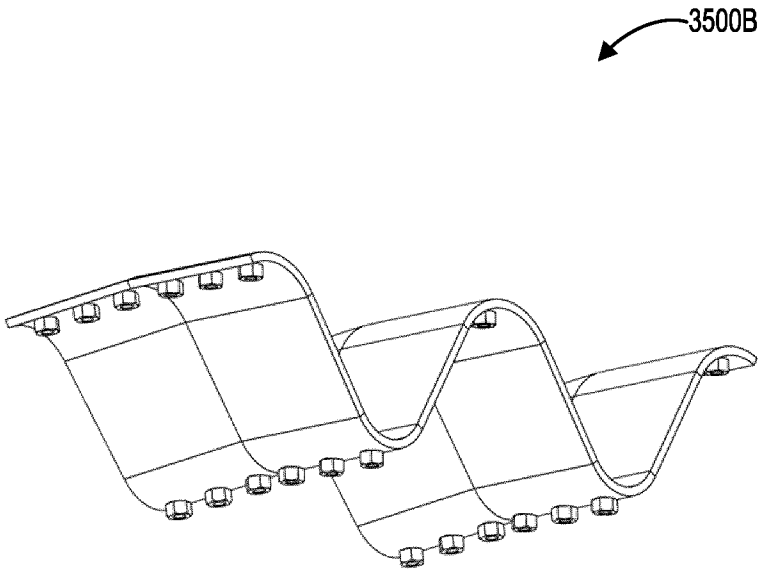
FIGS. 35A and 35B illustrate perspective views of joiner plates, in accordance with embodiments of the present disclosure.
Figure 35A:
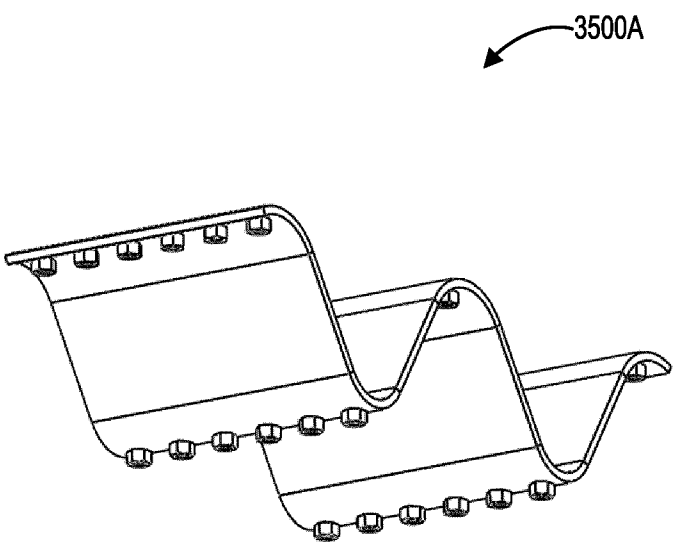

Reference is made to FIGS. 35A and 35B, which illustrate joiner plates, in accordance with embodiments of the present disclosure. FIG. 35A illustrates a joiner plate 3500A that may be configured to secure "under" structural plates 3150 (FIG. 31) and may include features similar to the joiner plate 3400B illustrated in FIG. 34B.

FIG. 35B illustrates a joiner plate 3500B that may be configured to secure "under" structural plates 3150 (FIG. 31) and may include features similar to the joiner plate 3400C illustrated in FIG. 34C.

Figure 36B:
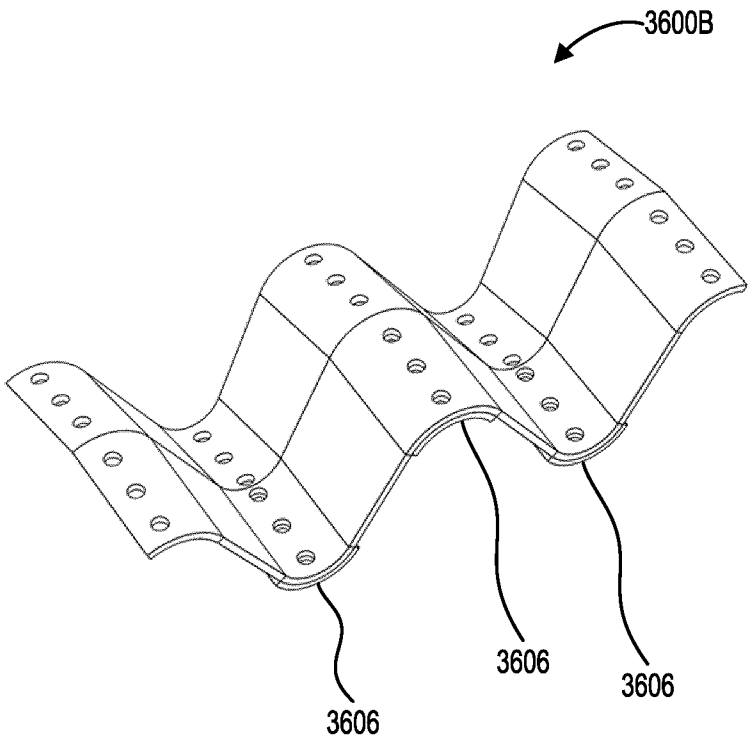
FIGS. 36A and 36B illustrate perspective views of joiner plates, in accordance with embodiments of the present disclosure.
Figure 36A:
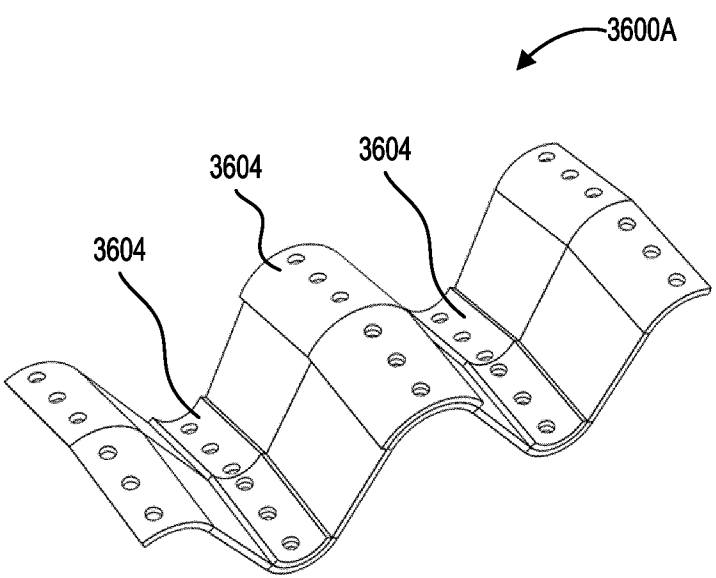

Reference is made to FIGS. 36A and 36B, which illustrate perspective views of joiner plates, in accordance with embodiments of the present disclosure. FIG. 36A illustrates a joiner plate 3600A that may be configured to secure "over" structural plates 3110 (FIG. 31). The joiner plate 3600A may include one or more supplemental masses 3604 positioned within or adjacent a crest or trough of the respective corrugations. The supplemental masses 3604 may be configured to reduce bending moments or stresses on the joiner plate 3600A.

FIG. 36B illustrates a joiner plate 3600B that may be configured to secure "under" structural plates 3150 (FIG. 31). The joiner plate 3600B may include one or more supplemental masses 3606 configured to reduce pending moments or stresses on the joiner plate 3600B.

Figure 37B:
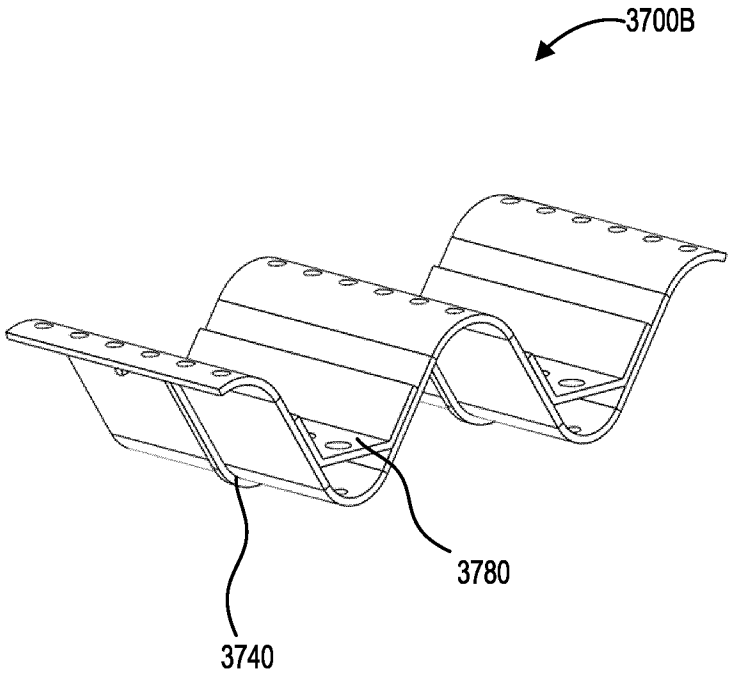
FIGS. 37A and 37B illustrate perspective views of joiner plates, in accordance with embodiments of the present disclosure.
Figure 37A:
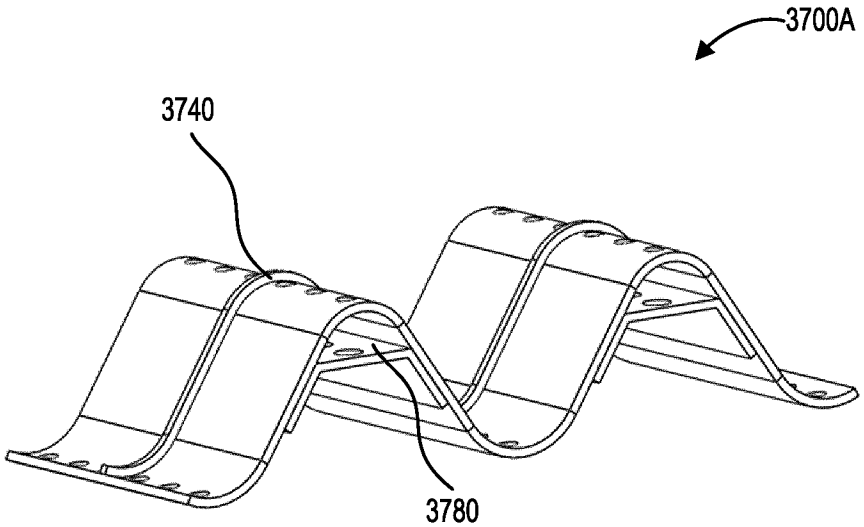

Reference is made to FIGS. 37A and 37B, which illustrate perspective views of joiner plates, in accordance with embodiments of the present disclosure. The joiner plate 3700A of FIG. 37A includes a transverse rib 3740 that may be constructed of PVC, rubber, or other material that may be configured to prevent or reduce passage of fluids through a non-overlapping interface between transverse edges of respective adjacent structural plates that are joined by the joiner plate 3700A. The joiner plate 3700A may include a lateral support member 3780, and may be configured to reduce bending moments or other compression loads imparted on the joiner plate 3700A. In some examples, the joiner plate 3700A may be positioned on an "inner" side of a box-shaped structure (e.g., similar to that illustrated in FIG. 32).

The joiner plate 3700B of FIG. 37B includes features similar to the joiner plate 3700A of FIG. 37A, and may be positioned on an "outer" side of a box-shaped structure for securing adjacent structural plates.

Figure 38:
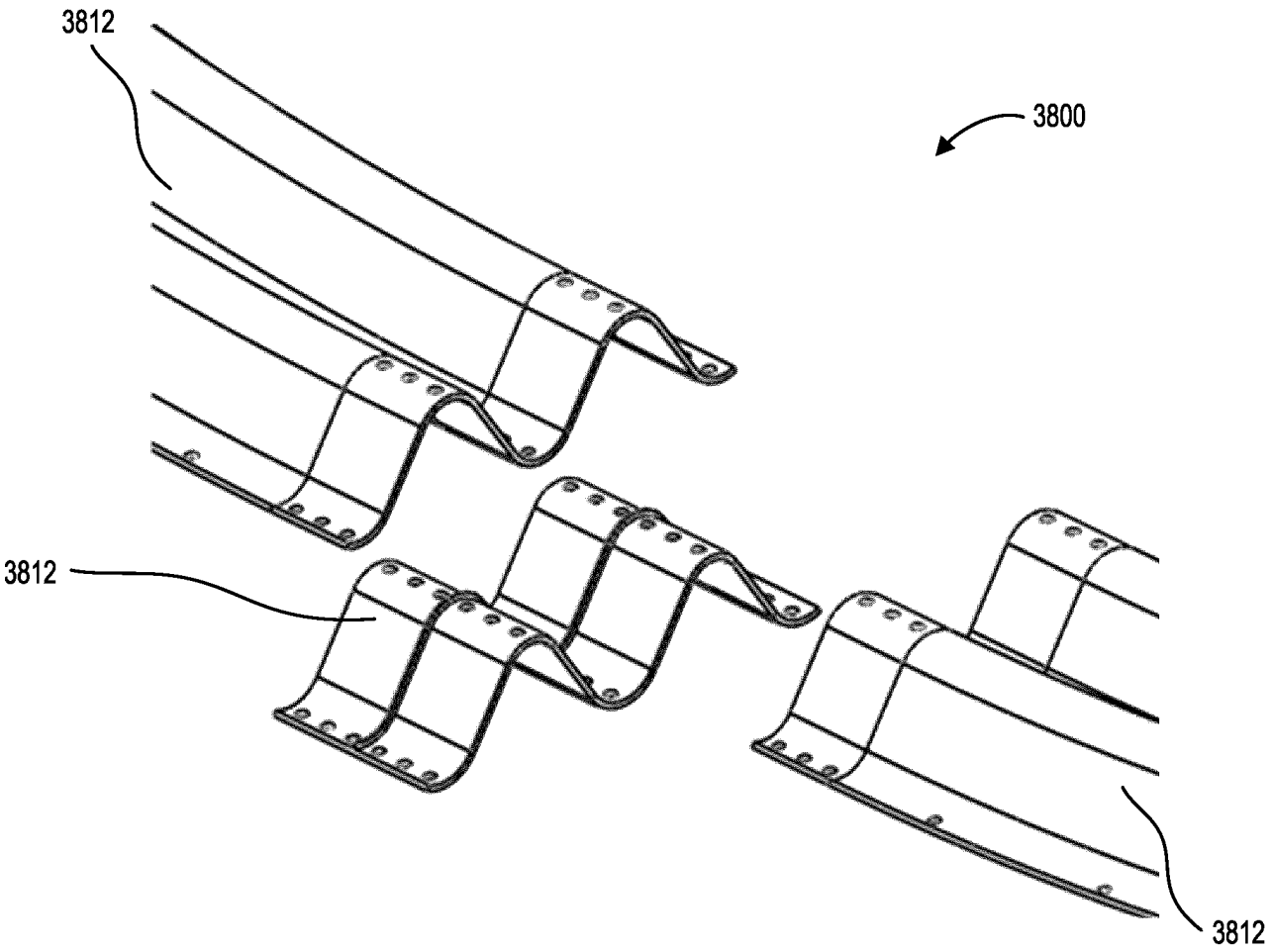
FIG. 38 illustrates an exploded view of adjacent structural plates and a joiner plate, in accordance with an embodiment of the present disclosure.

Reference is made to FIG. 38, which illustrates an enlarged exploded view 3800 of adjacent structural plates 3812. The respective structural plates 3812 may be secured at respective transverse edges by the joiner plate 3850. The joiner plate 3850 may be similar to the joiner plate illustrated in FIG. 16A, and may be a "full-width" joiner plate. The "full-width" joiner plate may have opposing joiner circumferential edges that may be positioned to abut corresponding circumferential edges of the structural plates. The joiner plate 3850 may be configured to be positioned on an "inner" side of a box-shaped structure.

Figure 39:
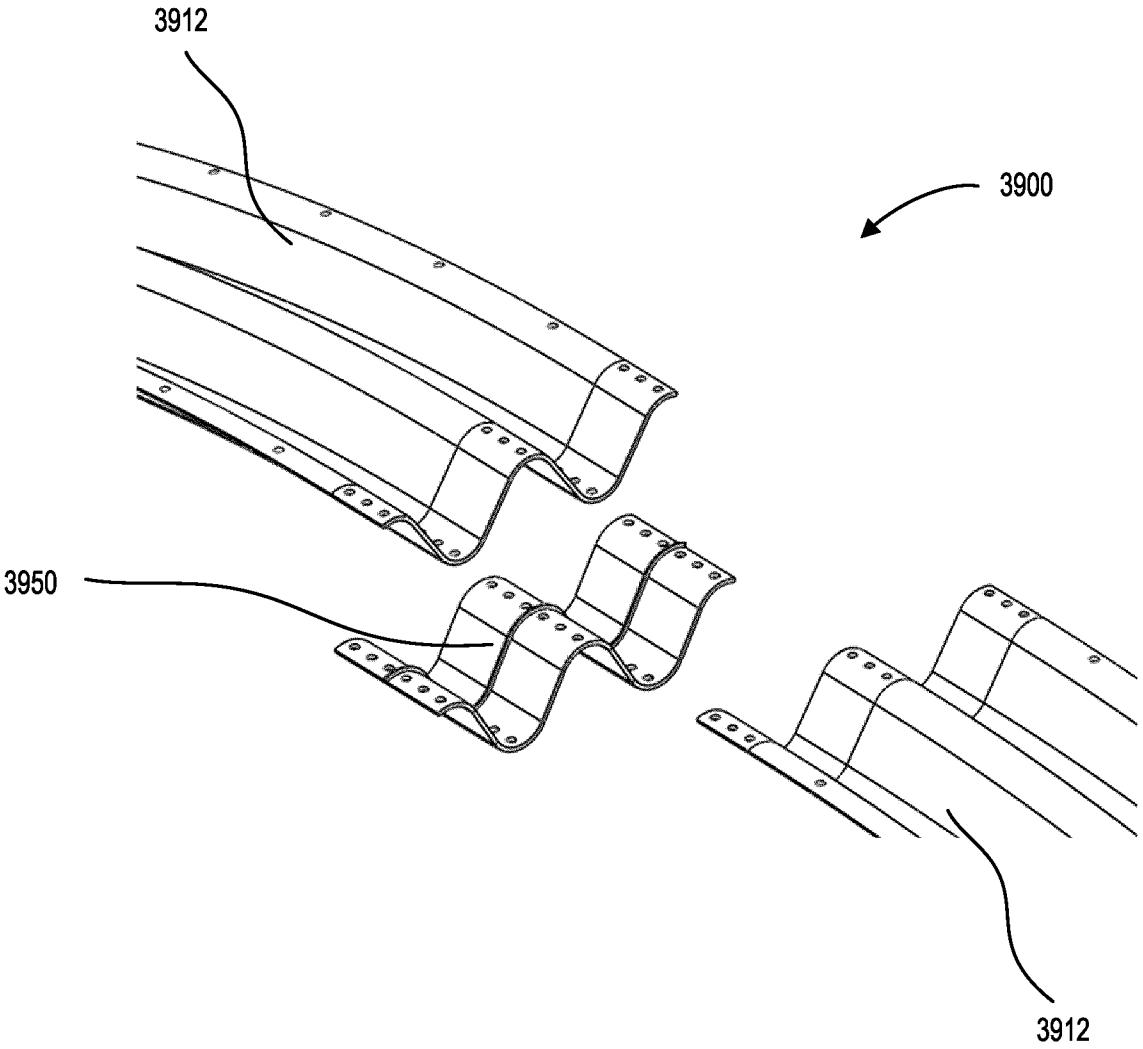
FIG. 39 illustrates an exploded and partially-exploded view of adjacent structural plates and a joiner plate, in accordance with an embodiment of the present disclosure.

Reference is made to FIG. 39 illustrates enlarged exploded view 3900 of adjacent structural plates. The respective structural plates 3912 may be secured at respective transverse edges by the joiner plate 3850. The joiner plate 3850 may be similar to the joiner plate illustrated in FIG. 38 and may be configured to be positioned on an "outer" side of a box-shaped structure.

Figure 40B:
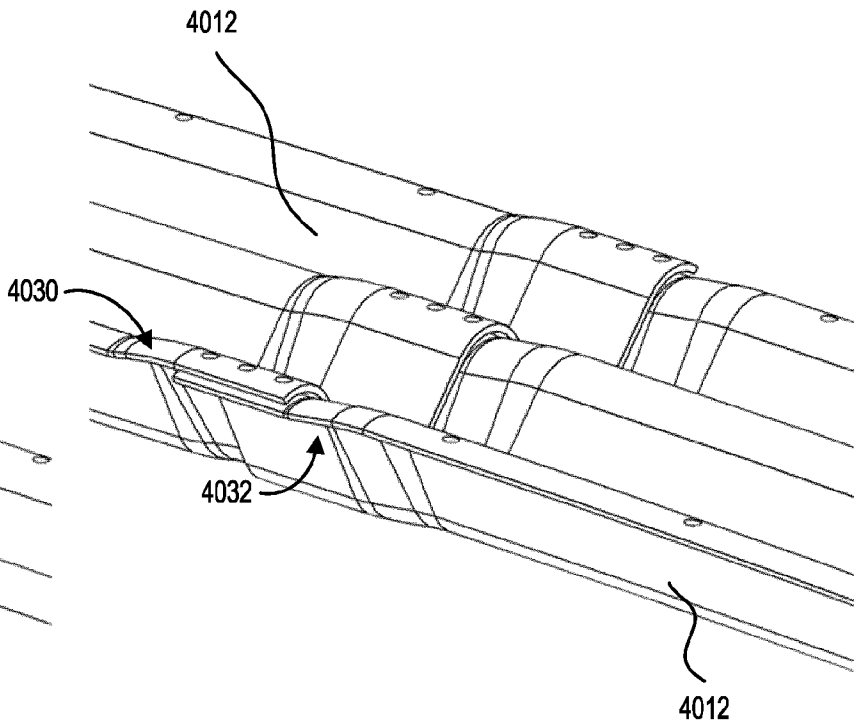
FIGS. 40A and 40B illustrate perspective views of adjacent structural plates, in accordance with embodiments of the present disclosure.
Figure 40A:
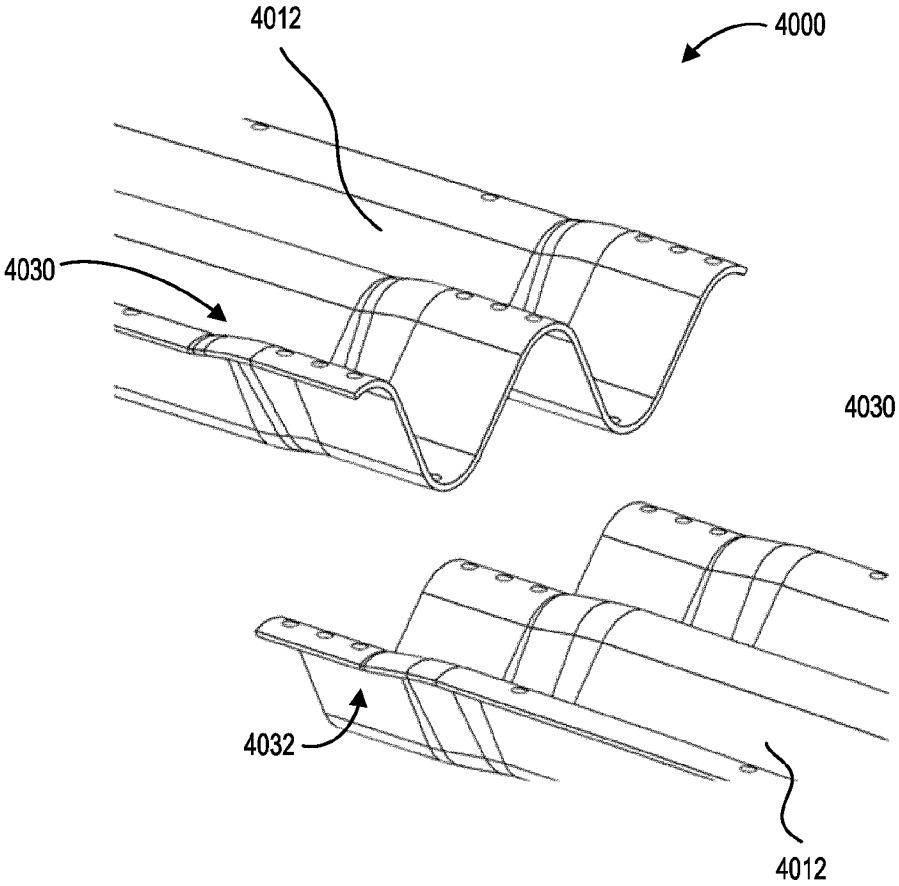

In some scenarios, it may be beneficial to provide structural plate features to promote alignment of structural plates prior to fastening the structural plates. Reference is made to FIGS. 40A and 40B, which illustrate enlarged partial perspective views of adjacent structural plates 4000, in accordance with embodiments of the present disclosure. The structural plates 4012 may include at least one swagged transverse end. For example, a first structural plate may include a transverse end that may include an "over" swagged transverse end 4030. The "over" swagged transverse end 3040 may include features whereby the transverse end may be transitioned to an elevated position relative to the circumferential direction of the structural plate 4012. An adjacent structural plate may include a transverse end that may include an "under" swagged transverse end 4032 that may be transitioned to a position lower in elevation relative to the circumferential direction of the structural plate 4012.

When an "over" swagged transverse end 4030 of the first structural plate and the "under" swagged transverse end 4030 of the adjacent structural plate are arranged in an overlapping arrangement, the respective transverse ends may be guided into alignment, such that apertures proximal to the respective transverse ends may align for receiving fasteners. FIG. 40B illustrates the swagged transverse ends positioned in overlapping arrangement.

Figure 41B:
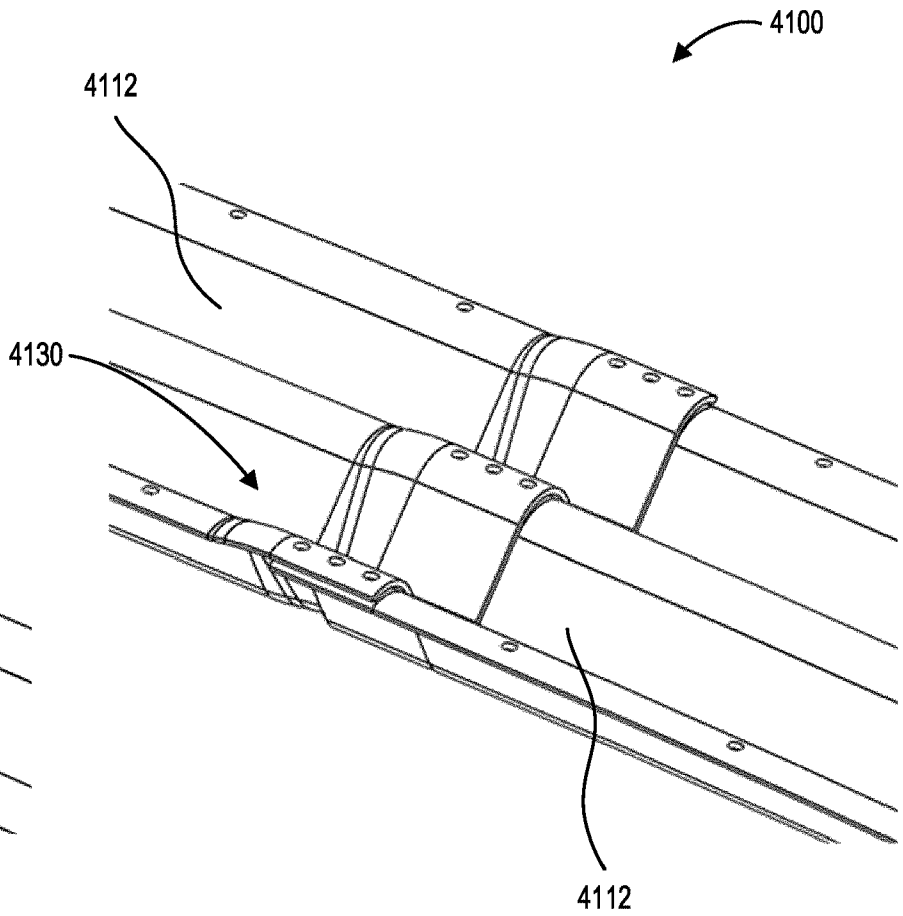
FIGS. 41A and 41B illustrate perspective views of adjacent structural plates, in accordance with embodiments of the present disclosure.
Figure 41A:
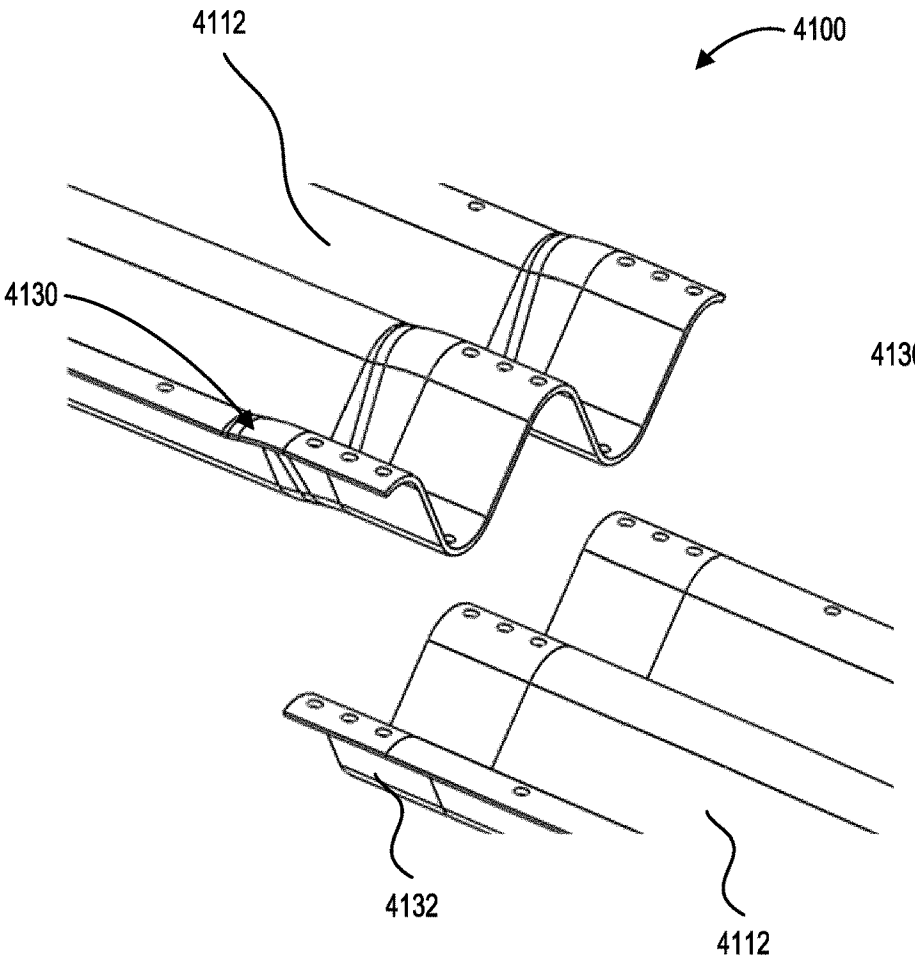

Reference is made to FIGS. 41A and 41B, which illustrate enlarged partial perspective views of adjacent structural plates 4100, in accordance with embodiments of the present disclosure. The structural plates 4012 may include an "over" swagged transverse end 4030 and an opposing transverse end 4032 that may not be swagged or otherwise include any features to alter the circumferential elevation to such transverse end. In some embodiments, the opposing transverse end 4032 may not be radiused (e.g., having an infinite radius), as compared to other portions of the structural plate.

FIG. 41B illustrates the "over" swagged transverse end 4030 of a first adjacent plate in overlapping arrangement with the opposing transverse end 4032 that may not have been otherwise swagged.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein without departing from the scope. Moreover, the scope of the present disclosure is not intended to be limited to the particular embodiments of the process, machine, manufacture, composition of matter, means, methods and steps described in the specification.

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

The description provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As can be understood, the examples described above and illustrated are intended to be exemplary only.

Applicant notes that the described embodiments and examples are illustrative and non-limiting. Practical implementation of the features may incorporate a combination of some or all of the aspects, and features described herein should not be taken as indications of future or existing product plans. Applicant partakes in both foundational and applied research, and in some cases, the features described are developed on an exploratory basis.

What is claimed is:

1. An arch-shaped structure comprising:

a first pair of structural plates respectively having plate corrugations extending transversely of a longitudinal length of the arch-shaped structure, the respective plates of the first pair of structural plates including a transverse end having at least one plate aperture adjacent a transverse edge, wherein the respective plates of the first pair of structural plates include a first pair of circumferential plate edges;

a first joiner plate securing the first pair of structural plates in non-overlapping arrangement at first non-overlapping transverse edges of the first pair of structural plates, wherein the first joiner plate includes joiner corrugations nested with the plate corrugations, and wherein the first joiner plate includes at least one joiner aperture aligning with the at least one plate aperture of the respective plates of the first pair of structural plates to receive fastening bolts, and wherein the first joiner plate includes a pair of first circumferential joiner edges, and wherein the respective first circumferential joiner edges overlap corresponding first circumferential plate edges;

a second pair of structural plates respectively including a second pair of circumferential plate edges, the second pair of structural plates joined to the first pair of structural plates by overlapping abutment along circumferential plate edges; and a second joiner plate securing the second pair of structural plates in non-overlapping arrangement at second non-overlapping transverse edges of the second pair of structural plates, and wherein the second joiner plate includes a pair of second circumferential joiner edges, and wherein the respective second circumferential joiner edges overlap corresponding second circumferential plate edges, and wherein the first non-overlapping transverse edges being offset from the second non-overlapping transverse edges in a circumferential direction, and wherein the first circumferential joiner edges and the second circumferential joiner edges are non-overlapping.

2. The arch-shaped structure of claim 1, wherein the first joiner plate or the second joiner plate secures the corresponding first pair or second pair of structural plates in non-overlapping abutment at the respective transverse edges.

3. The arch-shaped structure of claim 1, wherein at least one of the plates of the first pair of structural plates is joined to a third structural plate by overlapping abutment along a circumferential plate edge.

4. The arch-shaped structure of claim 1, wherein the respective plates of the first pair or the second pair of structural plates include a first circumferential plate edge having a first series of spaced apertures adjacent to the first circumferential plate edge, the respective spaced apertures being successively spaced from the transverse edge, and wherein the respective plates of the first pair or the second pair of structural plates include a second circumferential plate edge having a second series of spaced apertures adjacent to the second circumferential plate edge, the respective spaced apertures of the second series of spaced apertures being offset from the first series of spaced apertures relative to the transverse edge.

5. The arch-shaped structure of claim 4, wherein the offset of the respective spaced apertures of the second series of spaced apertures from the first series of spaced apertures relative to the transverse edge is a function of the structural plate thickness.

6. The arch-shaped structure of claim 1, wherein at least one of a pitch, depth, or radius of the joiner corrugations differs from a pitch, depth, or radius of the plate corrugations to allow nesting of the joiner corrugations with the plate corrugations.

7. The arch-shaped structure of claim 1, wherein at least one of the first joiner plate or the second joiner plate includes a lateral member affixed within at least one trough of the joiner corrugations.

8. The arch-shaped structure of claim 1, wherein at least one of the first pair or second pair of structural plates includes a first structural plate having a first series of spaced apertures proximal to at least one circumferential plate edge of the first structural plate; and wherein the arch-shaped structure includes:

an adjacent structural plate having a second series of spaced apertures proximal to at least one circumferential plate edge of the adjacent structural plate in overlapping arrangement with the first series of spaced apertures for receiving at least one fastener within overlapping apertures of the first series and the second series, and wherein a first aperture-to-aperture spacing distance between adjacent aperture pairs of the first series of spaced apertures is greater than a second aperture-to-aperture spacing distance between adjacent aperture pairs of the second series of spaced apertures.

9. The arch-shaped structure of claim 8, wherein the first series of spaced apertures includes slotted apertures in overlapping arrangement with the second series of spaced apertures.

10. The arch-shaped structure of claim 9, wherein the second series of spaced apertures includes circular apertures having a diameter substantially equal to a width of the slotted apertures.

11. The arch-shaped structure of claim 1, including a sealing compound received within at least one of the first or the second non-overlapping transverse edges of the first pair or the second pair of structural plates.

12. The arch-shaped structure of claim 1, wherein at least one of the first joiner plate or the second joiner plate includes a brake between transverse ends of the first joiner plate or the second joiner plate.

13. The arch-shaped structure of claim 1, wherein at least one of the first joiner plate or the second joiner plate secures a corresponding pair of structural plates in non-overlapping abutment at the respective transverse edges of the pair of structural plates on an inner surface of the pair of structural plates.

14. A method of assembling the arch-shaped structure of claim 1, the method comprising:

positioning the first pair of structural plates in non-overlapping arrangement at the first non-overlapping transverse edges of the first pair of structural plates;

placing the first joiner plate adjacent a portion of the non-overlapping arrangement such that the at least one joiner plate aperture aligns with at least one plate aperture of the respective plates of the first pair of structural plates; and fastening at least one fastening bolt in the at least one joiner plate aperture that is aligned with the at least one plate aperture of the respective plates of the first pair of structural plates.

15. The method of claim 14, wherein the respective plates of the first pair of structural plates include the plate corrugations extending transversely of the longitudinal length of the arch-shaped structure, and wherein the first joiner plate includes the joiner corrugations nested with the plate corrugations, the method comprising:

aligning the plate corrugations with the joiner corrugations to nest the joiner corrugations with the plate corrugations.

16. The method of claim 14, further comprising:

positioning a third structural plate along the circumferential plate edge of at least one of the first pair of structural plates in overlapping abutment; and fastening a fastening bolt in aligned plate apertures proximal the respective circumferential plate edges of the third structural plate and at least one of the first pair of structural plates.

17. The method of claim 14, wherein fastening the at least one fastening bolt joins the pair of structural plates to form a structural ring, the method comprising:

assembling a first set of structural rings;

positioning, on a foundation, the first set of structural rings successively and respectively placed apart from an adjacent structural ring in a longitudinal direction of the arch-shaped structure;

positioning additional structural rings between respective spaced-apart structural rings of the first set of structural rings, thereby lapping circumferential edges of the additional structural rings atop the respective spaced-apart structural rings of the first set of structural rings; and fastening the additional structural rings to the respective structural rings of the first set along the circumferential edges.

18. A kit for constructing an arch-shaped structure comprising:

a first pair of structural plates respectively having plate corrugations extending transversely of a longitudinal length of the arch-shaped structure, the respective plates of the first pair of structural plates including a transverse end having at least one plate aperture adjacent a transverse edge, wherein the respective plates of the first pair of structural plates include a first pair of circumferential plate edges; and a first joiner plate configured to secure the first pair of structural plates in non-overlapping arrangement at first non-overlapping transverse edges of the first pair of structural plates, wherein the first joiner plate includes joiner corrugations configured to nest with the plate corrugations, and wherein the first joiner plate includes at least one joiner aperture aligning with the at least one plate aperture of the respective plates of the first pair of structural plates to receive fastening bolts, and wherein the first joiner plate includes a pair of circumferential joiner edges, and wherein the respective first circumferential joiner edges is configured to overlap corresponding first circumferential plate edges;

a second pair of structural plates respectively including a second pair of circumferential plate edges, the second pair of structural plates configured to join to the first pair of structural plates by overlapping abutment along circumferential plate edges; and a second joiner plate configured to secure the second pair of structural plates in non-overlapping arrangement at second non-overlapping transverse edges of the second pair of structural plates, and wherein the second joiner plate includes a pair of second circumferential joiner edges, and wherein the respective second circumferential joiner edges are configured to overlap corresponding second circumferential plate edges, and wherein the first non-overlapping transverse edges are configured to be offset from the second non-overlapping transverse edges in a circumferential direction, and wherein the first circumferential joiner edges and the second circumferential joiner edges are non-overlapping.

19. The kit of claim 18, wherein the first joiner plate or the second joiner plate is configured to secure the corresponding first pair or second pair of structural plates in non-overlapping abutment at the respective transverse edges.

20. The kit of claim 18, wherein at least one of the first pair of structural plates is configured to be joined to a third structural plate by overlapping abutment along a circumferential plate edge.

21. The kit of claim 18, wherein the respective plates of the first pair or second pair of structural plates include a first circumferential plate edge having a first series of spaced apertures adjacent to the first circumferential plate edge, the respective spaced apertures being successively spaced from the transverse edge, and wherein the respective plates of the first pair or second pair of structural plates include a second circumferential plate edge having a second series of spaced apertures adjacent to the second circumferential plate edge, the respective spaced apertures of the second series of spaced apertures configured to be offset from the first series of spaced apertures relative to the transverse edge.

22. A kit of claim 21, wherein the offset of the respective spaced apertures of the second series of spaced apertures from the first series of spaced apertures relative to the transverse edge is a function of the structural plate thickness.

23. A kit of claim 18, wherein at least one of a pitch, depth, or radius of the joiner corrugations is configured to be different from a pitch, depth, or radius of the plate corrugations to allow nesting of the joiner corrugations with the plate corrugations.

24. A kit of claim 18, wherein at least one of the first joiner plate or the second joiner plate includes a lateral member configured to be affixed within at least one trough of the joiner corrugations.

* * * * *